US008181697B2

(12) United States Patent
Springett et al.

(10) Patent No.: US 8,181,697 B2
(45) Date of Patent: May 22, 2012

(54) MULTI-FUNCTION MULTI-HOLE DRILLING RIG

(75) Inventors: Frank Benjamin Springett, Spring, TX (US); David Gilbert Reid, Spring, TX (US); Guy L. McClung, III, Spring, TX (US)

(73) Assignee: National Oilwell Varco L.P., Houston, TX (US)

( * ) Notice: Subject to any disclaimer, the term of this patent is extended or adjusted under 35 U.S.C. 154(b) by 428 days.

(21) Appl. No.: 12/316,801

(22) Filed: Dec. 15, 2008

(65) Prior Publication Data

US 2010/0038088 A1 Feb. 18, 2010

Related U.S. Application Data

(60) Provisional application No. 61/189,146, filed on Aug. 15, 2008.

(51) Int. Cl.
*E21B 43/12* (2006.01)

(52) U.S. Cl. ..... 166/52; 166/313

(58) Field of Classification Search ..... 166/52, 166/313, 76.1, 102; 175/57, 161, 220
See application file for complete search history.

(56) References Cited

U.S. PATENT DOCUMENTS

| | | | | |
|---|---|---|---|---|
| 2,840,198 | A | 6/1958 | Woolslayer et al. | |
| 3,486,737 | A | 12/1969 | Campbell | 254/106 |
| 4,108,255 | A | 8/1978 | Smith | 175/9 |
| 4,208,158 | A * | 6/1980 | Davies et al. | 414/22.68 |
| 4,616,454 | A | 10/1986 | Ballachey et al. | 52/115 |
| 4,744,710 | A | 5/1988 | Reed | 414/22 |
| 4,819,730 | A * | 4/1989 | Williford et al. | 166/355 |
| 4,899,832 | A | 2/1990 | Bierscheid, Jr. | 173/23 |
| 5,107,940 | A | 4/1992 | Berry | 175/85 |
| 5,492,436 | A | 2/1996 | Suksumake | 405/201 |
| 6,047,781 | A | 4/2000 | Scott et al. | 175/5 |
| 6,056,071 | A | 5/2000 | Scott et al. | 175/5 |
| 6,068,069 | A | 5/2000 | Scott et al. | 175/5 |
| 6,085,851 | A | 7/2000 | Scott et al. | 175/7 |
| 6,158,516 | A | 12/2000 | Smith et al. | 166/385 |
| 6,161,358 | A | 12/2000 | Mochizuki et al. | 52/651.05 |
| 6,203,247 | B1 * | 3/2001 | Schellstede et al. | 405/196 |
| 6,343,892 | B1 | 2/2002 | Kristiansen | 405/195.1 |

(Continued)

FOREIGN PATENT DOCUMENTS

WO WO2004/035985 4/2004

(Continued)

OTHER PUBLICATIONS

PCT/US2009/053849 International Search Report (Dec. 2, 2009).

(Continued)

*Primary Examiner* — William P Neuder
*Assistant Examiner* — Richard Alker
(74) *Attorney, Agent, or Firm* — Williams, Morgan & Amerson, P.C.

(57) ABSTRACT

A multi-function multi-hole rig is disclosed which, in certain aspects, includes multiple machines for accomplishing rig functions, e.g. drilling machine(s), tripping machine(s), casing machine(s), and/or cementing machine(s), for producing multiple usable wellbores one after the other. This abstract is provided to comply with the rules requiring an abstract which will allow a searcher or other reader to quickly ascertain the subject matter of the technical disclosure and is submitted with the understanding that it will not be used to interpret or limit the scope or meaning of the claims, 37 C.F.R. 1.72(b).

74 Claims, 45 Drawing Sheets

U.S. PATENT DOCUMENTS

| | | | | |
|---|---|---|---|---|
| 6,443,240 | B1 | 9/2002 | Scott | 175/7 |
| 6,766,860 | B2 | 7/2004 | Archibald et al. | 166/341 |
| 6,932,553 | B1 | 8/2005 | Roodenburg et al. | 414/22.51 |
| 6,968,905 | B2 * | 11/2005 | Adnan et al. | 166/384 |
| 6,973,979 | B2 | 12/2005 | Carriere et al. | 175/203 |
| 7,320,374 | B2 | 1/2008 | Folk et al. | 175/220 |
| 7,377,335 | B2 | 5/2008 | Jones et al. | 175/57 |
| 7,401,656 | B2 | 7/2008 | Wood et al. | 166/384 |
| 2002/0074125 | A1 | 6/2002 | Fikes et al. | 166/352 |
| 2003/0098150 | A1 | 5/2003 | Andreychuk | 166/77.2 |
| 2004/0200641 | A1 | 10/2004 | Jones et al. | 175/57 |
| 2007/0251725 | A1 | 11/2007 | Banks | 175/5 |
| 2008/0023228 | A1 | 1/2008 | Stevens | 175/57 |
| 2009/0025937 | A1 | 1/2009 | Robinson et al. | 166/351 |

FOREIGN PATENT DOCUMENTS

| | | | |
|---|---|---|---|
| WO | WO2008/103156 | A2 | 8/2008 |
| WO | WO2008/118914 | | 10/2008 |
| WO | WO2010/019858 | A1 | 2/2010 |

OTHER PUBLICATIONS

PCT Search Report and Written Opinion from PCT/US2010/058835 dated Feb. 21, 2012.

* cited by examiner

MULTI-FUNCTION MULTI-HOLE DRILLING RIG

CROSS-REFERENCE TO RELATED APPLICATION

This application claims the benefits under the Patent Laws of U.S. Application Ser. No. 61/189,146 filed Aug. 15, 2008 including claiming priority therefrom and said application is incorporated fully herein by reference for all purposes.

BACKGROUND OF THE INVENTION

1. Field of the Invention

This invention is directed to drilling oil and gas wellbores in the earth; in certain particular aspects, to drilling and completing such multiple wellbores from a single drilling rig; and, in certain particular aspects, to drilling and completing such multiple wellbores so that they are relatively close to each other.

2. Description of Related Art

A wide variety of drilling rigs and methods are known for drilling oil and gas wellbores in the earth. In many known systems and methods, a single wellbore is drilled with a drilling rig and then, to drill another wellbore, the drilling rig is moved to a new location, often near the drilled wellbore. By way of example only (and not as a definitive or exhaustive disclosure) the following U.S. Patents and Application disclose drilling rigs and/or methods of the use of rigs (all incorporated fully herein for all purposes): U.S. Pat. Nos. 2,840,198; 4,108,255; 4,616,454; 6,068,069; 6,161,358; 6,443,240; 6,766,860 and Application No. 2007/0251725A1.

Many patents and publications illustrate and describe in detail known drilling rigs. By way of example only (and not as a definitive or exhaustive disclosure), U.S. Pat. No. 7,320,374 discloses systems and methods as shown in FIGS. 1A and 1B in which a known top drive system TDS1 in a derrick 140 is suspended from a block becket 18 which is suspended from the derrick 140 in a typical manner. A standard block and hook for hooking a standard becket may be used. An elevator 74 supports a tubular stand 142 which includes two pieces (or three) of drill pipe 143. The stand 142 has been moved from a monkey board 145 with multiple made-up stands 149 to a position axially aligned with a wellbore 147. A mouse hole 144 may be used, e.g. to make stands. A driller controls drilling from a driller's panel 141. The stands 149 are located at a setback position ST. Optionally, the system includes an emergency brake system and/or an emergency shut down device and, optionally, either or both are controllable from the panel 141.

Also by way of example only, as shown in FIG. 2 U.S. Pat. No. 5,107,940 discloses a known system TDS2 which includes a power swivel 30 and guide mechanism 51 mounted on a mast 102 of a conventional portable rotary earth drilling rig generally designated by the numeral 100. As will hereinafter be more fully explained, the power swivel 30 is pivotally secured through a floating torque arm assembly, called a carriage 70, to a pair of dollies 75 movable longitudinally on a guide track 51 mounted on the mast 102. The guide mechanism 51 illustrated in FIGS. 7-9, and the carriage 70, illustrated in FIGS. 10 and 11 of the drawings, form a torque restraint system.

The drilling rig 100 is a conventional 118 foot vehicle-mounted hydraulically telescoping derrick, having an inclined mast 102 with a hook load capacity of, for example 365,000 pounds. The mast 102 is typically inclined at a lean angle 119 of 3½ degrees relative to a vertical axis 125 centered over the well.

The mast 102 is pivotally mounted on a trailer 104 and is transported in a horizontal position with the upper mast section 115 telescoped into the lower mast section 110. When the mast 102 is erected, the telescoped sections 110 and 115 are rotated approximately 90 degrees about a horizontal axis to a vertical position by hydraulically-actuated rams 106. After legs on the lower mast section 110 engage the ground or other supporting surface, hydraulic fluid is delivered to hydraulically-actuated cylinders which raise the upper mast section 115 to the position illustrated in FIG. 1, wherein only the lower end of the upper section 115 extends downwardly into the upper end of the lower section 110.

The trailer-mounted rig includes a single drum drawworks 105 powered by diesel engines 103 through conventional transmissions and a compound box. A fast line 107 extends from drawworks 105 upwardly over a crown block 108, as illustrated in FIG. 1, to provide a number of lines 109 which carry a traveling block 112 connected to the power swivel 30 in the top drive system 20. A conventional folding substructure 140, equipped with a V-door 142, a catwalk 145, and two sets of pipe racks (not shown), parallel and juxtaposed to the catwalk, are mounted adjacent to the inclined telescoping mast 102.

The stand assembly system consists of a crown cantilevered single joint elevator snatch block 21 mounted directly over the mouse hole, an auxiliary cable 22, a live swivel assembly 23 and a single joint elevator 148. The system is permanently installed in the rig for use at any time.

The auxiliary cable 22 is designed to quickly attach to existing hydraulic or pneumatically-powered auxiliary tugger lines and is used to hoist a single joint 24' from the pipe ramp to the mouse hole, and to hoist a complete stand 25 from the mouse hole to the fingerboard 136 and set the stand 25 back on the setback SK.

The single joint elevator 148 is a specially-designed elevator with, for example, a 2,000 pound hoisting capacity for quick attachment to and release from the drill pipe. It is attached to the auxiliary cable 22 utilizing a live swivel assembly 23 to prevent upspiraling of the cable while shouldering up a stand 25 in the mouse hole.

During operation, a stand 25 is attached to or removed from the drill string 150, utilizing elevator 48.

The guide track 51 is rigid and continuous; it extends longitudinally along mast 102. The guide track 51 is formed in at least two segments: a lower guide track segment 52, and an upper guide track segment 54, secured to the lower mast segment 110 and upper mast segment 120 115, respectively (see FIG. 1). The guide track 51 shown can be comprised of, for example 3½ inch standard pipe sections, each approximately 20 feet long (for easy handling). However, it should be appreciated that guide track 51 may be formed of members having non-circular cross-sections, such as H-beams, without departing from the basic concept of the torque restraint system.

FIGS. 13-15 of U.S. Pat. No. 5,107,940 describe the procedure for making up a stand 25. FIGS. 16-18 of U.S. Pat. No. 5,107,940 describe how a made-up stand is added to a drilling string.

U.S. Pat. No. 4,108,255 discloses an apparatus for drilling concurrently a plurality of wells within a laterally confined area. The confines of the drilling apparatus employ a structure having vertically extending walls rising from a drilling floor. A plurality of wells are drilled, each employing a separate rotary drilling table and a separate draw work assembly mounted in vertical displacement from the drilling table associated there with. Preferably, the individual draw work assemblies associated with separate rotary drilling tables are utilized only to feed drilling pipe assemblies into the well and to aid in the actual drilling operation. To withdraw drilling pipe assemblies, a master draw works is provided and is mounted vertically above the draw work assemblies associated with particular rotary drilling tables. In addition, the draw work assemblies are preferably located on bridges which are rotatably mounted with respect to an upright central support, so that the bridges are rotatable about the upright support and carriages forming part of the draw works are movable along the bridges so that the carriages may be moved both radially and rotationally relative to the upright support. The confining structure of the vertically extending walls renders the well drilling apparatus suitable for construction for use in drilling wells on the floor of a body of water and also for use in drilling a plurality of wells in a highly urbanized areas. This versatility is achieved by constructing the well drilling apparatus with exterior walls of the confining structure in the form of a facade, to resemble a commercial building or in the form of a water resistant cassion that may be lowered into a body of water to extend from the floor to the surface thereof. In one aspect this patent discloses a well drilling apparatus located within a confining structure having cylindrical annular vertically extending walls rising from a drilling floor and enclosing: a plurality of rotary drilling tables laterally displaced from each other proximate to said drilling floor and within the confines of said walls each arranged to accommodate separate drilling assemblies including drilling pipe for drilling separate wells at spatially separated locations at said drilling floor; an upright support extending upward relative to the drilling floor within said confining structure; and separate drilling draw work assemblies associated with and mounted in vertical displacement from each of said rotary drilling tables for manipulating the drilling pipe and other portions of the drilling assembly utilized with the associated rotary table, wherein each of said separate drilling draw work assemblies is mounted on a separate bridge that extends laterally from said upright support and is supported at said vertically extending walls at a distance above the rotary drilling table with which it is associated.

In several situations it is desirable to drill wellbores for oil and gas wells relatively near to each other, e.g. within 8 to 12 feet of each other (or more) (platforms are often within 16 to 32 feet of each other). A variety of problems and disadvantages are associated with certain typical ways for drilling wellbores that are close to each other. Often, using rigs designed for drilling one hole and then moving the rig to drill another hole, much of the total time expended to drill multiple holes is not time spent actually drilling.

BRIEF SUMMARY OF THE INVENTION

The present invention discloses, in certain aspects, systems and methods for drilling and completing multiple wellbores, e.g. multiple oil or gas wellbores from a single rig without moving the entire rig. In one particular aspect, such systems and methods include drilling a plurality of wellbores for oil and gas wells which are close to each other.

In certain aspects, such systems and methods include, on a single rig machines for drilling an oil or gas wellbore and for completing the wellbores. In certain aspects, machines for completing a wellbore include machines for: drilling a wellbore and/or tripping drill pipe and a drill bit in or out of a drilled wellbore and/or for casing the wellbore; heater installation machines; and/or machines for cementing a cased wellbore; and/or machines for producing an upper portion (sometimes called a "conductor hole") of a wellbore, e.g., but not limited to, machines previously used to make conductor holes, ratholes and/or mouseholes, e.g., but not limited to, as disclosed in co-owned pending U.S. patent application Ser. No. 12/009,328 filed Jan. 17, 2008, fully incorporated herein for all purposes.

In one particular aspect, a drilling machine is moved to a new position on the rig to commence drilling a new hole (without moving the rig) while a tripping machine moves into place over a drilled wellbore and commences tripping out drill pipe and a drill bit used with the drilling machine to drill the drilled wellbore. In another aspect in which two wellbores have been thus drilled, a cementing machine moves over the first drilled wellbore and commences a cementing operation to cement in place casing installed by the tripping machine (or installed by a casing running machine separate from the tripping machine) while the tripping machine moves over a second-drilled wellbore to trip out drilling pipe and a drill bit from the second wellbore as the drilling machine is drilling a third wellbore. Disposable and/or abandonable bits may be used in systems and methods according to the present invention. Also, part of a wellbore can be drilled, e.g., with a drill bit on drill pipe and part using a casing drilling method.

In one particular aspect, the drilling machine is a casing drilling machine (with no need for a tripping machine). In certain systems and methods according to the present invention there are multiple (and at least two) casing drilling machines on one rig.

In certain aspects, drilling machines, tripping machines, and casing running machines according to the present invention have a pipe racking system, as is traditional, in front of the machine(s) (e.g. as in many known cases in which the hole to be drilled is between the drilling machine and the pipe racking system and setback area); but in other aspects according to the present invention, a pipe racking system is located behind the machine rather then in front of the machine. In certain aspects according to the present invention, a pipe racking system uses the string hoisting mechanism of the rig to operate the pipe racking mechanism. In other aspects, the drill pipe is supported, not by slips, but by two sides of the tool joint. The hoisting mechanism picks up on the other two sides of the tool joint in order to eliminate the need for slips.

In certain aspects, multiple machines and multiple wellbore locations are so located that from a single driller's cabin on the rig all machines and all wellbore locations can be viewed and monitored during stages of drilling, tripping, and cementing on multiple holes. In one particular aspect, a cabin system is provided in which the driller's cabin is movable to multiple positions on the rig either across the rig or on its periphery. In one particular aspect each of the multiple machines (or only one or two of them) are movable on the rig, either across the rig or on its periphery. In any system according to the present invention, the driller can also move or be moved in a chair around a driller's cabin, and, in one aspect, he is located in the center of the floor and the chair rotates to view each wellbore.

In one particular aspect a rig according to the present invention includes a heater installation machine for installing heating devices, apparatuses, tubulars, and/or structure for a wellbore.

In certain aspects, systems and methods according to the present invention employ drilling machines in which a drilling device is moved, forced, or pulled down to facilitate drilling of an oil or gas wellbore. In one particular aspect, a cylinder-powered drilling machine according to the present invention includes one, two, or more powered cylinder apparatuses that pull a drilling device down to force it into the earth.

In certain aspects, the present invention discloses a center-support drilling machine in which a drilling machine is rotatably mounted on a center support, e.g. a central pillar, so that it is rotatable on the center support for location over multiple wellbore locations. In other aspects, additional machines (tripping, casing running, heater installing, and/or cementing) are also rotatably mounted on the center support. One machine can be mounted above or below another and/or staggered at different levels on a center support.

In certain aspects of the present invention a movement apparatus moves individual machines (drilling, tripping, casing running, cementing, and/or heater installing) around a rig and in one aspect the movement apparatus picks up a machine to move it. In one particular aspect, this is a crane, cranes, or a hoisting device.

In certain aspects according to the present invention a road module is provided adjacent one multi-hole location or extending by multiple multi-hole locations. In one aspect a crane and/or driller's cabin is movably positioned on the road module and a multi-function multi-hole rig according to the present invention (or several of them) is located adjacent the road module and movable with respect to the road module from one multi-hole location to another.

In certain aspects, the present invention provides systems and methods in which a multi-function multi-hole rig for drilling and completing an oil or gas wellbore includes multiple machines movable on the rig itself to each of several hole locations (without moving the entire rig) by moving the machines around or on the rig's periphery. In certain particular aspects, such a rig has a rig periphery as viewed from above, which is non-rectangular, e.g., but not limited to, generally circular, elliptical, oval, octagonal, hexagonal, pentagonal, triangular, polygonal or with a curved configuration. Machines can be movable on a track or path around such a periphery or a separate movable support supporting the machines is movable to move the machines around the periphery from one hole location to the next. In one aspect, in such a rig, a driller's cabin is centrally located while, in another aspect, a driller's cabin is also movable on the rig's periphery; or is movable across a rig floor. In one aspect, a driller's cabin is on the rig's periphery, but stationary.

In one aspect in such rigs with one, two, three, or more machines movable on a rig's periphery, one, two, three or more machines and/or a driller's cabin are movable across a portion of a rig floor from one position to another.

In one aspect of the present invention, a rig is provided on which a machine or certain machines are movable around a rig's periphery and a machine or certain machines are movable across a portion of a rig; for example, in a rig according to the present invention a drilling machine and a cementing machine are movable around a rig's periphery and a tripping machine is movable across a rig from one hole location to another; and, in one aspect, machines other than a drilling machine are movable around a rig's periphery and a drilling machine is movable across the rig from one hole location to another.

Accordingly, the present invention includes features and advantages which are believed to enable it to advance oil and gas wellbore drilling and completion technology. Characteristics and advantages of the present invention described above and additional features and benefits will be readily apparent to those skilled in the art upon consideration of the following detailed description of preferred embodiments and referring to the accompanying drawings.

Certain embodiments of this invention are not limited to any particular individual feature disclosed here, but include combinations of them distinguished from the prior art in their structures, functions, and/or results achieved. Features of the invention have been broadly described so that the detailed descriptions that follow may be better understood, and in order that the contributions of this invention to the arts may be better appreciated. There are, of course, additional aspects of the invention described below and which may be included in the subject matter of the claims to this invention. Those skilled in the art who have the benefit of this invention, its teachings, and suggestions will appreciate that the conceptions of this disclosure may be used as a creative basis for designing other structures, methods and systems for carrying out and practicing the present invention. The claims of this invention are to be read to include any legally equivalent devices or methods which do not depart from the spirit and scope of the present invention.

What follows are some of, but not all, the objects of this invention. In addition to the specific objects stated below for at least certain preferred embodiments of the invention, there are other objects and purposes which will be readily apparent to one of skill in this art who has the benefit of this invention's teachings and disclosures. It is, therefore, an object of at least certain preferred embodiments of the present invention to provide new, useful, unique, efficient, nonobvious multi-function rigs for drilling and completing multiple adjacent spaced-apart wellbores.

The present invention recognizes and addresses the problems and needs in this area and provides a solution to those problems and a satisfactory meeting of those needs in its various possible embodiments and equivalents thereof. To one of skill in this art who has the benefits of this invention's realizations, teachings, disclosures, and suggestions, other purposes and advantages will be appreciated from the following description of certain preferred embodiments, given for the purpose of disclosure, when taken in conjunction with the accompanying drawings. The detail in these descriptions is not intended to thwart this patent's object to claim this invention no matter how others may later attempt to disguise it by variations in form, changes, or additions of further improvements.

The Abstract that is part hereof is to enable the U.S. Patent and Trademark Office and the public generally, and scientists, engineers, researchers, and practitioners in the art who are not familiar with patent terms or legal terms of phraseology to determine quickly from a cursory inspection or review the nature and general area of the disclosure of this invention. The Abstract is neither intended to define the invention, which is done by the claims, nor is it intended to be limiting of the scope of the invention or of the claims in any way.

It will be understood that the various embodiments of the present invention may include one, some, or all of the disclosed, described, and/or enumerated improvements and/or technical advantages and/or elements in claims to this invention.

Certain aspects, certain embodiments, and certain preferable features of the invention are set out herein. Any combination of aspects or features shown in any aspect or embodiment can be used except where such aspects or features are mutually exclusive.

BRIEF DESCRIPTION OF THE SEVERAL VIEWS OF THE DRAWINGS

A more particular description of embodiments of the invention briefly summarized above may be had by references to the embodiments which are shown in the drawings which form a part of this specification. These drawings illustrate certain preferred embodiments and are not to be used to improperly limit the scope of the invention which may have other equally effective or legally equivalent embodiments.

FIG. 17O is a perspective view showing a step in the method according to the present invention using the system of FIG. 15.

Figure 1A:
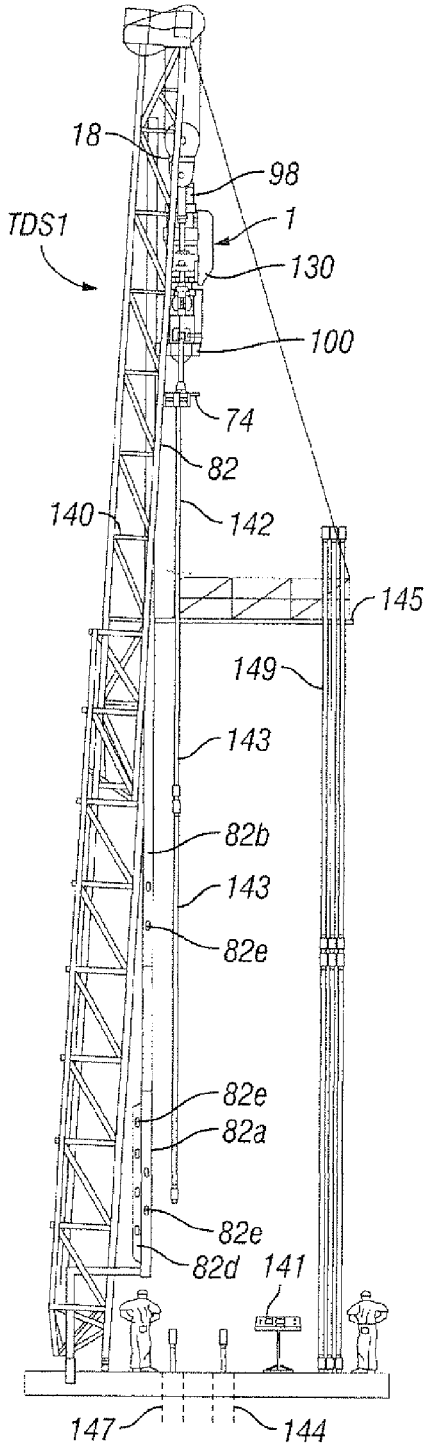
FIG. 1A (Prior Art)
FIG. 1A is a side view of a prior art drilling rig.
Figure 1B:
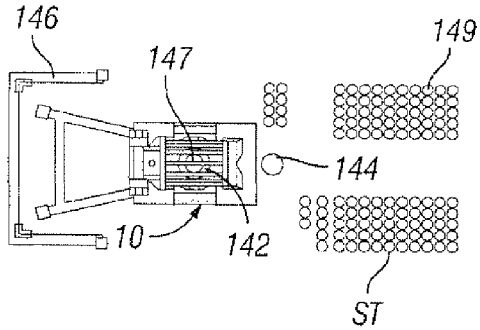
FIG. 1B (Prior Art)
FIG. 1B is a top view of the rig of FIG. 1A.
Figure 2:
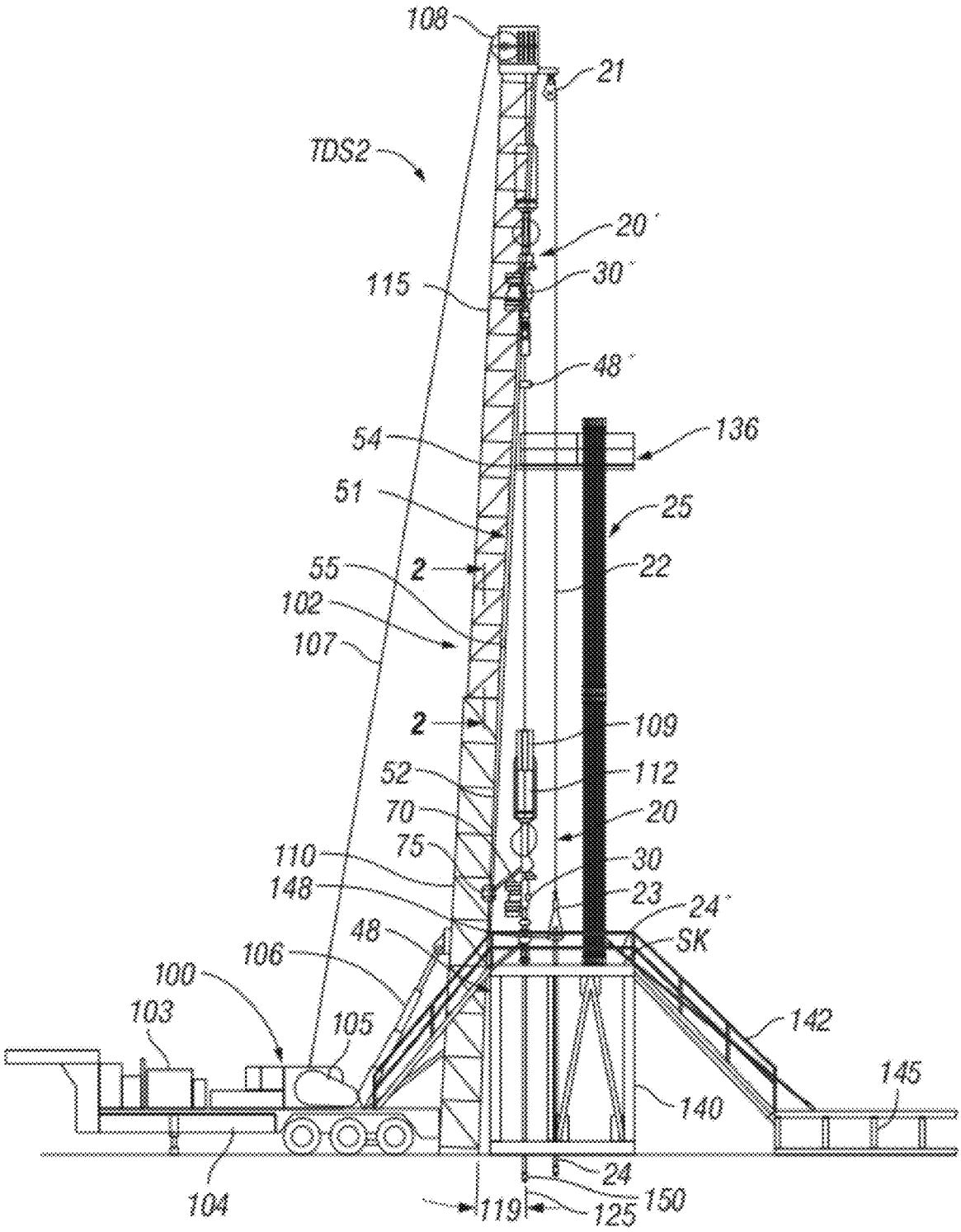
FIG. 2 (Prior Art)
FIG. 2 is a side view of a prior art drilling rig.

Presently preferred embodiments of the invention are shown in the above-identified figures and described in detail below. Various aspects and features of embodiments of the invention are described below and some are set out in the dependent claims. Any combination of aspects and/or features described below or shown in the dependent claims can be used except where such aspects and/or features are mutually exclusive. It should be understood that the appended drawings and description herein are of preferred embodiments and are not intended to limit the invention or the appended claims. On the contrary, the intention is to cover all modifications, equivalents and alternatives falling within the spirit and scope of the invention as defined by the appended claims. In showing and describing the preferred embodiments, like or identical reference numerals are used to identify common or similar elements. The figures are not necessarily to scale and certain features and certain views of the figures may be shown exaggerated in scale or in schematic in the interest of clarity and conciseness.

As used herein and throughout all the various portions (and headings) of this patent, the terms "invention", "present invention" and variations thereof mean one or more embodiment, and are not intended to mean the claimed invention of any particular appended claim(s) or all of the appended claims. Accordingly, the subject or topic of each such reference is not automatically or necessarily part of, or required by, any particular claim(s) merely because of such reference. So long as they are not mutually exclusive or contradictory any aspect or feature or combination of aspects or features of any embodiment disclosed herein may be used in any other embodiment disclosed herein.

DETAILED DESCRIPTION OF THE INVENTION

Figure 3:
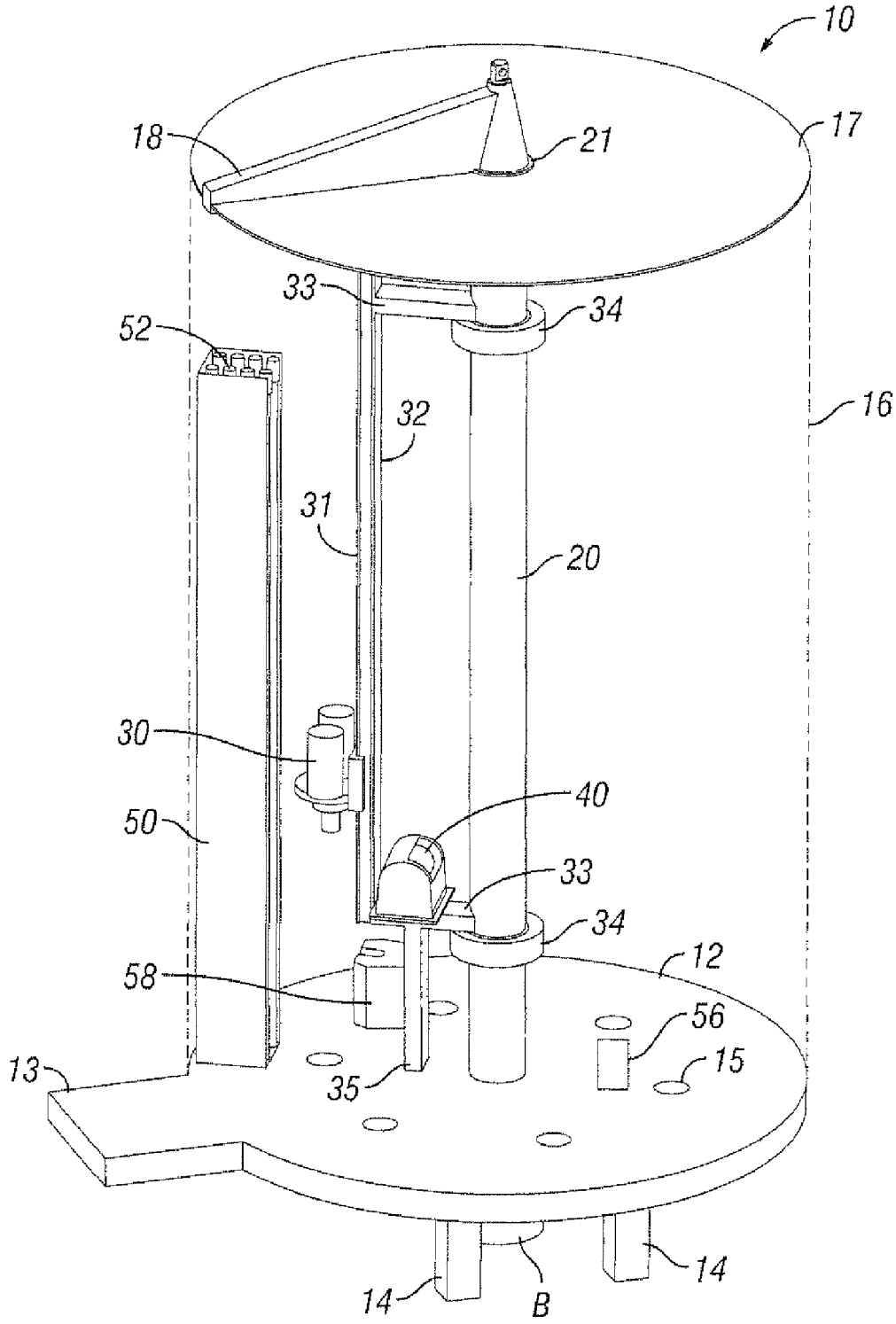
FIG. 3 is a perspective view of a drilling rig for drilling oil and gas wells according to the present invention.

FIG. 3 shows a system 10 according to the present invention which has a base or rig floor 12 with supports 14 to which is secured an upright pillar 20. An optional shroud 16 (sides shown in dotted lines), e.g. for use in harsh weather environments, encompasses the majority of the rig floor 12 and has a top 17 A crane 18 is rotatably mounted on a top 21 of the pillar 20. A platform 13 projects from the rig floor 12.

Six holes 15 extend through rig floor 12, each hole corresponding to and above a location on the ground below the rig floor 12 where a wellbore is to be drilled and completed. Any desired number of such holes can be provided (for any desired number of wellbores).

A drilling machine 30 is movably mounted for up and down movement on a beam 31 which is part of a support 32 which is rotatably mounted on the pillar 20. Crossbeams 33 are connected to rings 34 which encompass and rotate on the pillar 20. A drawworks 40 is mounted on the lower crossbeam 33. A beam 35 connected to the lower crossbeam 33 extends down to the top of the rig floor 12.

A cartridge 50 with tubulars 52 therein (e.g. drill pipe) is supported on the rig floor 12. The cartridge 50, in one aspect, is movable around the rig floor 12 so it is adjacent a desired machine. As shown in FIG. 3, the cartridge 50 is adjacent the drilling machine 30. Any suitable and desirable rig equipment and apparatuses may be located on the rig floor 12; e.g., but not limited to, an iron roughneck 58.

Optional air treatment equipment 56 on the rig floor 12 provides heated or cooled air to the system 10. Optionally, the equipment 56 is located near the system 10, but not on the rig floor 12. Any system according to the present invention disclosed herein may have equipment like the equipment 56. A bucket B collects mud circulated from the wellbore.

Figure 4:
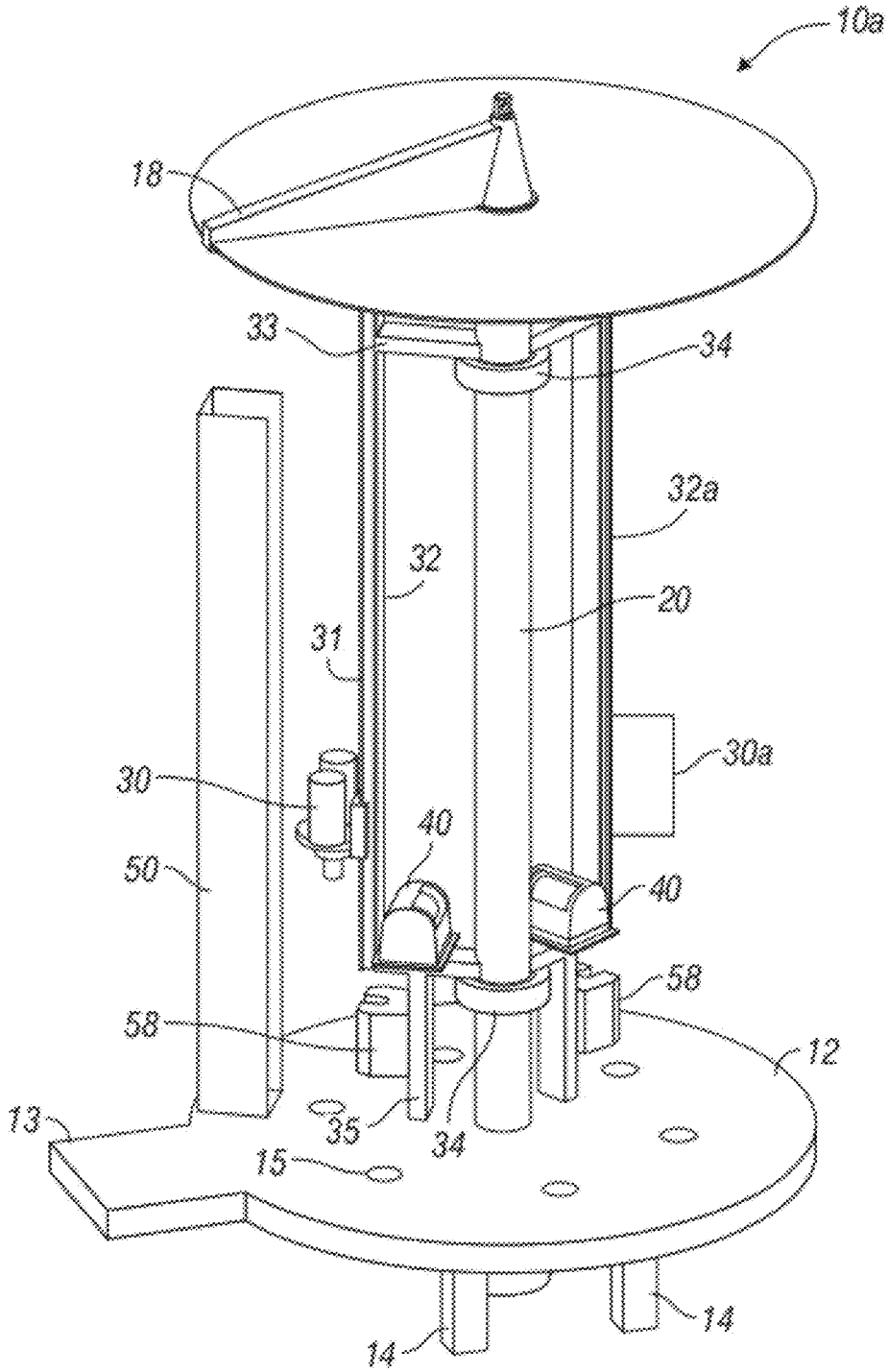
FIG. 4 is a perspective view of a drilling rig for drilling oil and gas wells according to the present invention.

FIG. 4 illustrates a system 10*a*, like the system 10, FIG. 3, and like numerals indicate like parts. An additional support 32*a* supports an additional machine 30*a* (shown schematically). The machine 30*a* may be a drilling machine, tripping machine, a cementing machine, a casing machine, a heater installation machine or any other machine used or useful on a drilling rig.

A machine 30*a* may be on the same ring 34 as a machine 30 or there may be separate rings for the support 32*a* for the machine 30*a* and its drawworks.

Optionally, an additional machine (not shown) on an additional support (not shown) is rotatably mounted on the pillar 20.

FIGS. 5A-5D show a system 100 according to the present invention which has a rig floor 102 on four supports 104 (three shown). Optionally, the system 100 is mobile (as may be the system 10) and is mounted on wheels 106 (shown schematically in dotted line; tracks may be used instead of wheels). The rig floor 102 has six holes 108 therethrough. Each of the six holes 108 is located above a location on the ground G at which it is desired to drill and complete an oil and gas wellbore A drilling machine 120 is located adjacent one of the holes 108 and is drilling a wellbore 110 with a bit 114 on a drill string 112.

The drilling machine 120 is movable up and down on a track 122. A pipe rack 130 behind the drilling machine 120 holds drill pipe 132 (or, if desired, tubing or casing) for use in the drill string 112. Optionally, as shown in dotted line in FIG. 5C, the system 100 has a harsh weather shroud 136 and an optional air treatment system 138 (shown schematically) to heat or cool air.

The drill machine 120 may be a pull-down drilling machine, a cylinder rig, or a drawworks-driven machine.

A tripping machine 140 (FIG. 5B) on the rig floor 102 is adjacent a hole 108 through which a wellbore 109 has already been drilled with the drilling machine 120. The tripping machine 140 is removing the drill pipe 132 used by the drilling machine 120 from the wellbore 109. In certain aspects, this tripping machine can hang off the drill pipe on the tool joint upset at the rig floor instead of using slips. The hoisting mechanism is on either side of the hang off point.

A cementing machine 150 (shown schematically in FIG. 5A) is positioned for cementing a wellbore 111 which was previously drilled by the drilling machine 120 and from which, previously, the drill pipe was removed from the wellbore 111 by the tripping machine 140 (or for cementing when casing drilling was used, casing having been run by a tripping machine or by a casing running machine).

A driller's cabin 160 is located on the rig floor 102. Personnel in the driller's cabin, e.g. a driller, can see each hole 108 and each machine located adjacent a hole.

A pathway 128 indicates movement options for each of the machines 120, 140, 150. Any suitable movement paths may be used and any suitable movement apparatus for moving the machines may be used.

The machine 140 has a pipe rack system 142 adjacent thereto and the machine 150 has a pipe rack system 152 adjacent thereto. As viewed in FIG. 5B, e.g., the pipe rack 130 is behind the drilling machine 120. This is the opposite of known pipe rack systems which are in front of a drilling system and in which the hole through which a well is drilled is between a drilling system and a pipe rack system. Locating the pipe rack system behind the drilling machine (or behind another machine) has several advantages, e.g., saving space and allowing an unobstructed view of multiple operations and/or multiple wells. Also, in certain aspects of the present invention, a hoisting system is part of a pipe rack system.

Figure 5A:
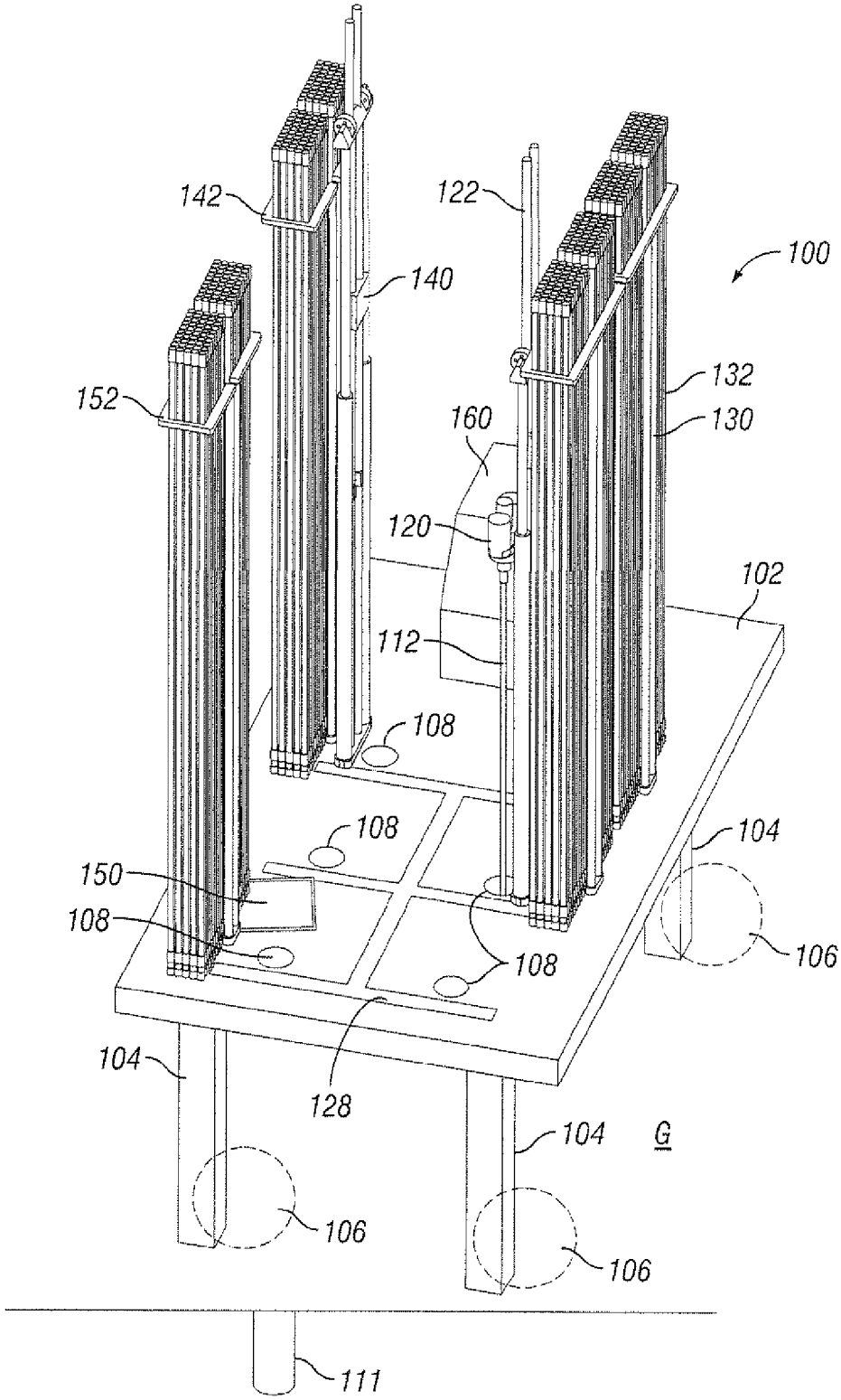
FIG. 5A is a perspective view of a drilling rig for drilling oil and gas wells according to the present invention.
Figure 5B:
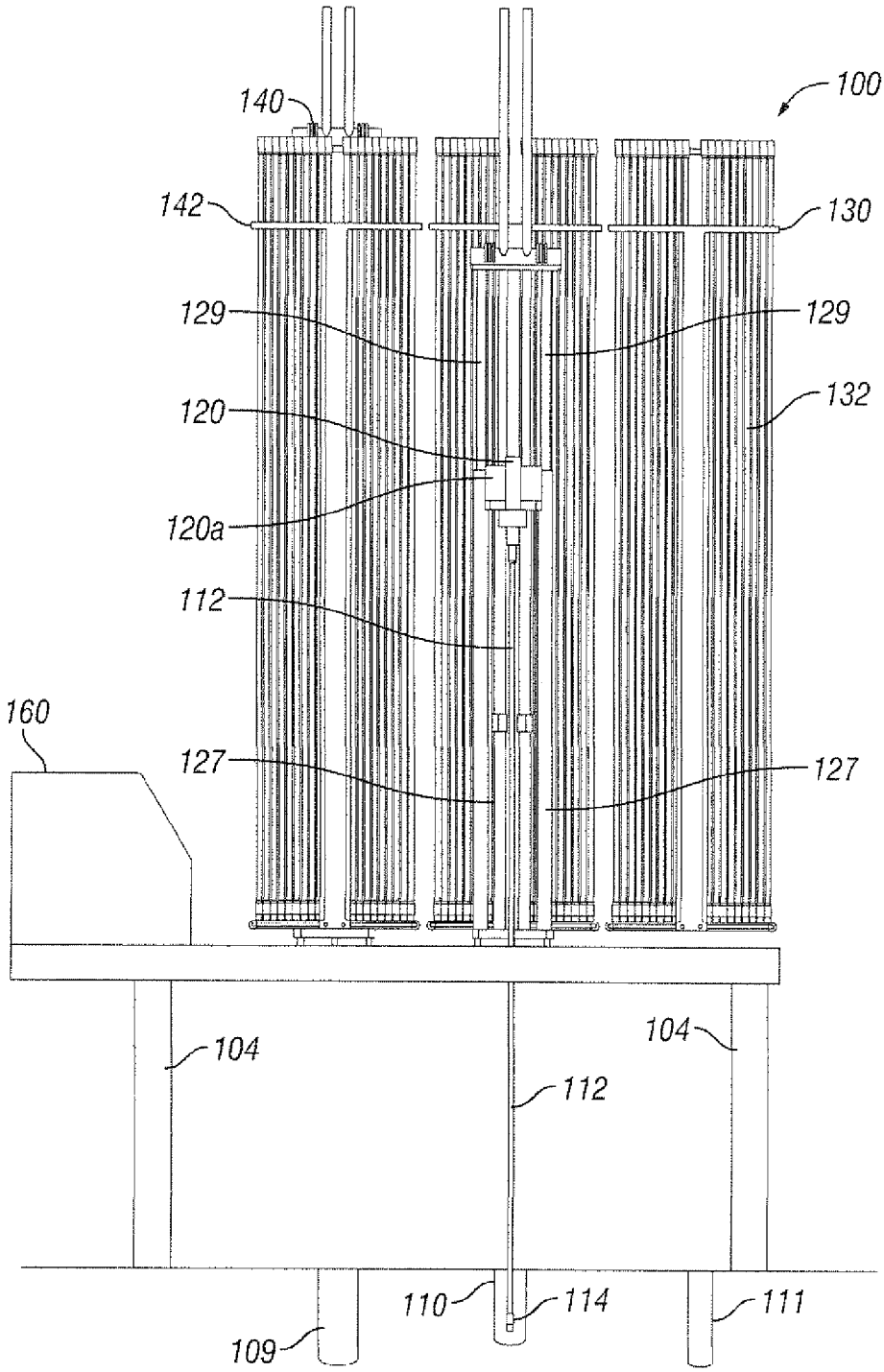
FIG. 5B is a side view of the rig of FIG. 5A.
Figure 5C:
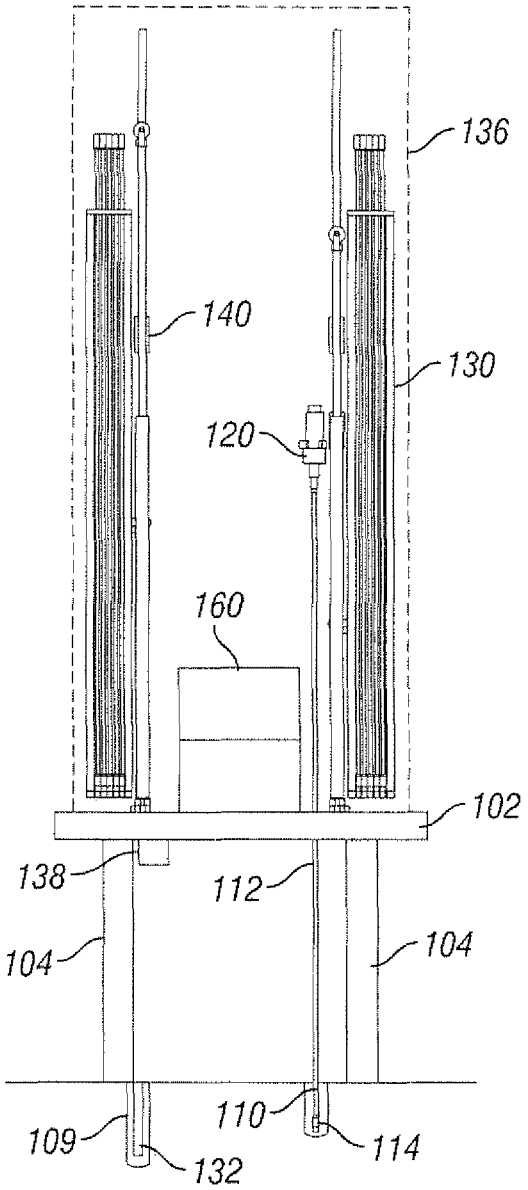
FIG. 5C is an end view of the rig of FIG. 5A.
Figure 5D:
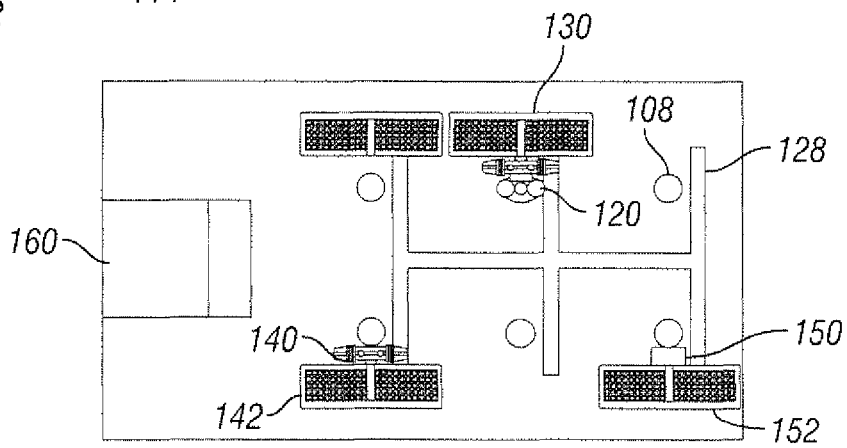
FIG. 5D is a top view of the rig of FIG. 5A.

In one particular aspect the drilling machine 120 is a pull-down cylinder-powered rig as shown, e.g., in FIG. 5B. Power cylinders 127 have rods 129 connected to a plate 133 that moves on tracks 137. The power cylinders 127 are connected to a drilling apparatus 120*a*. Extension of the rods 129 upwardly results in pushing up of the sheaves that then pull up a top drive or tripping machine. Retracting of the rods 129 results in pulling down on other sheaves that then pull down on the top drive or on the tripping machine. Power cylinders can be advantageous, e.g., as compared to a typical top drive rig, in saving space in ease of control, and in the ability to keep a top drive from colliding with the rig floor or into the crown. In one particular aspect, the drilling machine 120 has a 50-to-75 ton top drive or power swivel. In other aspects, for any system according to the present invention, the drilling machine is a 50-to-1250 ton top drive system.

Figure 6A:
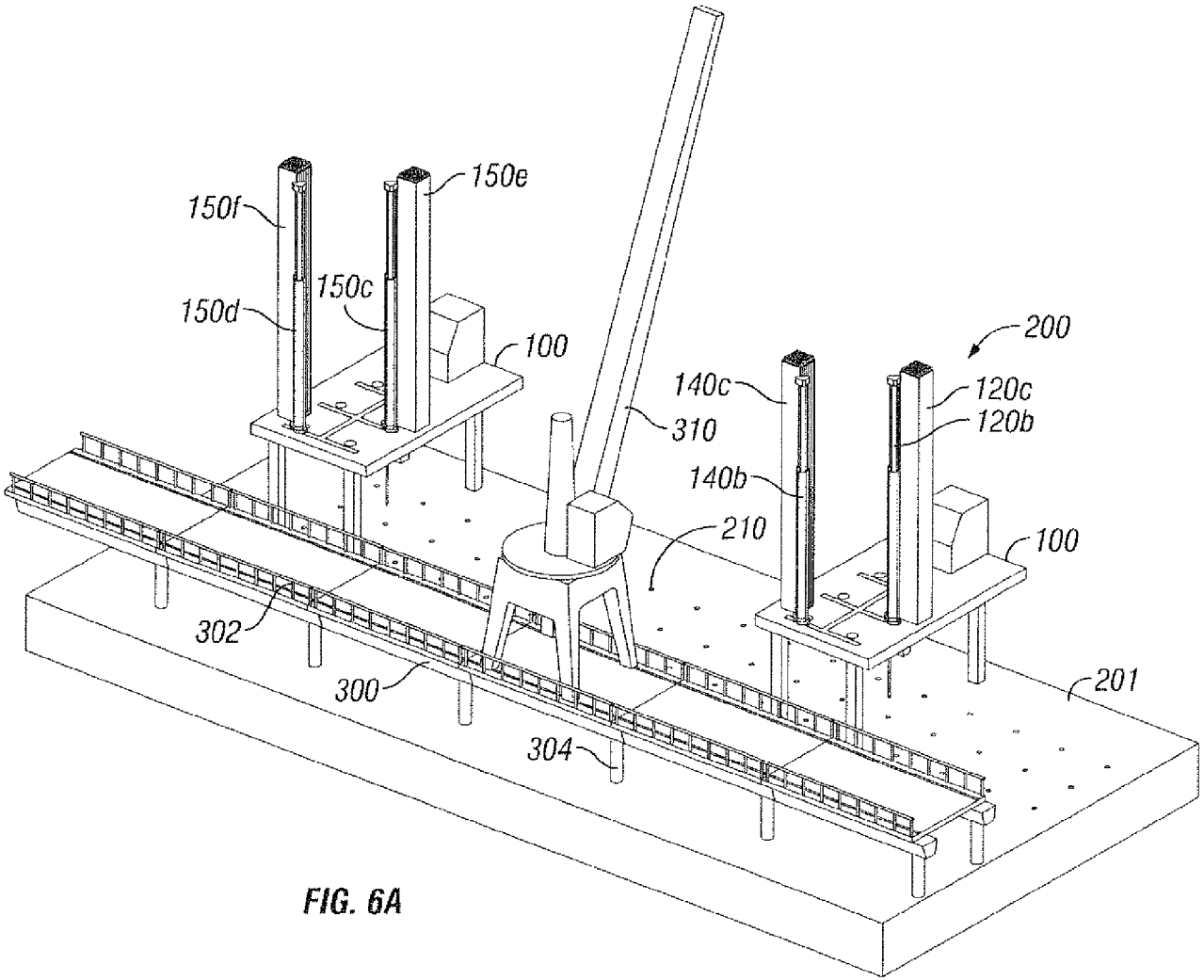
FIG. 6A is a perspective view of a drilling system for drilling oil and gas wells according to the present invention.
Figure 6B:
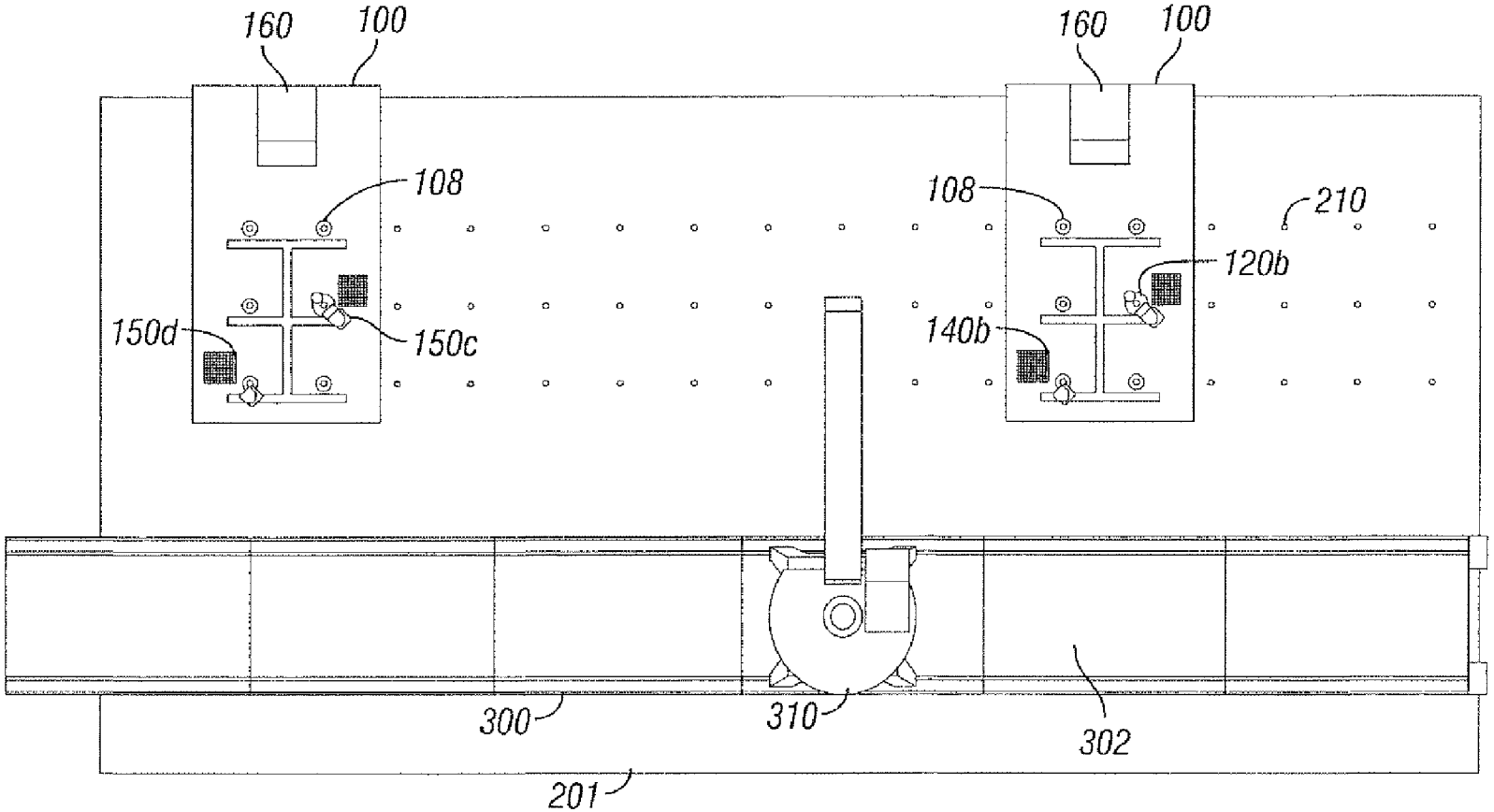
FIG. 6B is a top view of the system of FIG. 6A.

FIG. 6A shows a system 200 according to the present invention which includes multiple systems 100 (any desired number; two shown at a location 201) adjacent a road module 300 according to the present invention. Multiple wellbores 210 are being drilled and completed by the systems 100.

The road module 300 includes connected road sections 302 supported by supports 304. In one aspect, the supports 304 extend down to bedrock at the location 201 (e.g., but not limited to, through top soil, tundra, muskeg, peat, sand, unstable soil or material and/or ice). Optionally, a crane 310 is semi-permanently or movably mounted on the road sections 302 for use in operations of any of the systems 100.

Each system 100 can have all the machines needed to drill and complete multiple wellbores or, optionally, each system 100 can have only machines with certain functions. For example, and not by way of limitation, the machine 100 to the right in FIG. 6A can have a drilling machine 120*b* and its associated pipe racking system 120*c* and a tripping machine 140*b* with its associated pipe racking system 140*c* while the drilling machine to the left in FIG. 6A (to be moved from left-to-right following the drilling machine 100 to the right in FIG. 6A) has a casing machine 150*c* (with its rack system 150*e*) and a cementing machine 150*d* (with its rack system 150*f*). The first drilling system 100 (the one to the right in FIG. 6A) drills the wellbores and trips out the drill pipe while a second machine cases the wellbores and/or cements the casing in place. In one aspect, each rig is capable of performing all the operations to produce an entire well. Once the well is drilled, casing is run immediately. According to the present invention, a single rig can drill, etc. an entire well or one rig can drill one section of a hole case and cement it, then another (the next) rig comes in and drills the next section of that hole, etc. Each system 100 can have all the necessary machines to drill and complete a well and, optionally, a heater installation machine to install heaters in a wellbore.

Figure 7A:
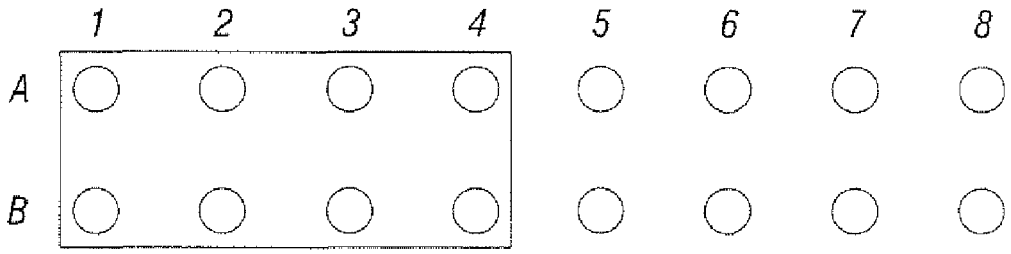
FIG. 7A is a top schematic view showing steps in a method according to the present invention using a rig according to the present invention.
Figure 7B:
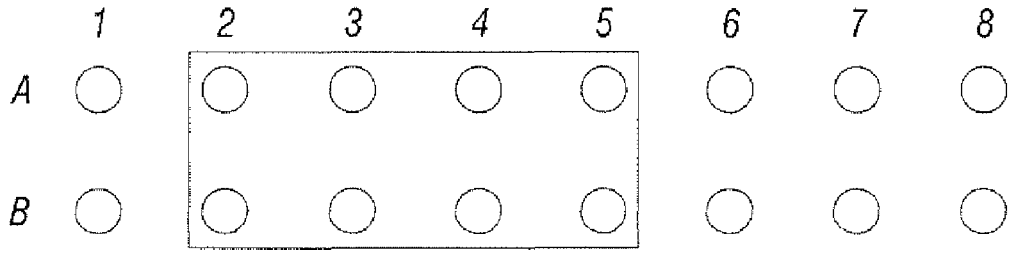
FIG. 7B is a top schematic view showing a step in the method of FIG. 7A.

FIGS. 7A and 7B illustrate one option for a drilling machine 100 in a system for progressive work on multiple wells. As shown in FIG. 7A, there are sixteen wells to be drilled (1-8 in line A and 1-8 in line B). As illustrated in FIG. 7A, a system 100 drills all the wells below holes 1-4, line A and 1-4, line B, and completes (or trips pipe out of) hole 1A and 1B (or only some of them). In one aspect the system 100 completes wells on lines 1-3 and partially completes wells on line 4. Then the system 100 is moved so that it is above wellbore locations 4-7, line A and 4-7, line B. Thus while various machines are working on the already-drilled holes, the drilling machine can drill the wellbores at locations 5A and 5B; and so on for all sixteen wellbores.

Figure 8A:
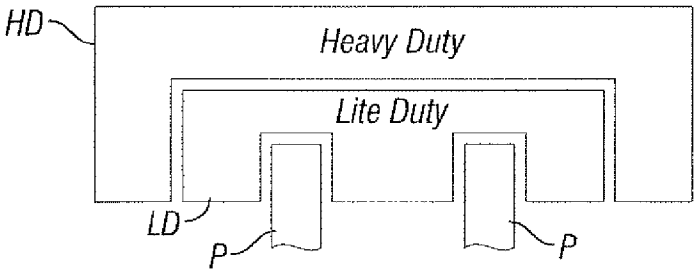
FIG. 8A is a cross-section view of the top of a road module according to the present invention.
Figure 8:
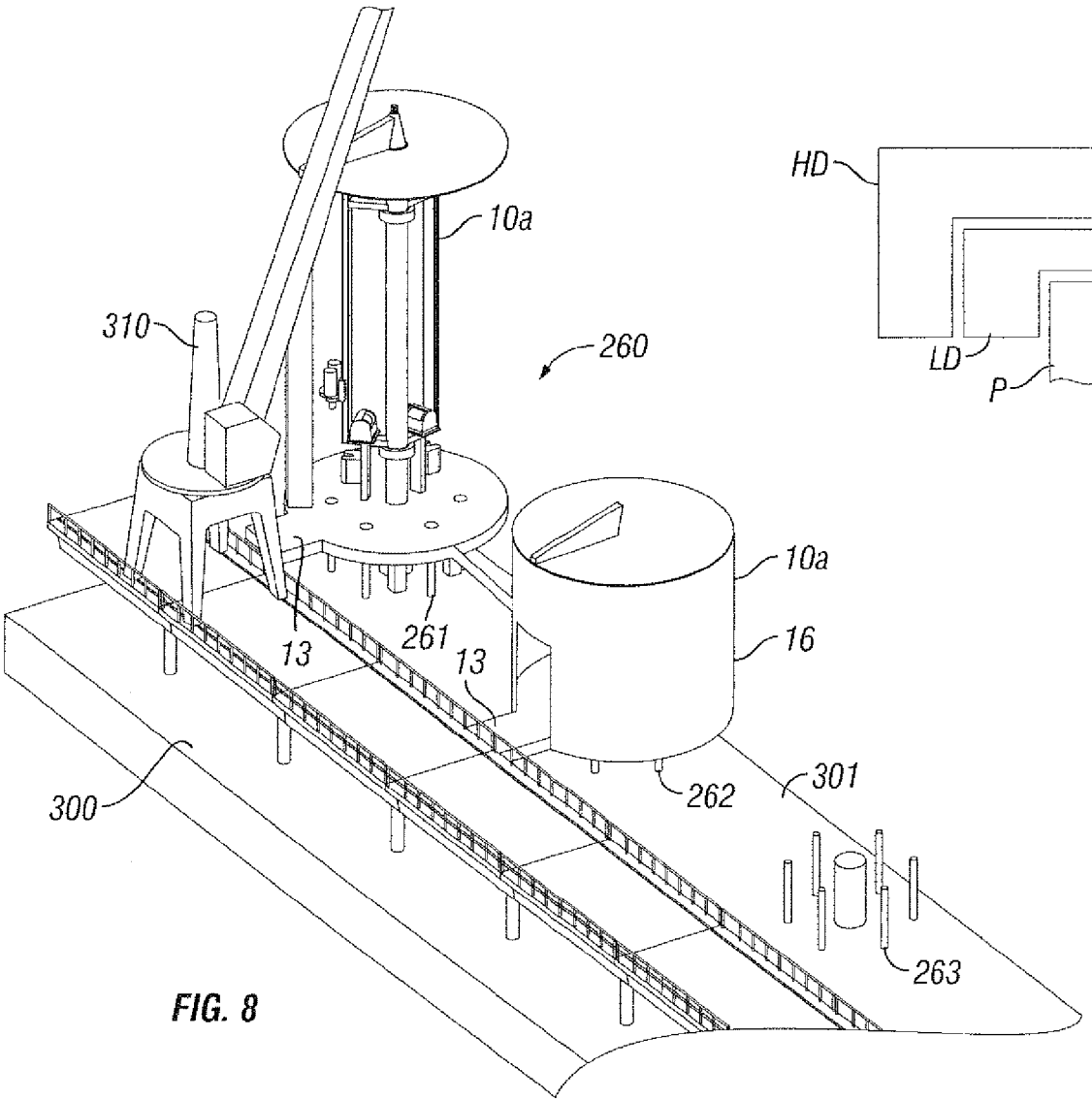
FIG. 8 is a perspective view of a system according to the present invention.

FIG. 8 shows a system 260 with systems 10*a* according to the present invention and a road module system 300. The systems 10*a* move down a location 301 (left-to-right in FIG. 8) drilling and completing multiple wellbores corresponding to multiple holes 261, 262, 263, etc. (six holes for each set of multiple holes, six shown for hole location 263, five shown for hole location 261; but it is within the scope of the present invention to have as many holes as desired, including, but not limited to, two holes, three holes, four holes, five holes, seven holes or eight holes). As illustrated, a system 10*a* can be any desired height sufficient to achieve wellbores of desired depth. FIG. 8A shows in cross-section one embodiment of a road module according to the present invention supported by pillars P. A lite duty road top LD, supported directly by the pillars P, supports a heavy duty road top HD. The heavy duty road top HD is optional, or, if present, is selectively removable. Alternatively, the lite duty road top LD is, selectively, removed or eliminated.

Figure 9A:
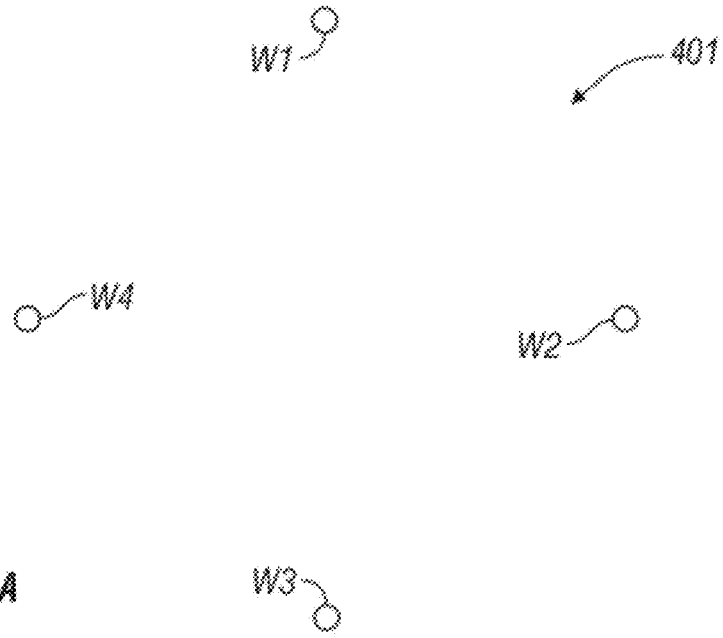
FIG. 9A is a top schematic view showing locations for multiple wellbores to be drilled and completed.

FIG. 9A shows a site 401 with multiple wellbore sites W1, W2, W3, and W4. It is within the scope of the present invention for there to be any desired number of wellbore sites at a location (e.g. two, fifty, two hundred, etc.). In many instances they will be 10 feet apart; but smaller (and larger) spacings are within the scope of the present invention.

Figure 9B:
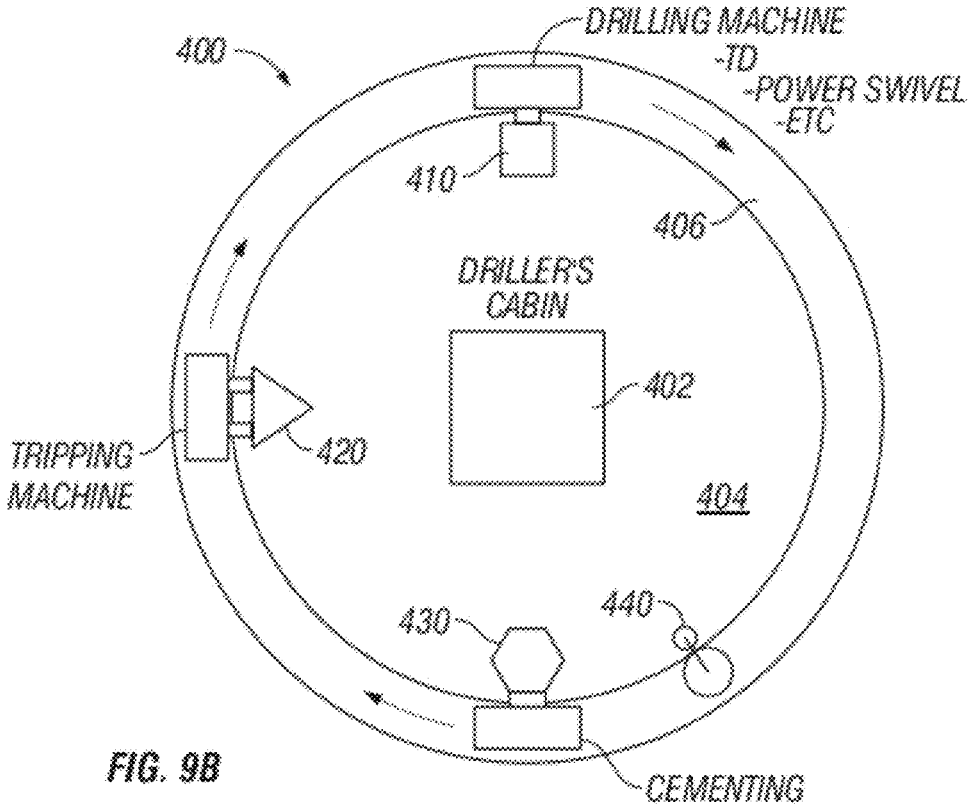
FIG. 9B is a top schematic view of a drilling system according to the present invention for drilling at the locations shown in FIG. 9A.

FIG. 9B shows a system 400 according to the present invention which includes a driller's cabin 402 on a base 404 from which personnel, e.g. a driller, can view at all times multiple machines located at the system's periphery. A drilling machine 410, a tripping machine 420, and a cementing machine 430 (which may also perform casing functions; or a separate casing machine may be used). Each machine may be mounted for movement in a pathway 406 (e.g. a track, groove, or a rail system); or the base 404 can have the pathway 406 rotatably mounted therearound and the entire pathway 406, supporting the machines, can rotate with respect to the base 404. Optionally, the base 404 rotates. Also, as described above, a driller chair can rotate.

Optionally, and this is true for any system disclosed herein according to the present invention, including but not limited to the systems of FIGS. 3-8, the system 400 can include a heater running machine 440 for installing a heater function in or near any wellbore drilled with the system 400 (or with any system according to the present invention). The machine 440 can install heaters in an already-drilled wellbore.

Figure 9C:
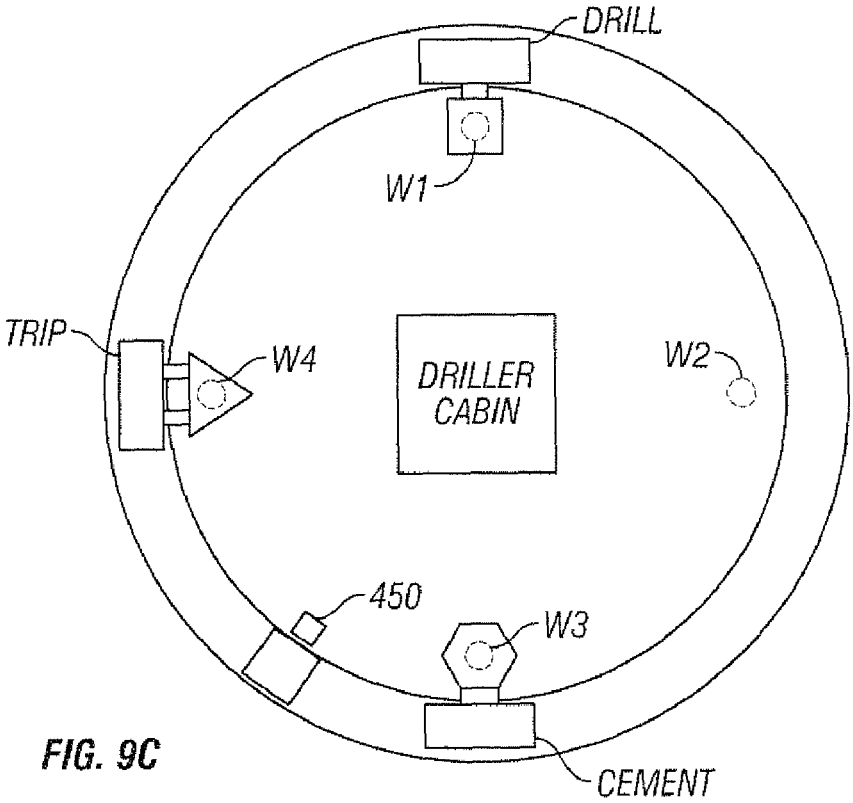
FIG. 9C is a top schematic view showing steps in drilling and completing wells at the locations of FIG. 9A.

FIG. 9C illustrates the system 400 in use with the drilling machine 410 drilling the wellbore W1, the tripping machine 420 tripping drill pipe from the already-drilled wellbore W4, and the cementing machine 430 cementing in place casing (installed previously either by the cementing machine which includes casing installation apparatus, etc. or by a separate casing apparatus 450 (optional for the system 400, shown in FIG. 9C). The next wellbore to be drilled will be the wellbore W2.

Figure 10:
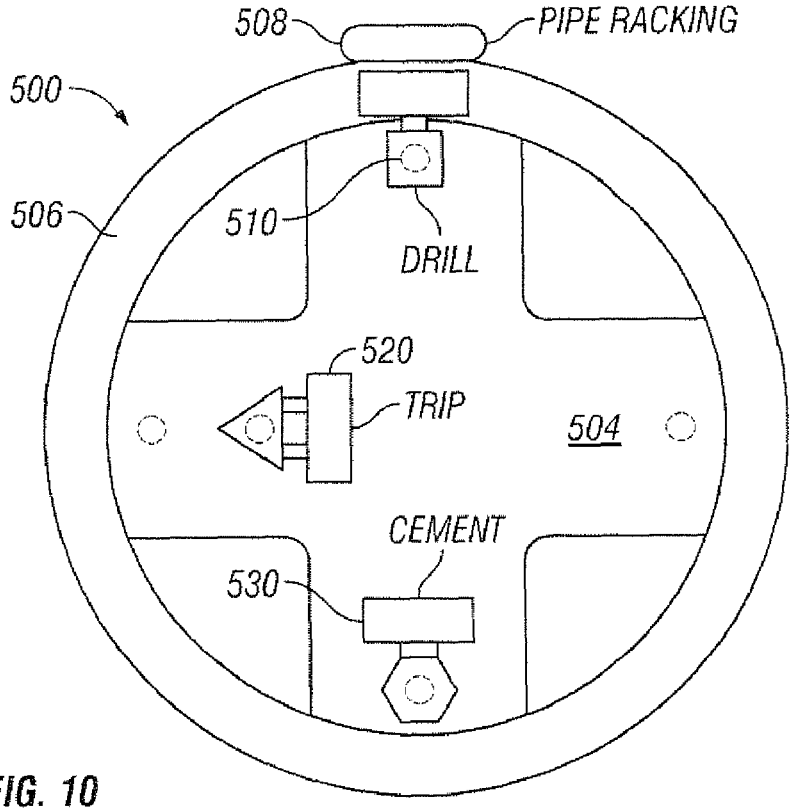
FIG. 10 is a top schematic view of a drilling system according to the present invention.

In another embodiment, in a system 500 according to the present invention as shown in FIG. 10, a drilling machine 510 is on a pathway 506 (like the pathway 406); and both a tripping machine 520 and a cementing machine 530 (and a heater installer if present) move on a base 504 (like the base 404). Optionally the heater installer is also on the pathway 506. A pipe racking system 508 is behind the drilling machine 510 (either connected to the pathway 506 or to another adjacent structure). Alternatively, a crane or hoist is used.

Figure 11:
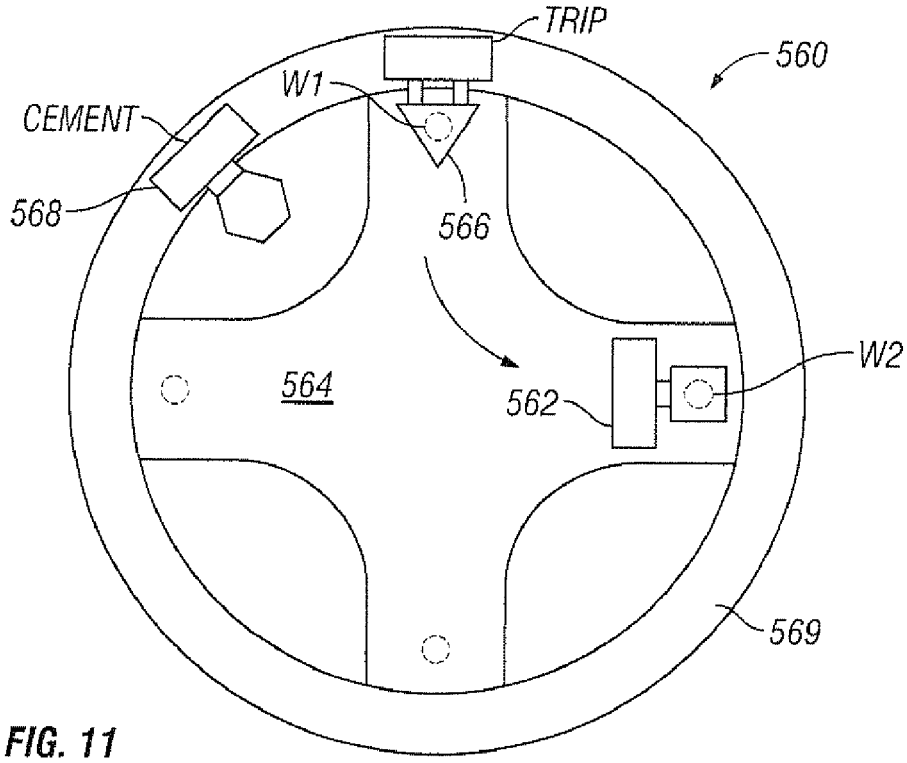
FIG. 11 is a top schematic view of a drilling system according to the present invention.

As shown in FIG. 11, optionally, in a system 560 according to the present invention, a drilling machine 562 is movable across a base 564; and a tripping machine 566 and a cementing machine 568 have a pathway 569. Optionally (as is true for any system according to the present invention) a casing machine may be used with any of the systems of FIGS. 9A-13).

Figure 12:
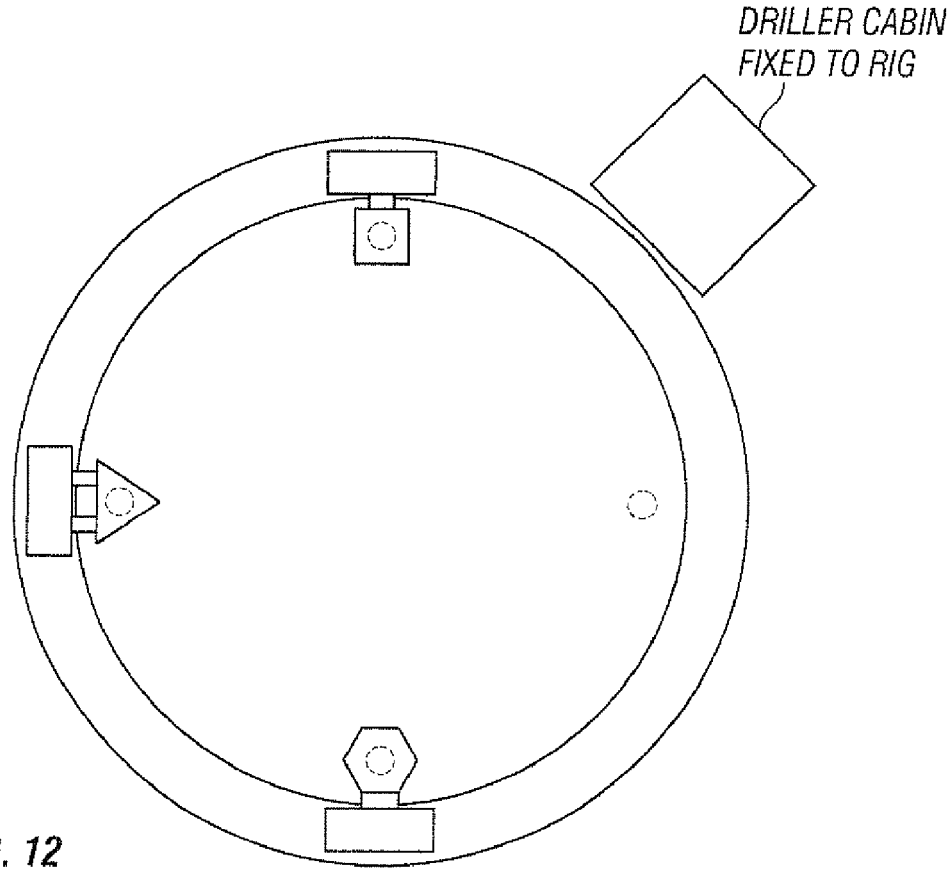
FIG. 12 is a top schematic view of a drilling system according to the present invention.

As shown in FIG. 12, a driller's cabin can be in a fixed position connected to a base of a system or to some other structure adjacent thereto. In one aspect, the driller's cabin is located so personnel therein can view all operating machines and/or all well locations simultaneously. In one aspect viewing is possible via direct line of sight, camera(s), and/or rotating a drill chair to a desired position for viewing.

Figure 13:
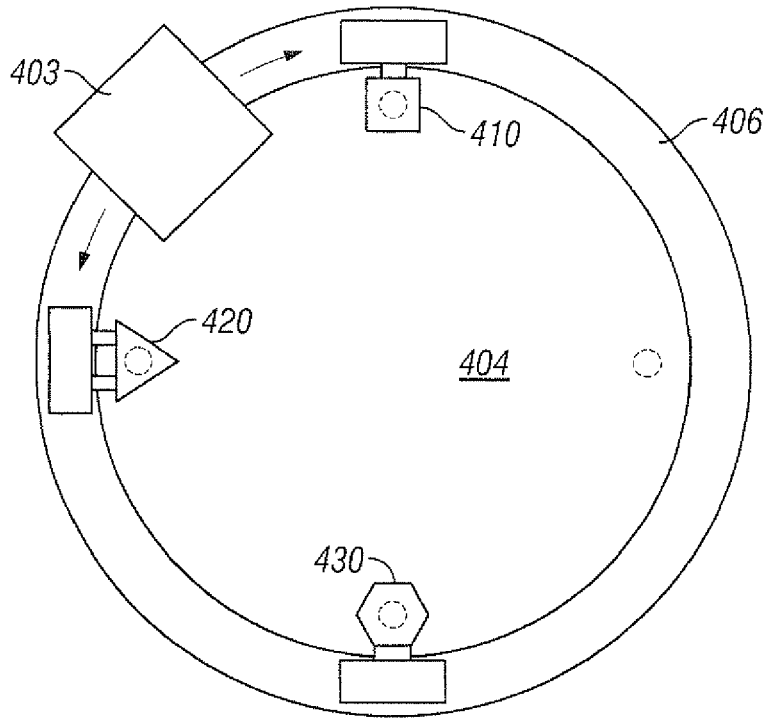
FIG. 13 is a top schematic view of a drilling system according to the present invention.
Figure 14:
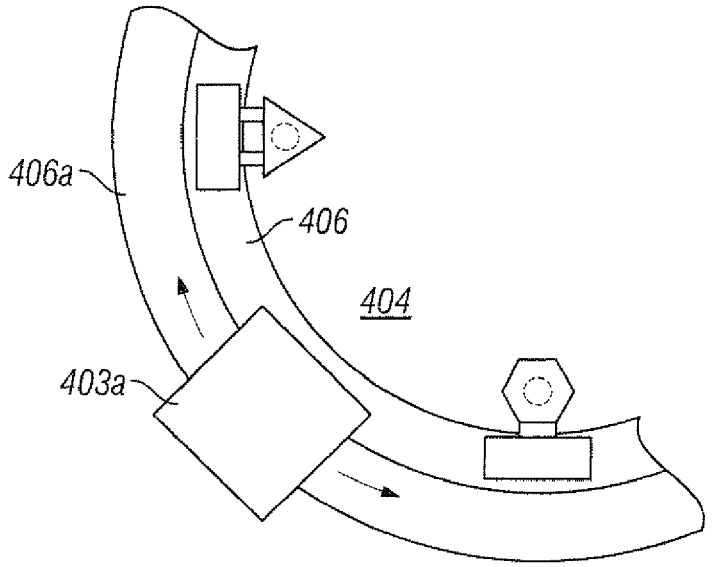
FIG. 14 is a top schematic view of a drilling system according to the present invention.

FIG. 13 shows an optional disposition of a driller's cabin 403. The driller's cabin 403 is on the pathway 406 (and may be located anywhere on the pathway 406) and is movable with respect to the base 404 as are any of the machines. A crane or other apparatus can move the driller's cabin 403 to any desired location on the pathway 406. Optionally, as shown in FIG. 14, a driller's cabin 403*a* has its own dedicated pathway 406*a* which, in one aspect, moves around both a pathway 406 and a base 404.

Figure 15:
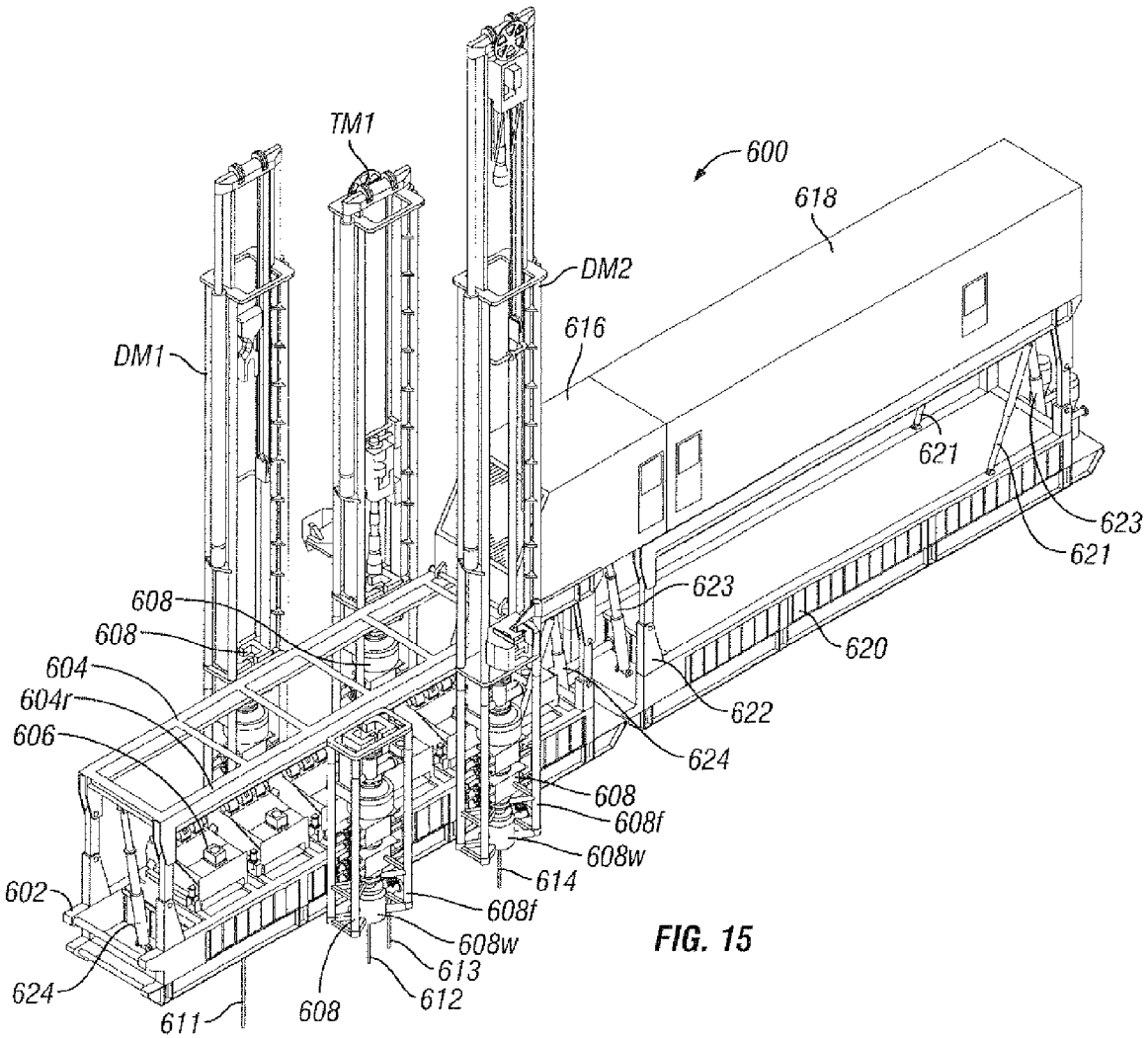
FIG. 15 is a perspective view of a system according to the present invention.
Figure 15A:
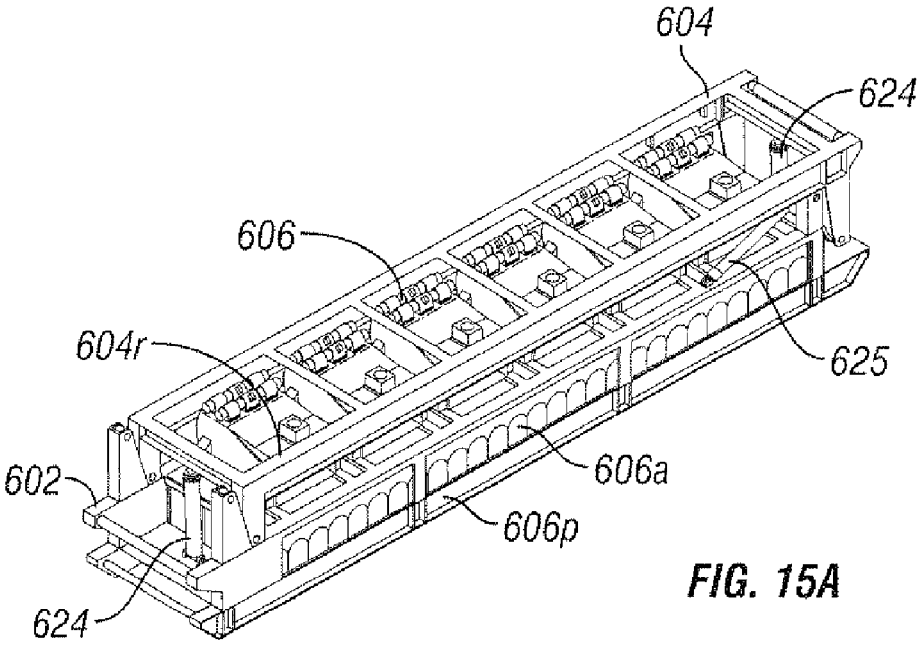
FIG. 15A is a perspective view of a rig floor and shaker pit of the system of FIG. 15.

FIG. 15 shows a system 600 according to the present invention which includes an erectable rig structure 602 with a floor 604 under which are a plurality of shale shakers 606 with a mud pit 606*p* (see, e.g., FIG. 15A), optionally as shown in FIG. 15A with an auger apparatus 606*a* for moving material in and from the mud pit 606*p*. The shakers and the mud pit are located between the wellbore locations 611-614 and are movable thereinto and therefrom as desired. For each well location, there may be pressure control equipment (e.g., a flowline; a blowout preventer apparatus; and/or diverter apparatus—indicated by the numeral 608). As shown, multiple blowout preventer stacks 608 are each located over a wellbore location 611-614. In certain particular aspects wells to be drilled at locations 611-614 are at least eight feet apart and at most twenty five feet apart, but any desired spacing is within the scope of the present invention. In one particular aspect, the wells are about fifteen feet apart. The shaker apparatuses 606 are supported by the structure 602.

A variety of machines can be used with the system 600 including, but not limited to, any machine in any system of FIGS. 3-20A. In one aspect two drilling machines DM1 and DM2 are connected to or are adjacent the rig structure 602, and a tripping machine TM1 is connected to or adjacent the rig structure 602. Any machine is movable to a position above any well location. Optionally, and selectively, the machines may be supported by the pressure control equipment and/or by a frame around any such equipment (e.g., a frame 608*f* as shown in FIG. 15, part of which encompasses a wellhead 608*w*). In such cases, drilling loads (the loads of a drilling machine and/or a tubular string connected to the drilling machine and/or equipment connected to the tubular string) are supported by the pressure control equipment (e.g., but not limited to, by a blowout preventer stack and/or by a frame therearound). Optionally, e.g. as shown in FIG. 17N, machines are supported by the equipment 608 and are out of the way of a driller's cabin 616 if it moves on the structure 602.

A driller's cabin 616 is connected to the rig structure 602 and another cabin 618 (or an extension of the cabin 616) is connected to erection structure 622 above an active rig mud system 620 (which may include mud pit structure). The erection structure 622 includes position locking apparatuses 621 and powered erection apparatuses 623, 624 (e.g., but not limited to, power cylinder apparatuses, lead screw apparatuses, and/or motorized apparatuses). Optionally, the cabin 616 is movable from one end of the structure to the other.

Figure 15B:
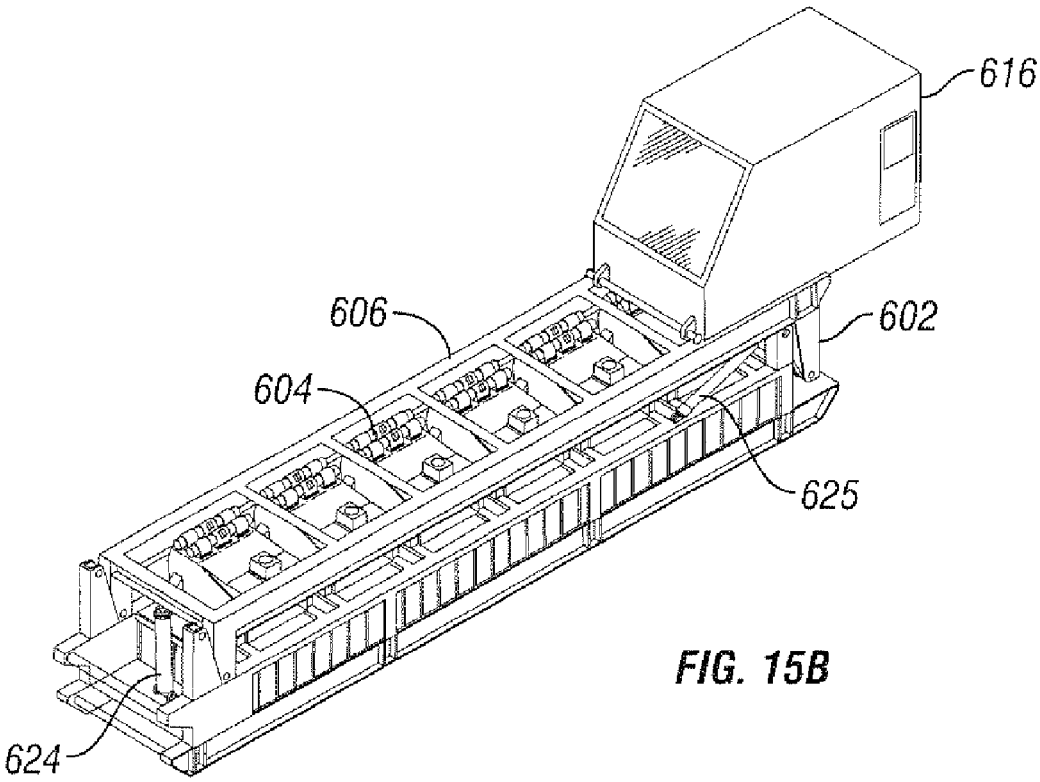
FIG. 15B is a perspective view of a driller's cabin on the floor of FIG. 15A.
Figure 15C:
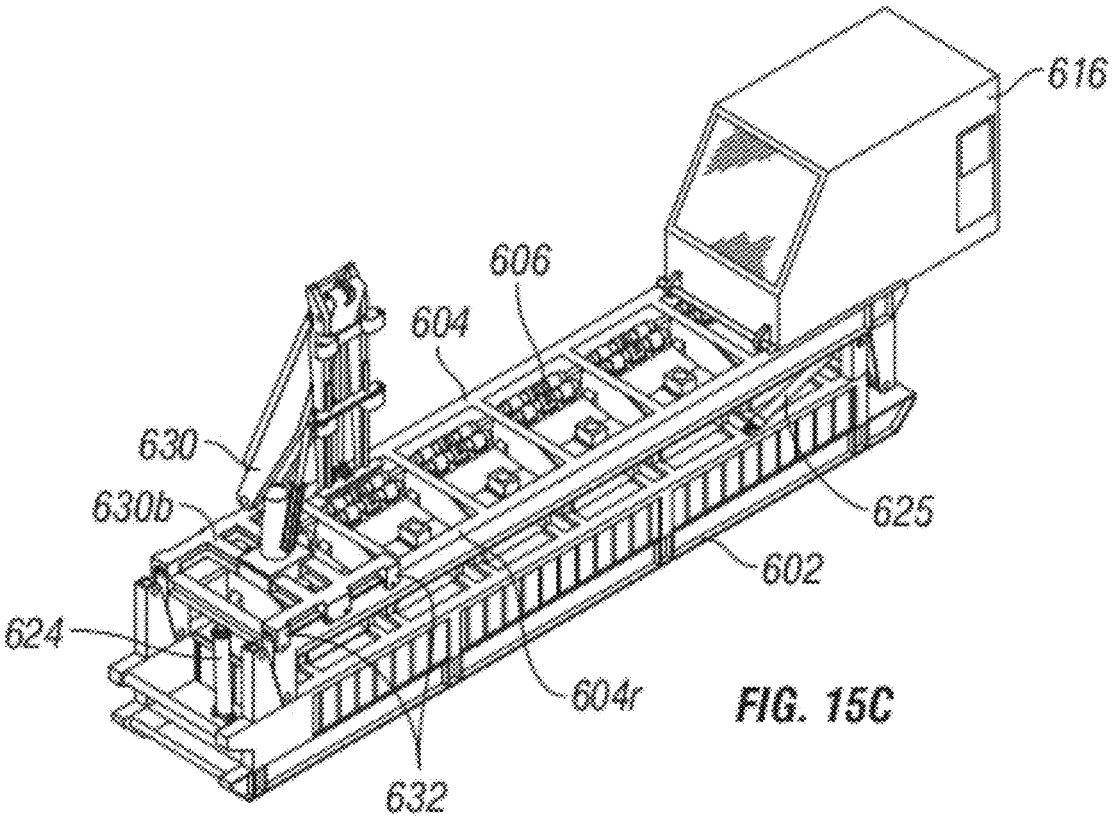
FIG. 15C is a perspective view of a crane on the floor of FIG. 15A.
Figure 15D:
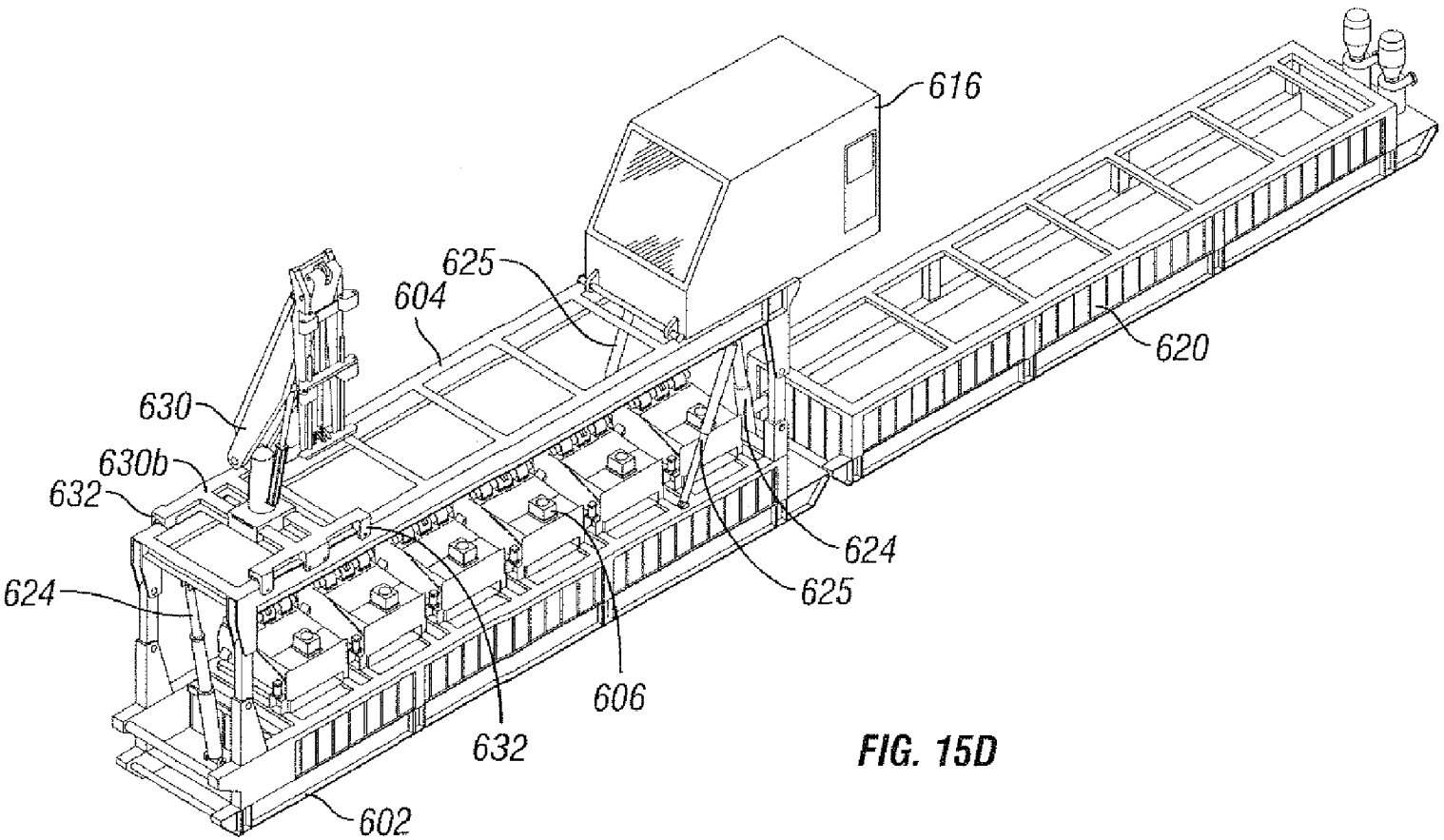
FIG. 15D is a perspective view of the system parts of FIG. 15B with an active mud system.

As shown in FIG. 15B, the driller's cabin 616 has been placed on and connected to the floor 604 of the rig structure 602. As shown in FIG. 15C a crane 630 has been placed on and connected to rails 604*r* of the floor 604. The crane 630 on a base 630*b* has roller apparatuses 632 which move on the rails 604*r*. FIG. 15D illustrates the position of the active rig mud system 620 and its connection to the rig structure 602 (with the rig structure 602 fully erected).

Figure 16A:
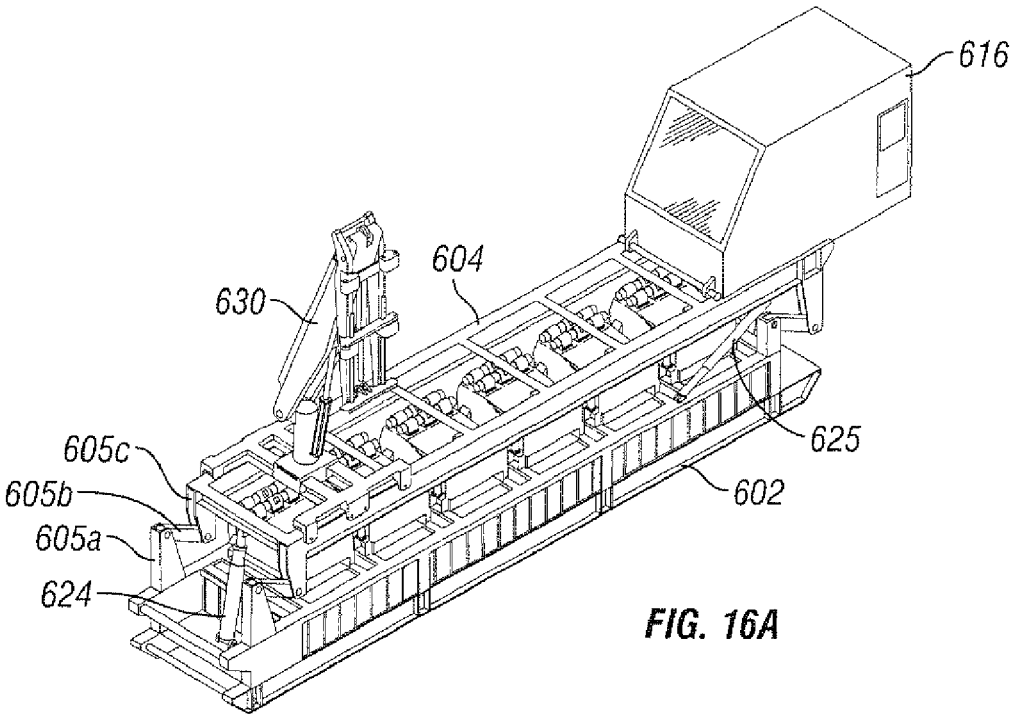
FIG. 16A is a perspective view showing a step in the erection of the rig floor of FIG. 15A.
Figure 16B:
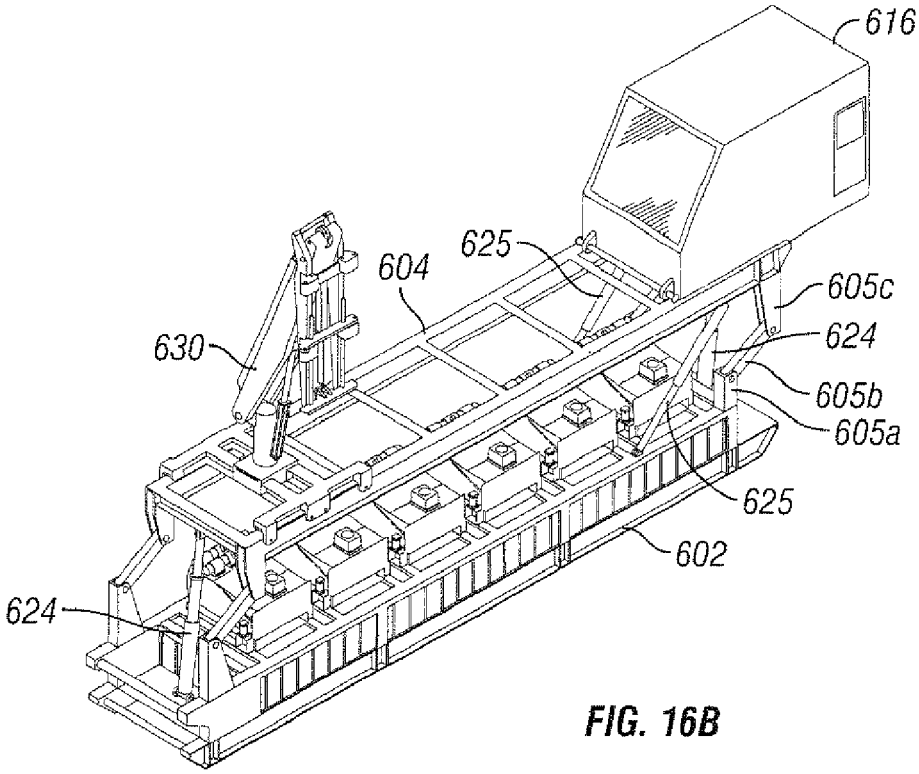
FIG. 16B is a perspective view showing a step in the erection of the rig floor of FIG. 15A.
Figure 16C:
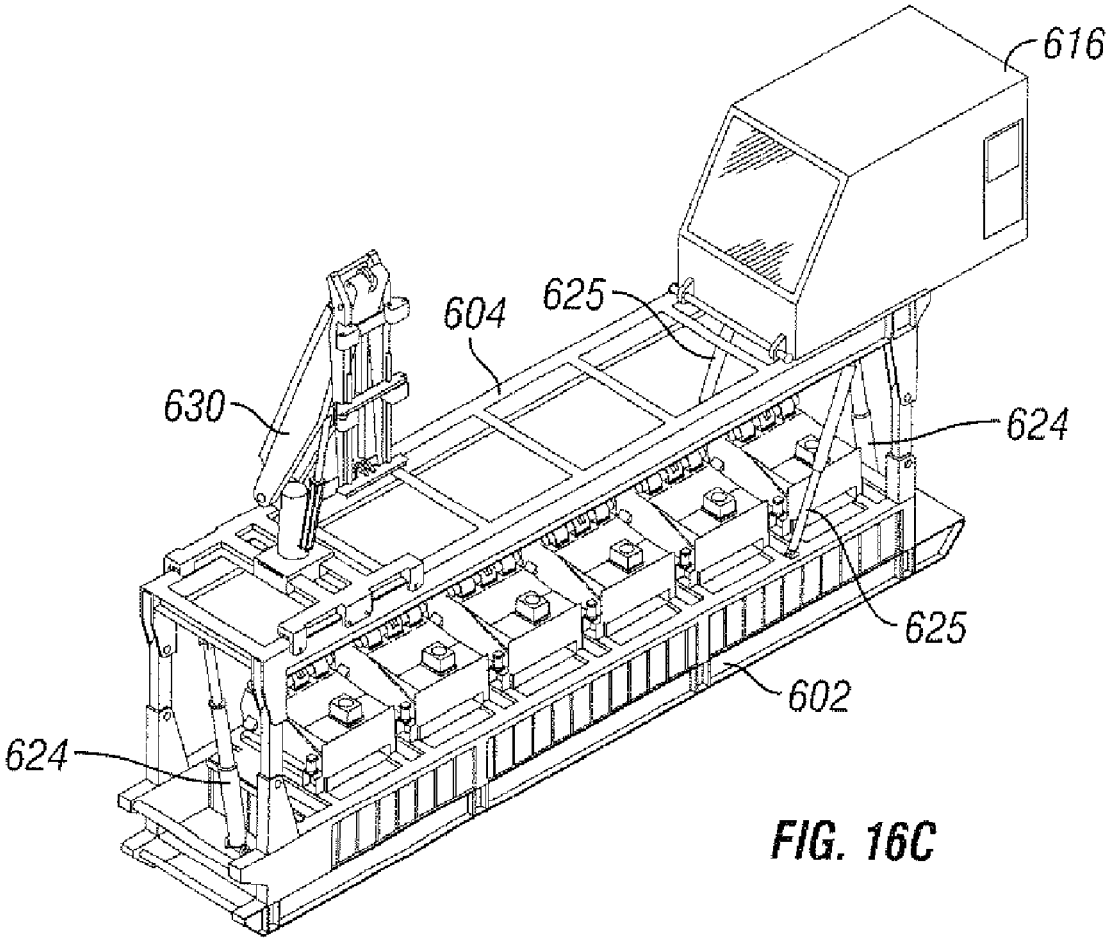
FIG. 16C is a perspective view showing a step in the erection of the rig floor of FIG. 15A.

FIGS. 16A-16C illustrate steps in the erection of the rig structure 602. Powered cylinder apparatuses 624 connected between a top 602*a* and a bottom 602*b* of the rig structure 602. As shown in FIG. 16A, the apparatuses 624 are energized and the rig structure 602 begins to rise. As shown in FIG. 16B, the rig structure 602 continues to rise. As shown in FIG. 16C the rig structure 602 has reached its full height and is locked in place with locking apparatuses 625

The rig structure 602 has four multi-part lets 605 each with a base 605*a*, a pivotably connected mid-section 605*b*, and an upper part 605*c*.

Figure 17A:
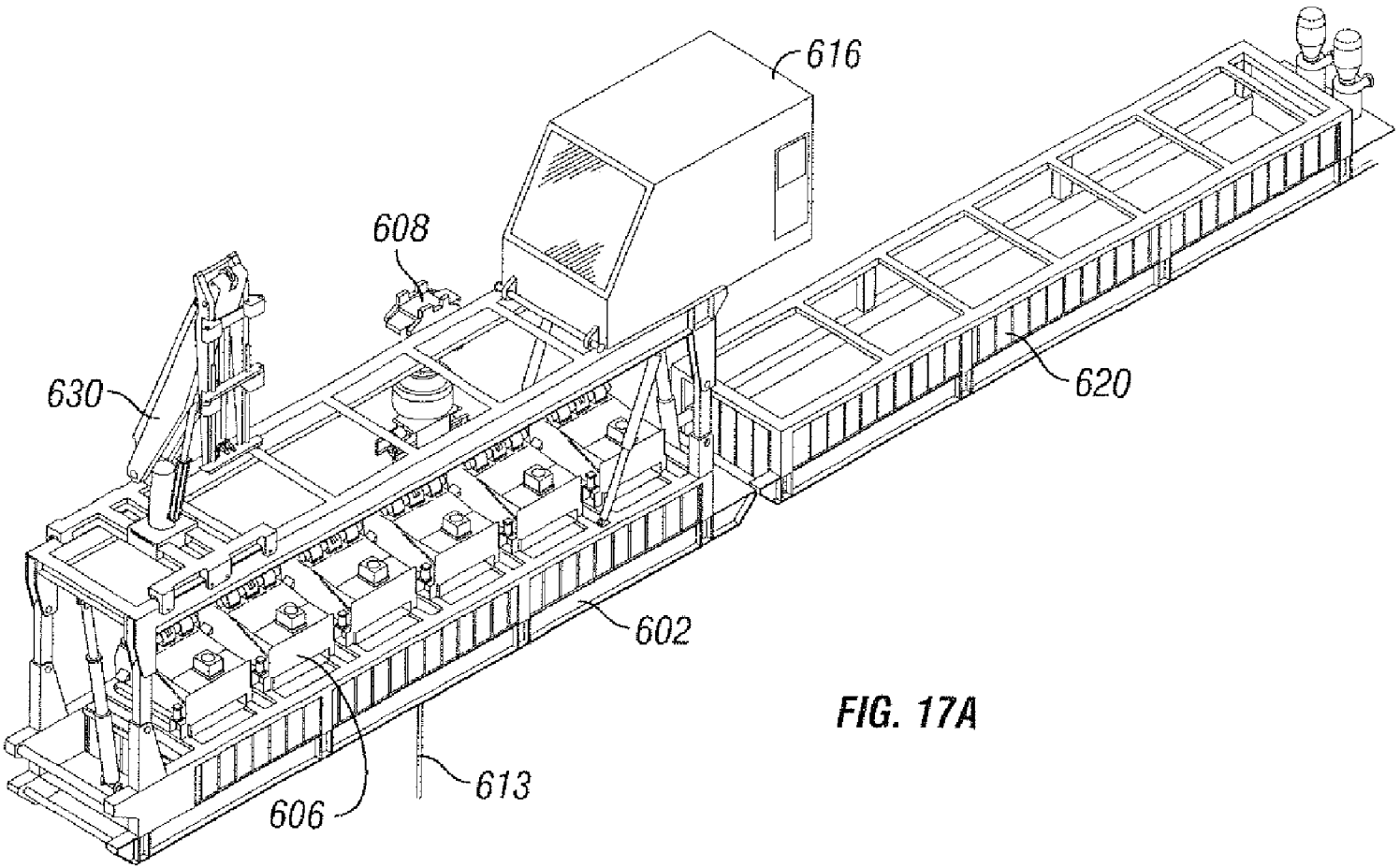
FIG. 17A is a perspective view showing a step in the method according to the present invention using the system of FIG. 15.
Figure 17B:
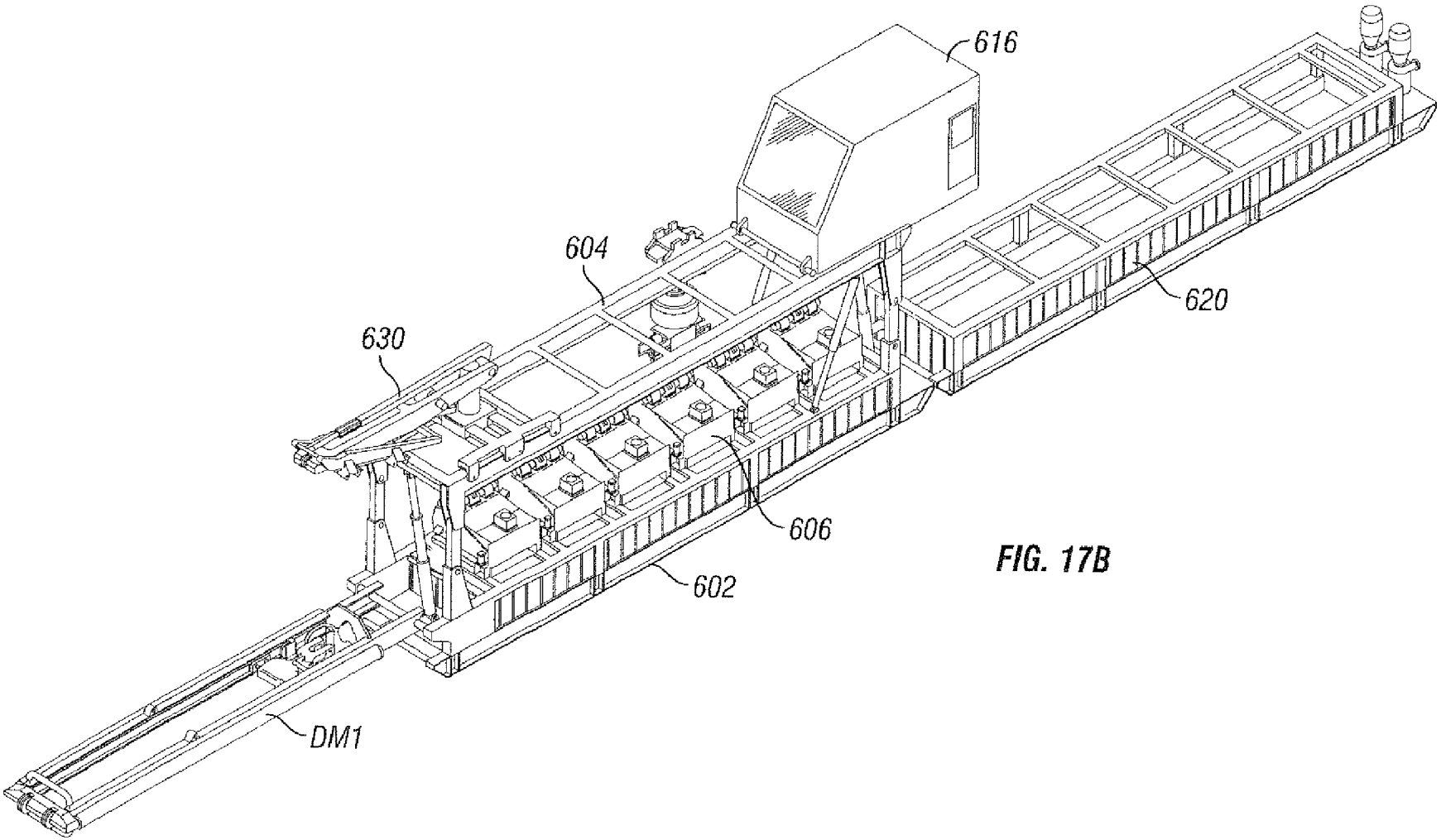
FIG. 17B is a perspective view showing a step in the method according to the present invention using the system of FIG. 15.
Figure 17C:
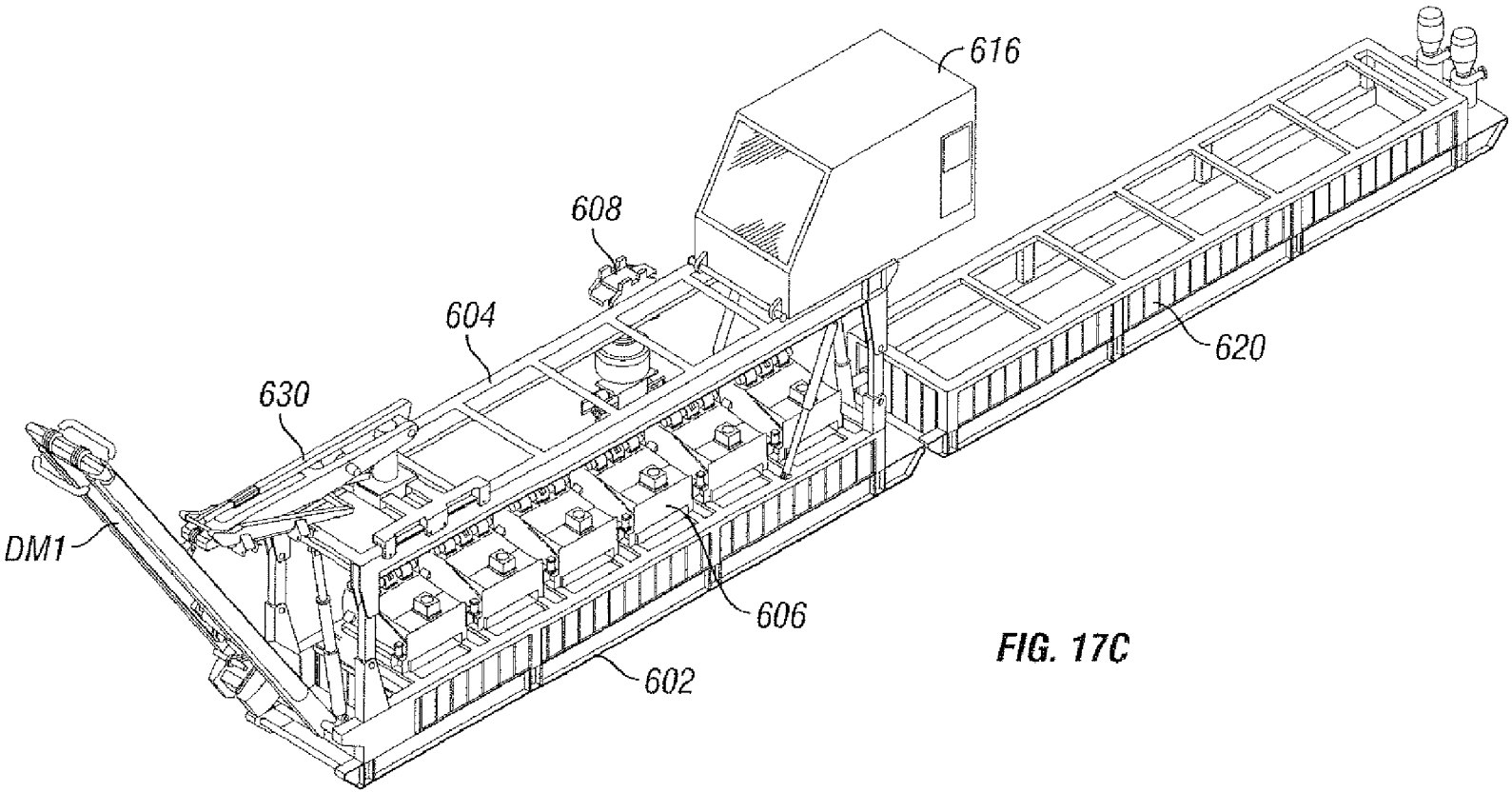
FIG. 17C is a perspective view showing a step in the method according to the present invention using the system of FIG. 15.
Figure 17D:
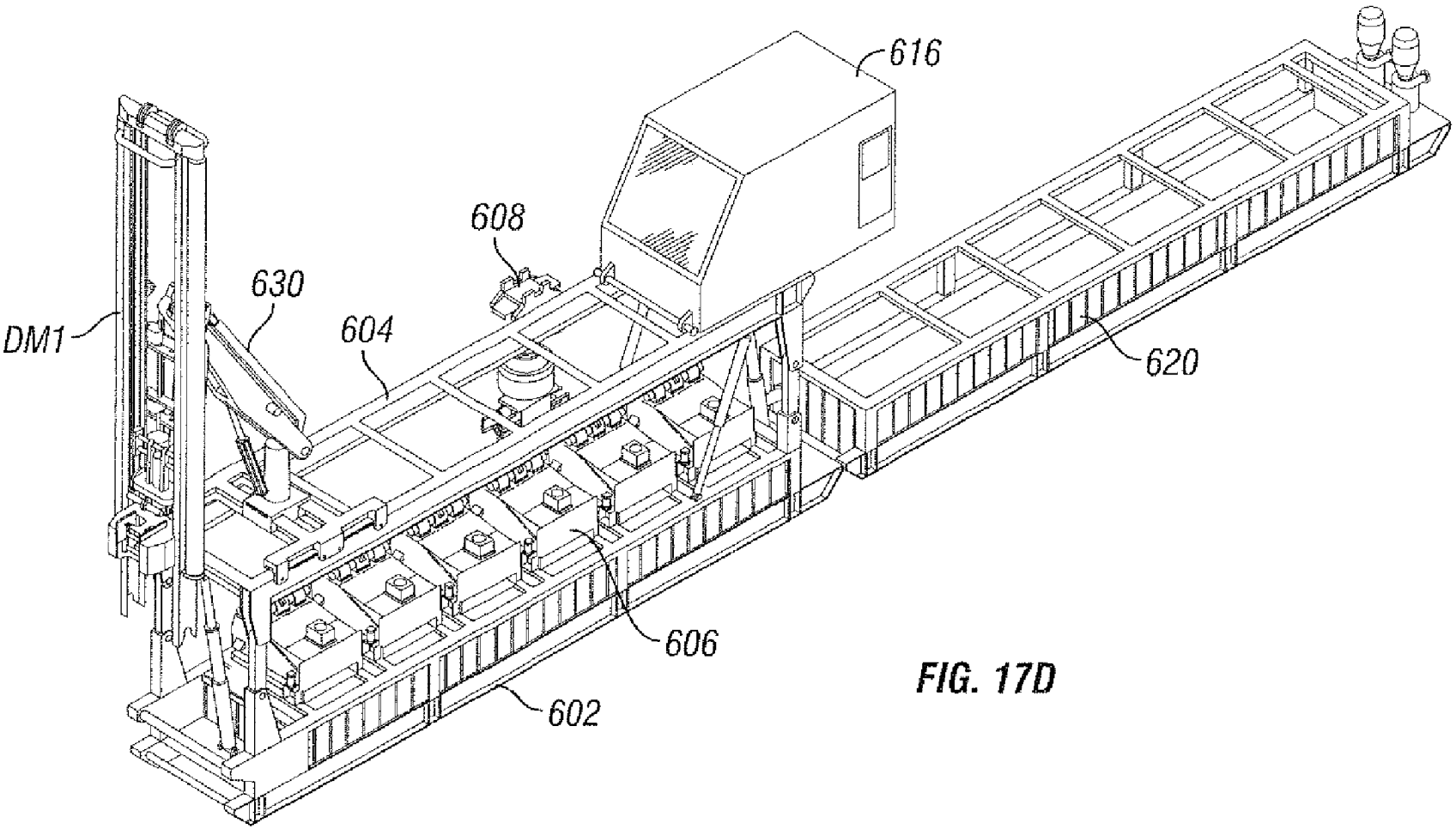
FIG. 17D is a perspective view showing a step in the method according to the present invention using the system of FIG. 15.
Figure 17E:
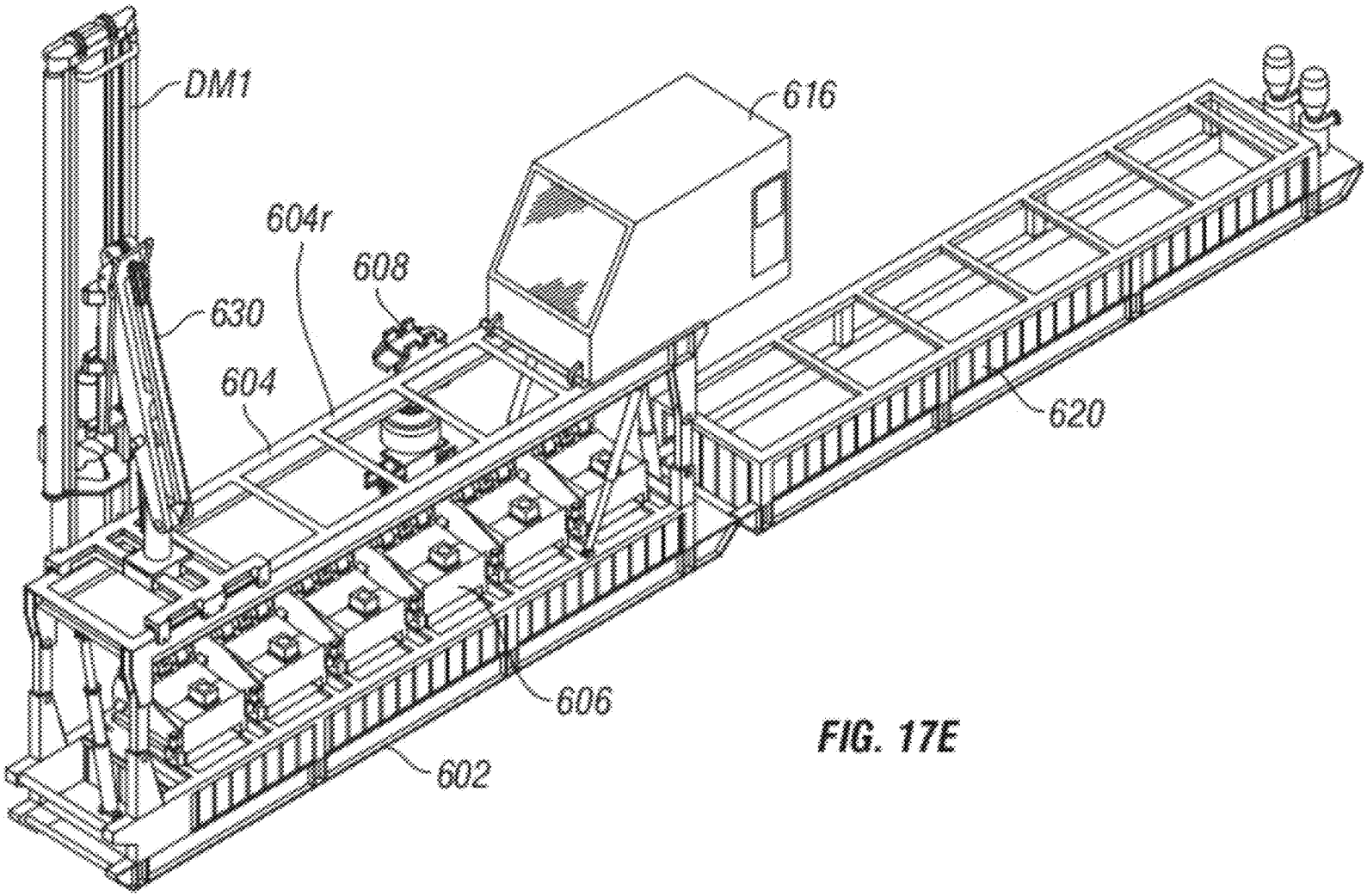
FIG. 17E is a perspective view showing a step in the method according to the present invention using the system of FIG. 15.
Figure 17F:
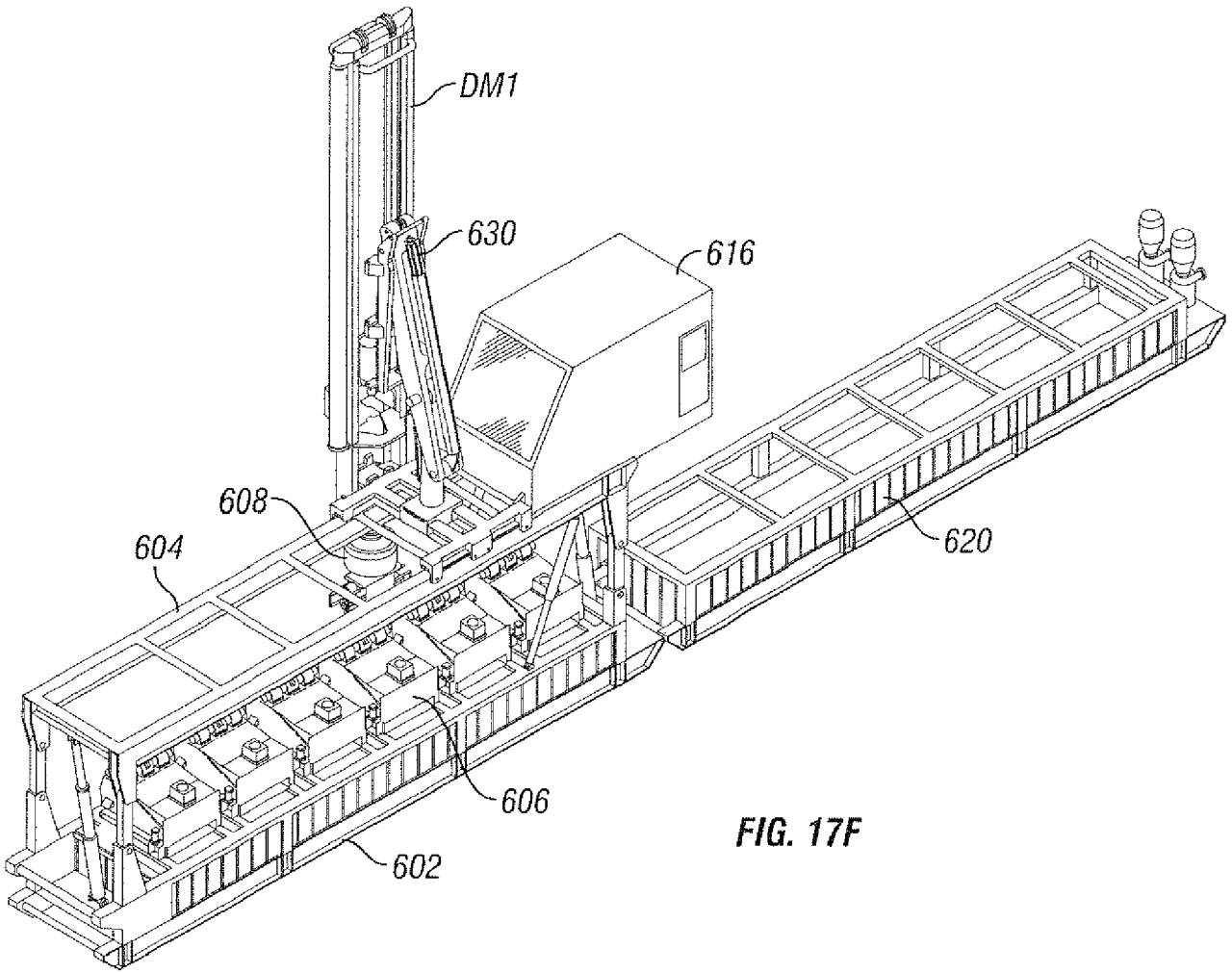
FIG. 17F is a perspective view showing a step in the method according to the present invention using the system of FIG. 15.
Figure 17G:
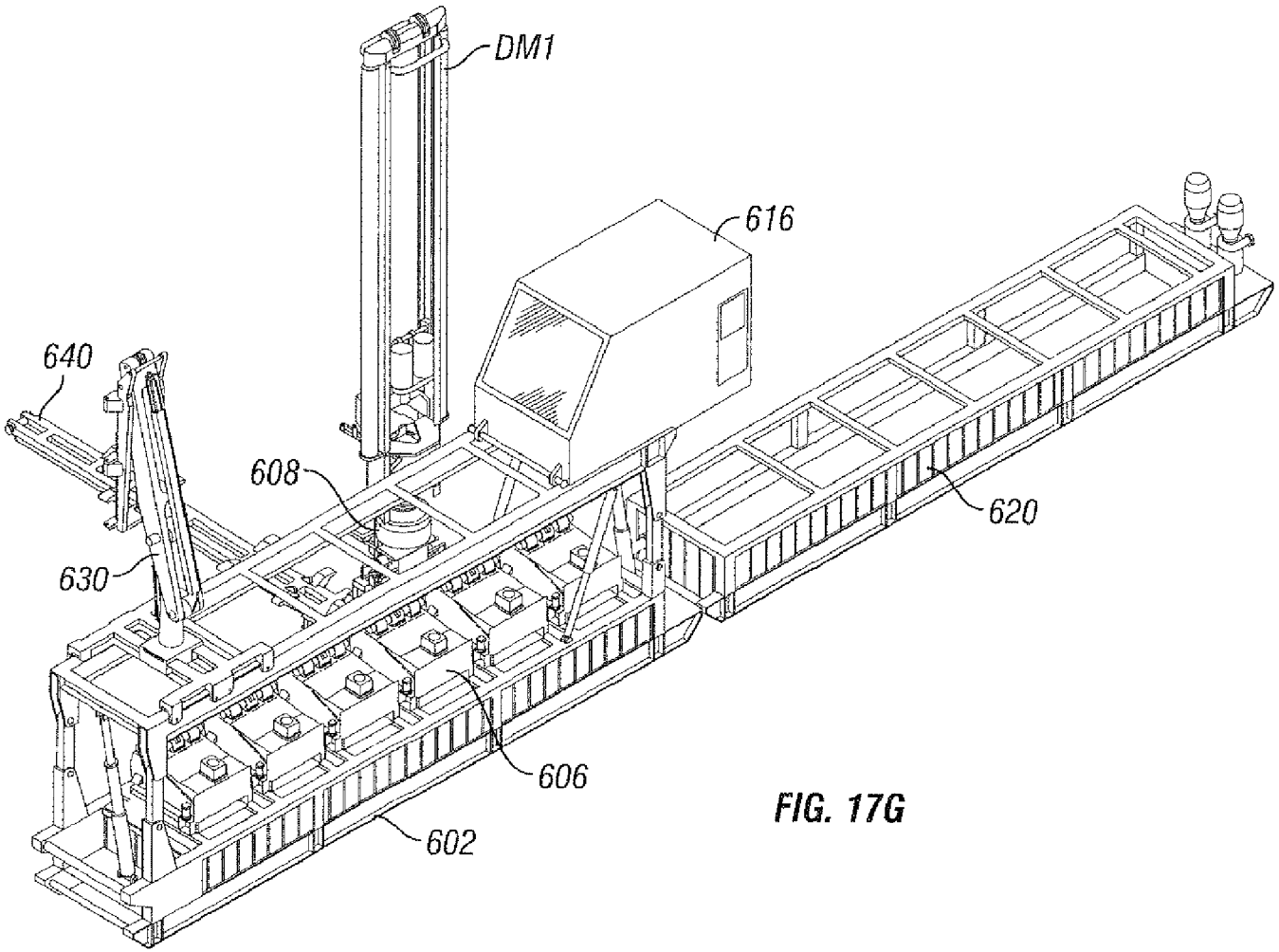
FIG. 17G is a perspective view showing a step in the method according to the present invention using the system of FIG. 15.
Figure 17H:
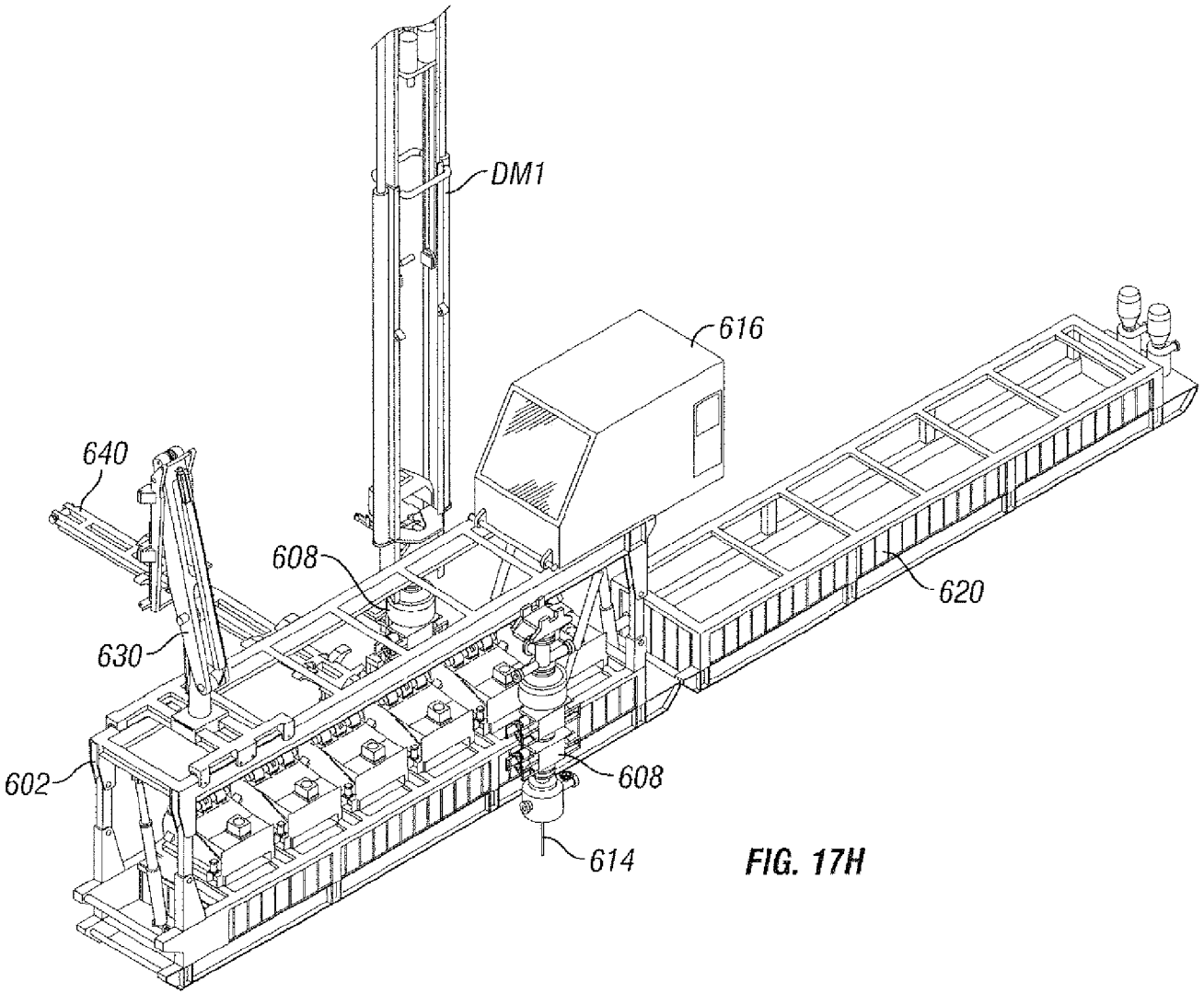
FIG. 17H is a perspective view showing a step in the method according to the present invention using the system of FIG. 15.
Figure 17I:
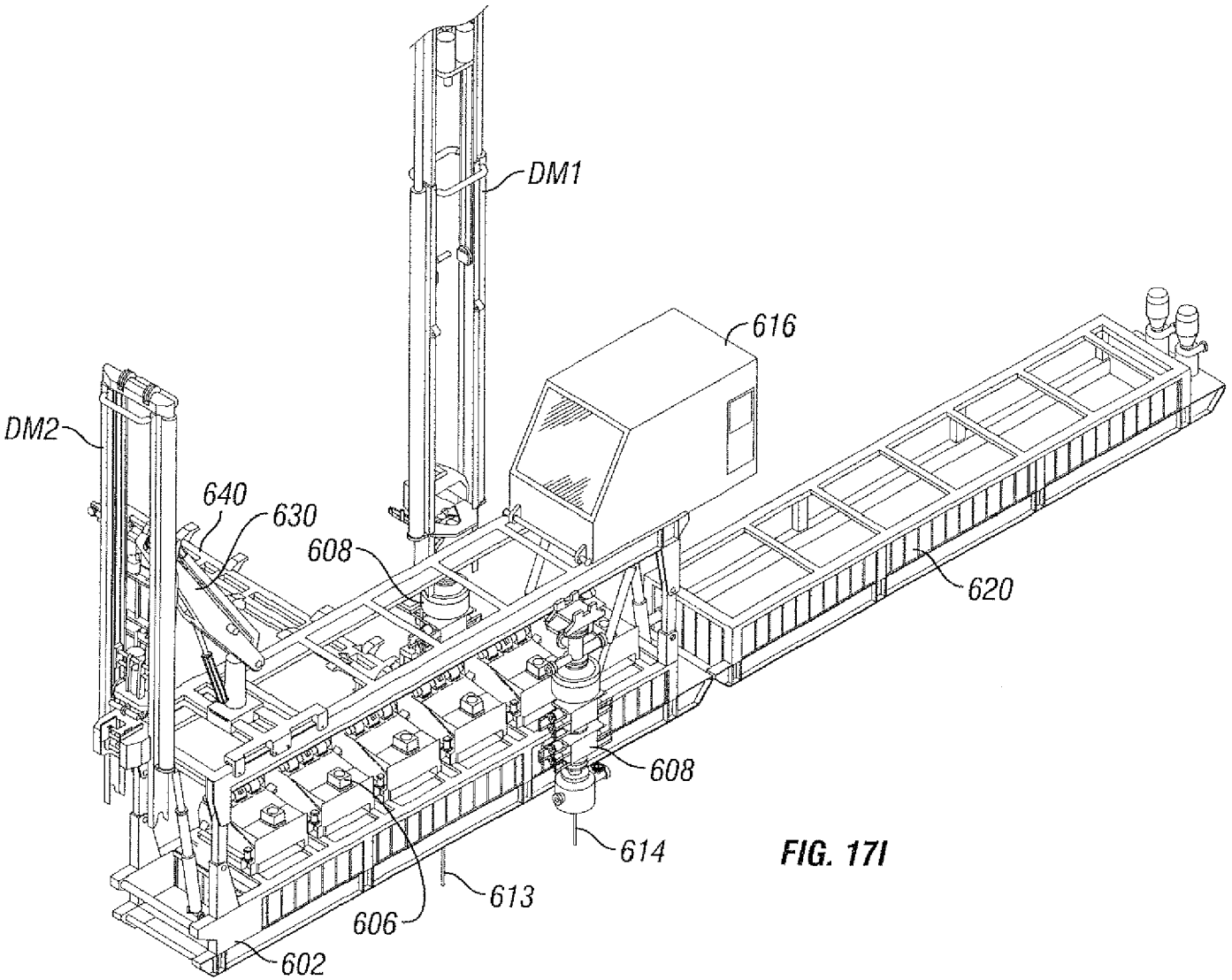
FIG. 17I is a perspective view showing a step in the method according to the present invention using the system of FIG. 15.
Figure 17J:
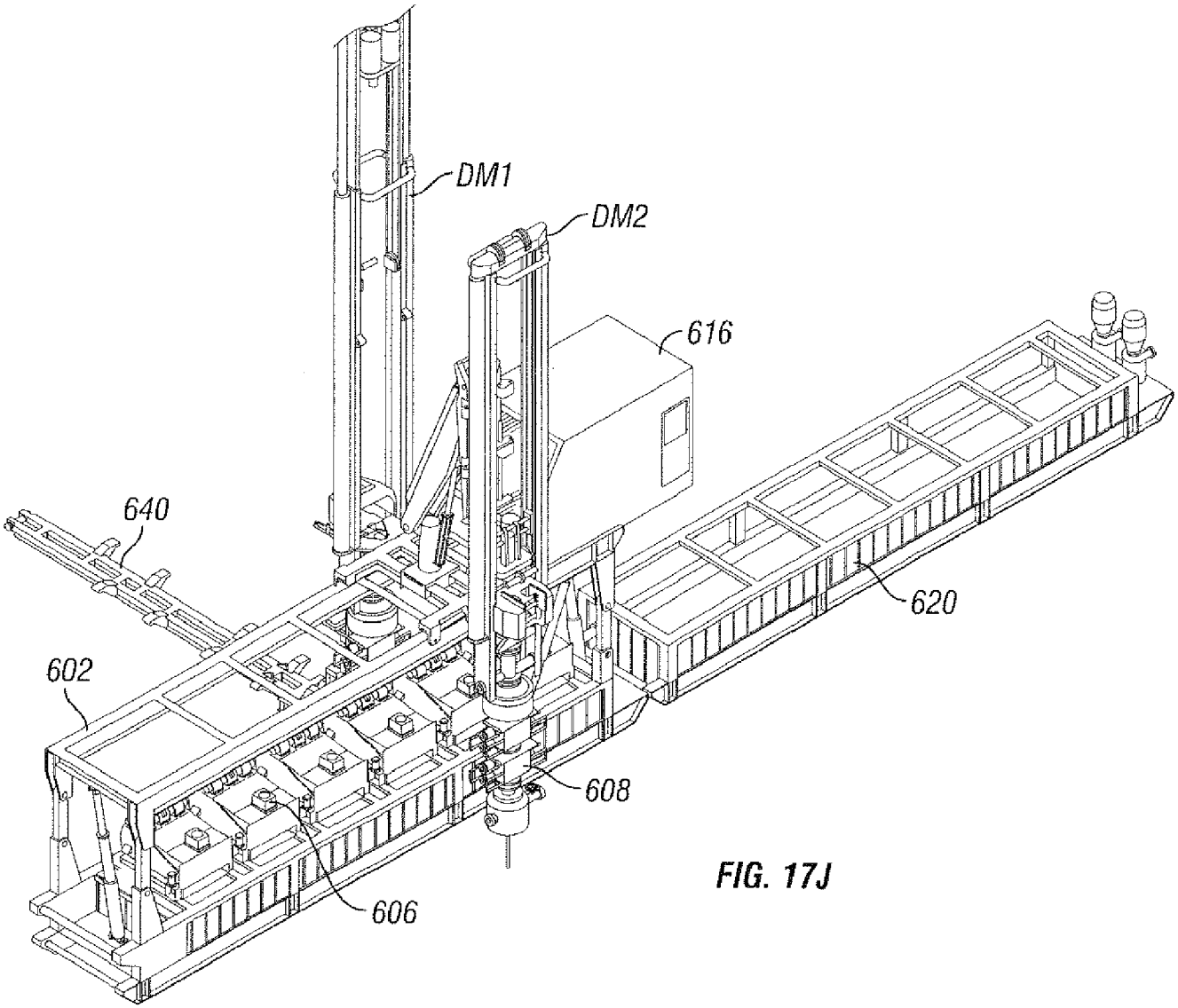
FIG. 17J is a perspective view showing a step in the method according to the present invention using the system of FIG. 15.
Figure 17K:
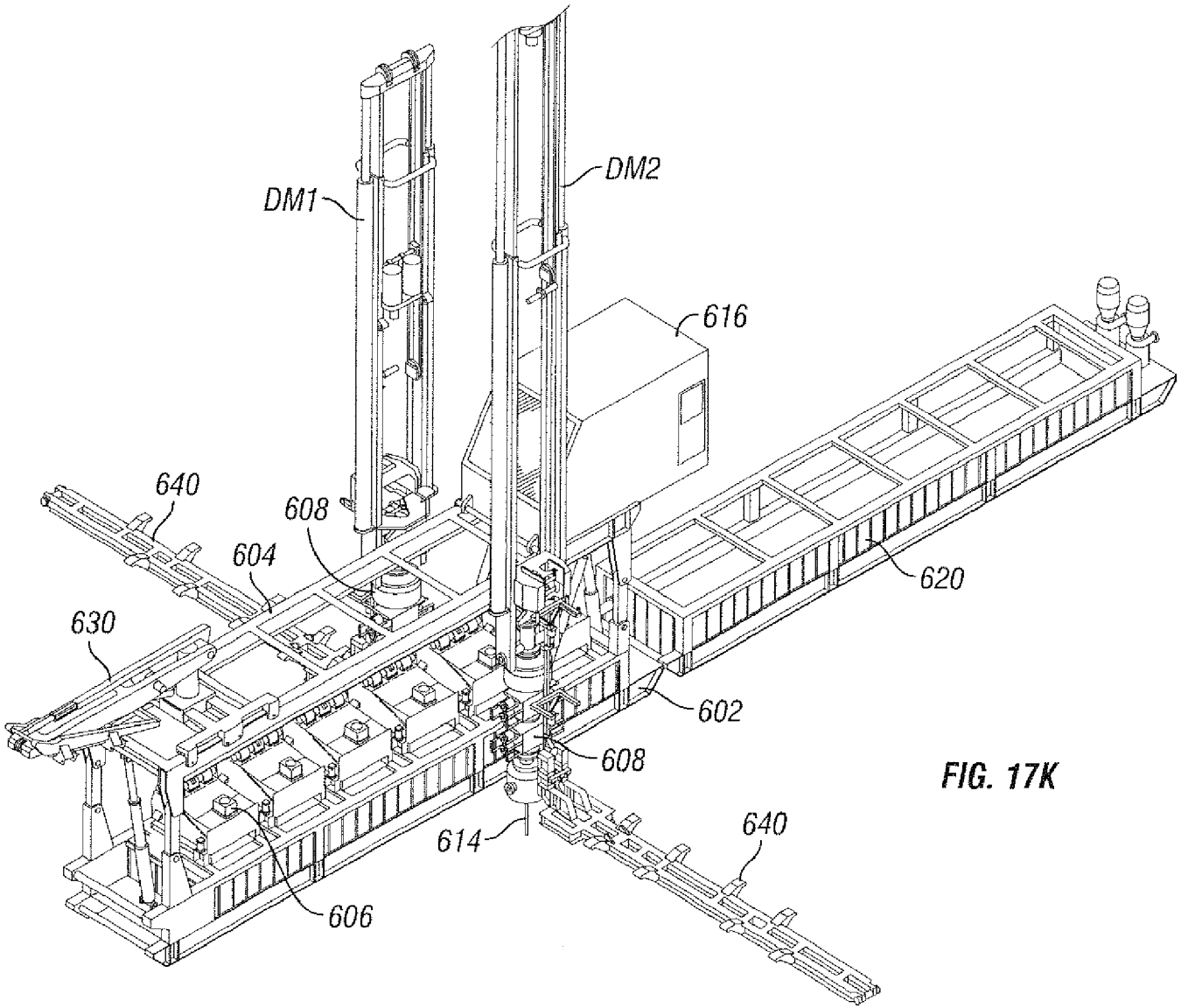
FIG. 17K is a perspective view showing a step in the method according to the present invention using the system of FIG. 15.
Figure 17L:
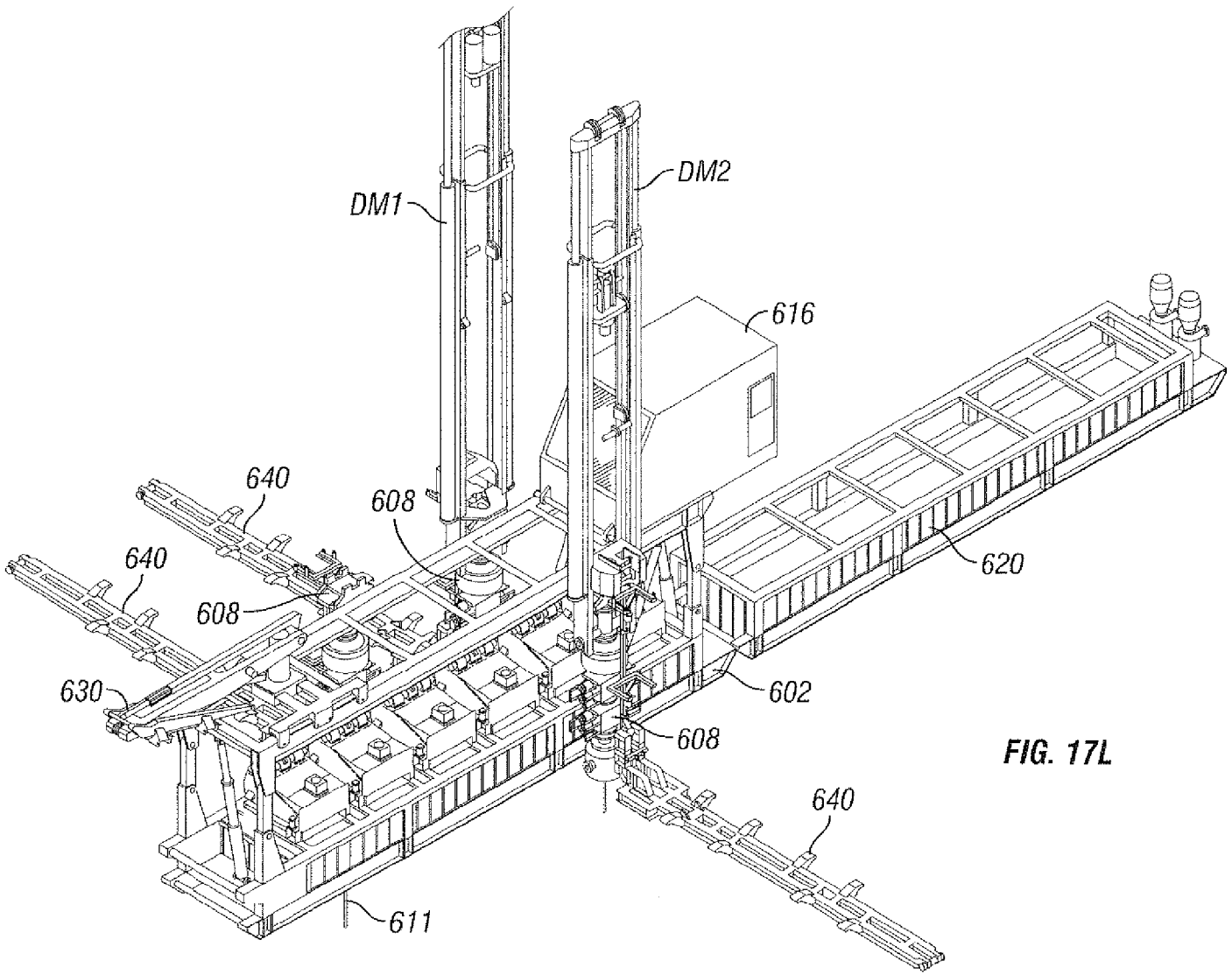
FIG. 17L is a perspective view showing a step in the method according to the present invention using the system of FIG. 15.
Figure 17M:
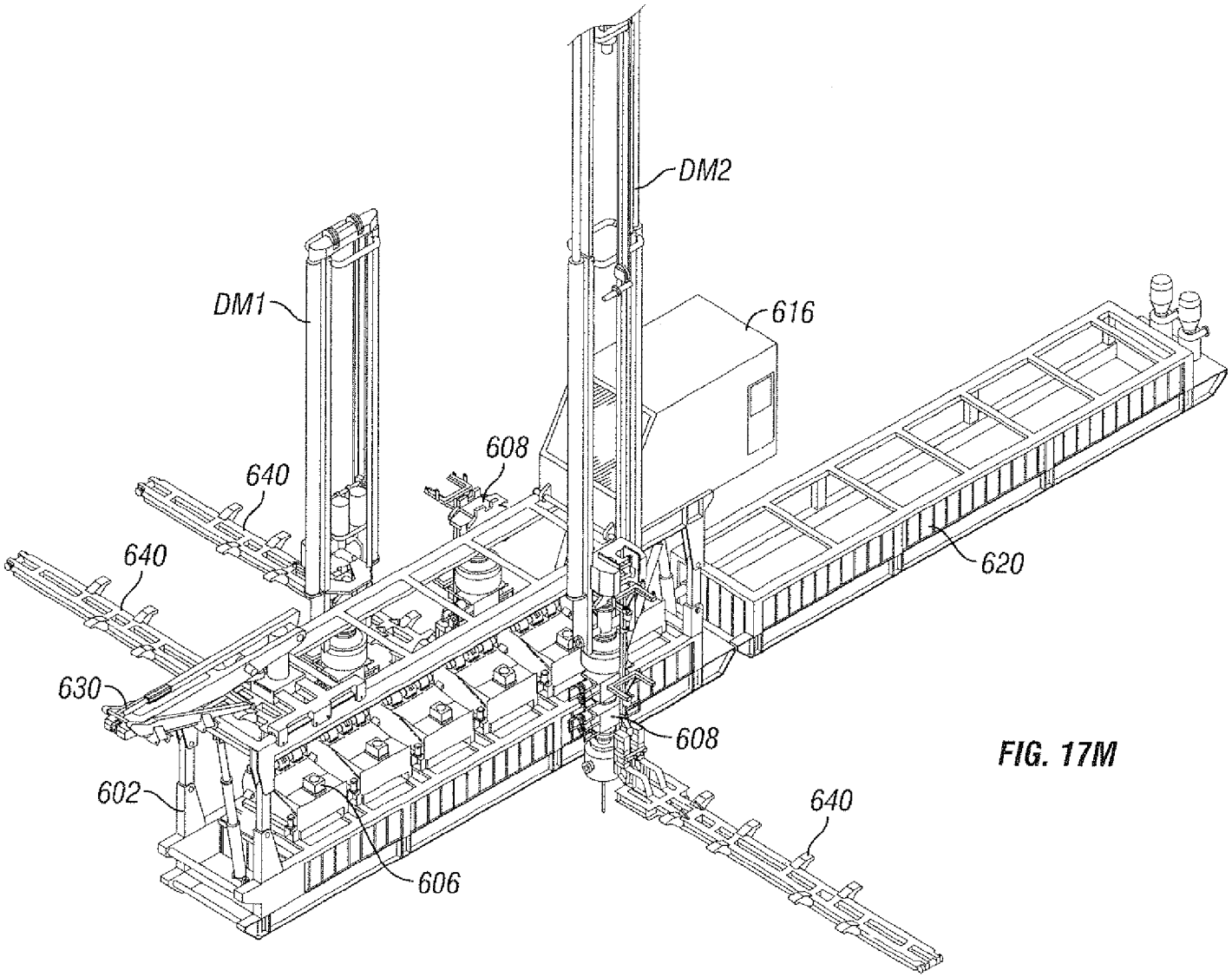
FIG. 17M is a perspective view showing a step in the method according to the present invention using the system of FIG. 15.
Figure 17N:
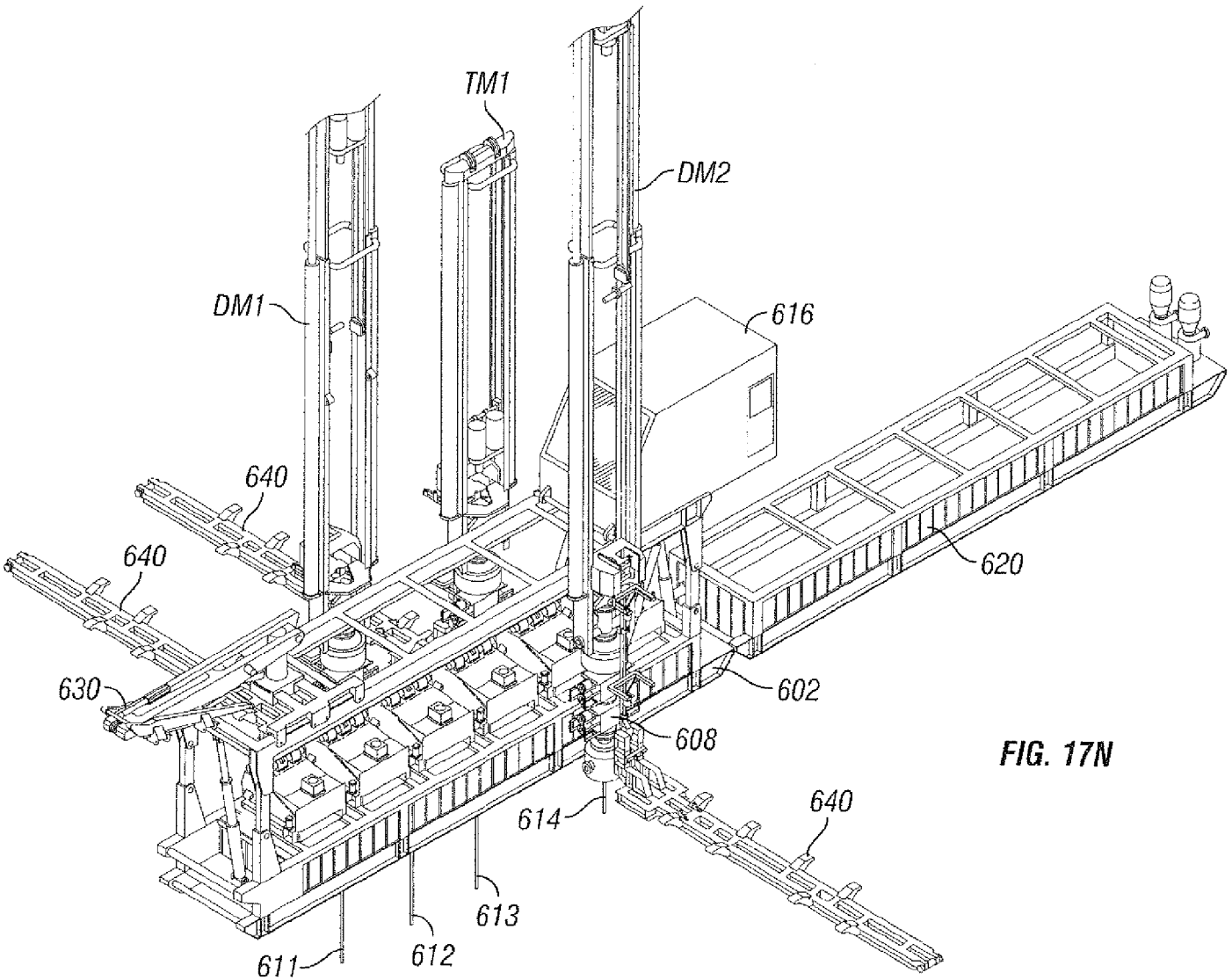
FIG. 17N is a perspective view showing a step in the method according to the present invention using the system of FIG. 15.
Figure 170:
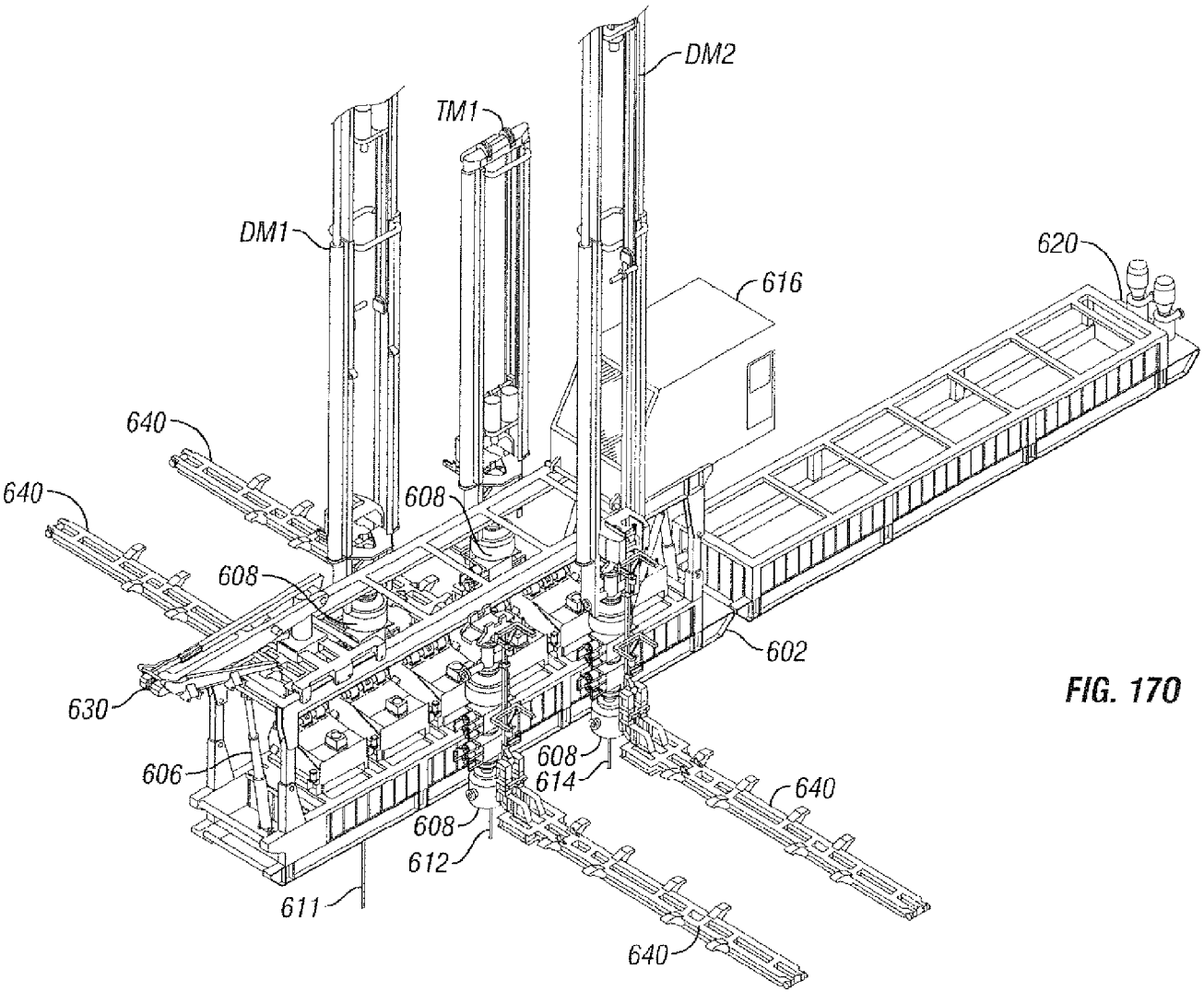
Figure 17P:
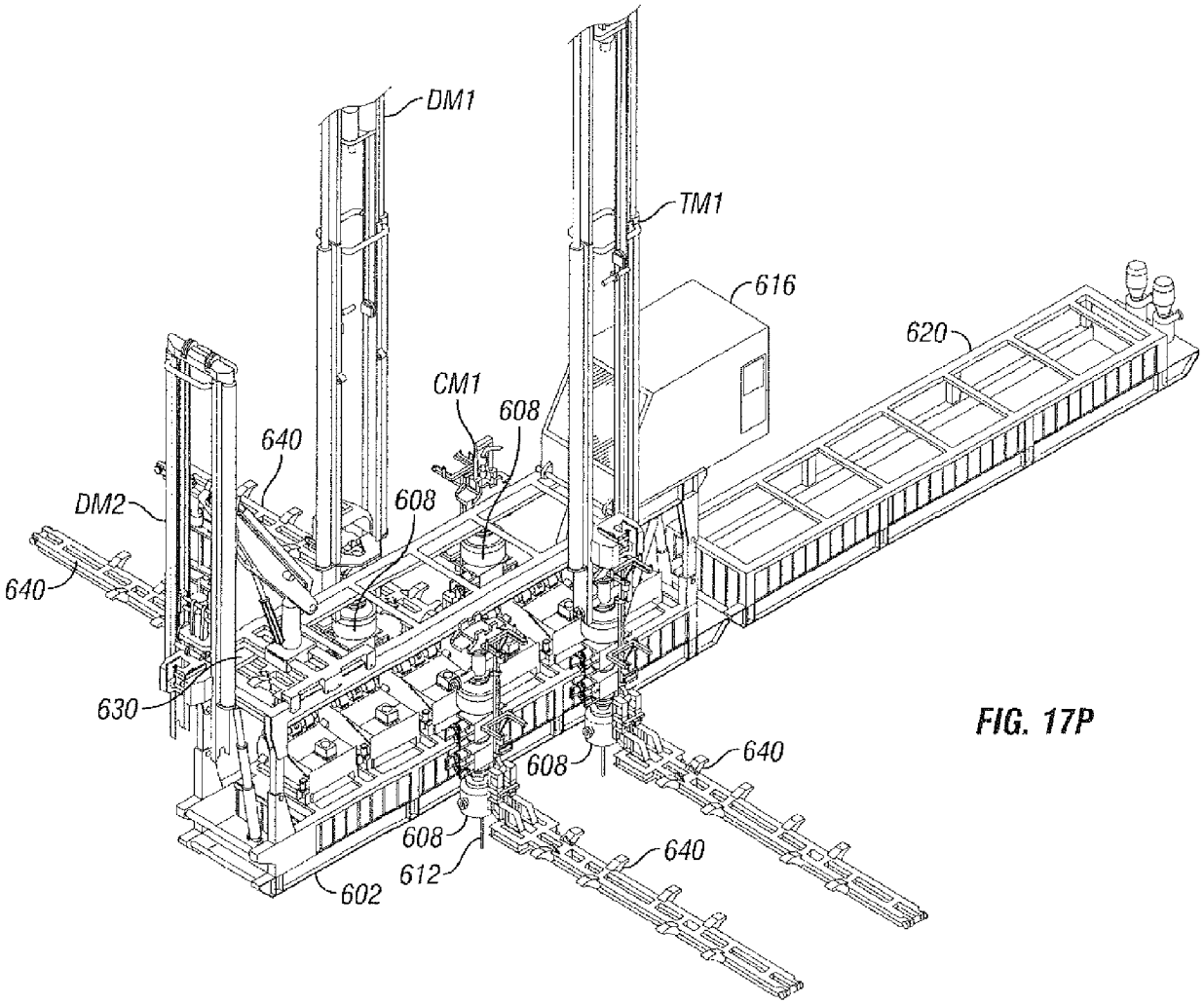
FIG. 17P is a perspective view showing a step in the method according to the present invention using the system of FIG. 15.
Figure 17Q:
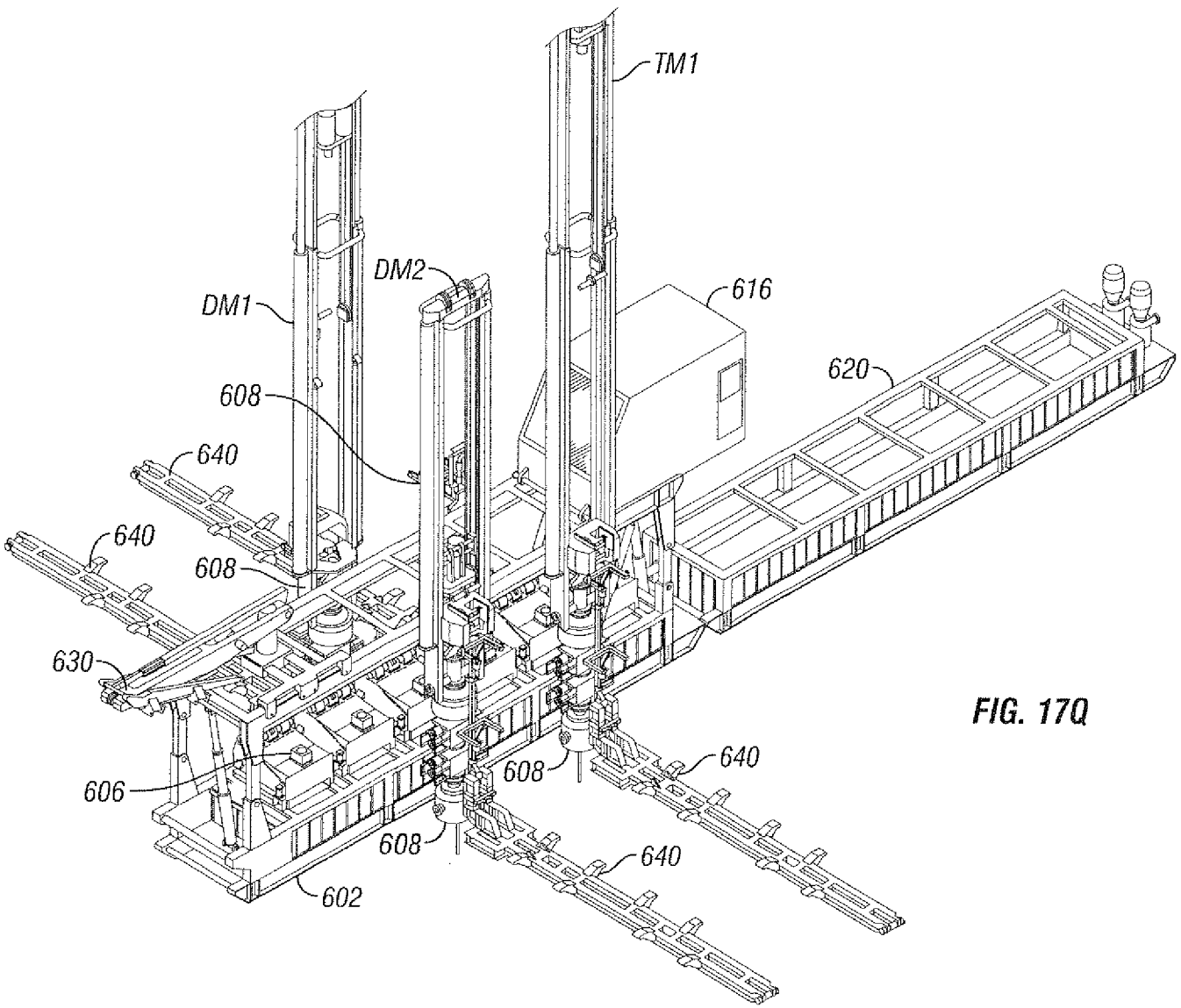
FIG. 17Q is a perspective view showing a step in the method according to the present invention using the system of FIG. 15.
Figure 17R:
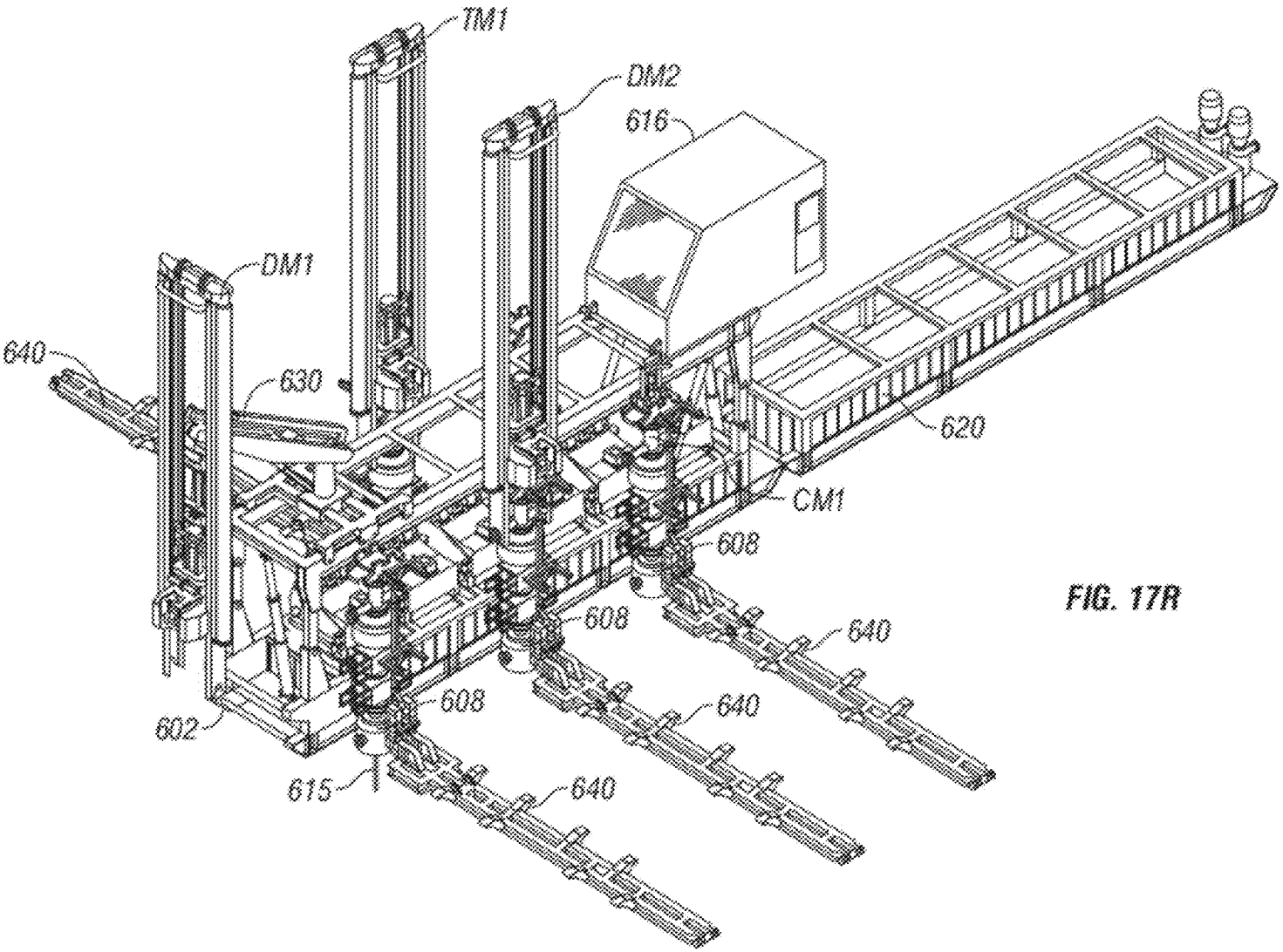
FIG. 17R is a perspective view showing a step in the method according to the present invention using the system of FIG. 15.
Figure 17S:
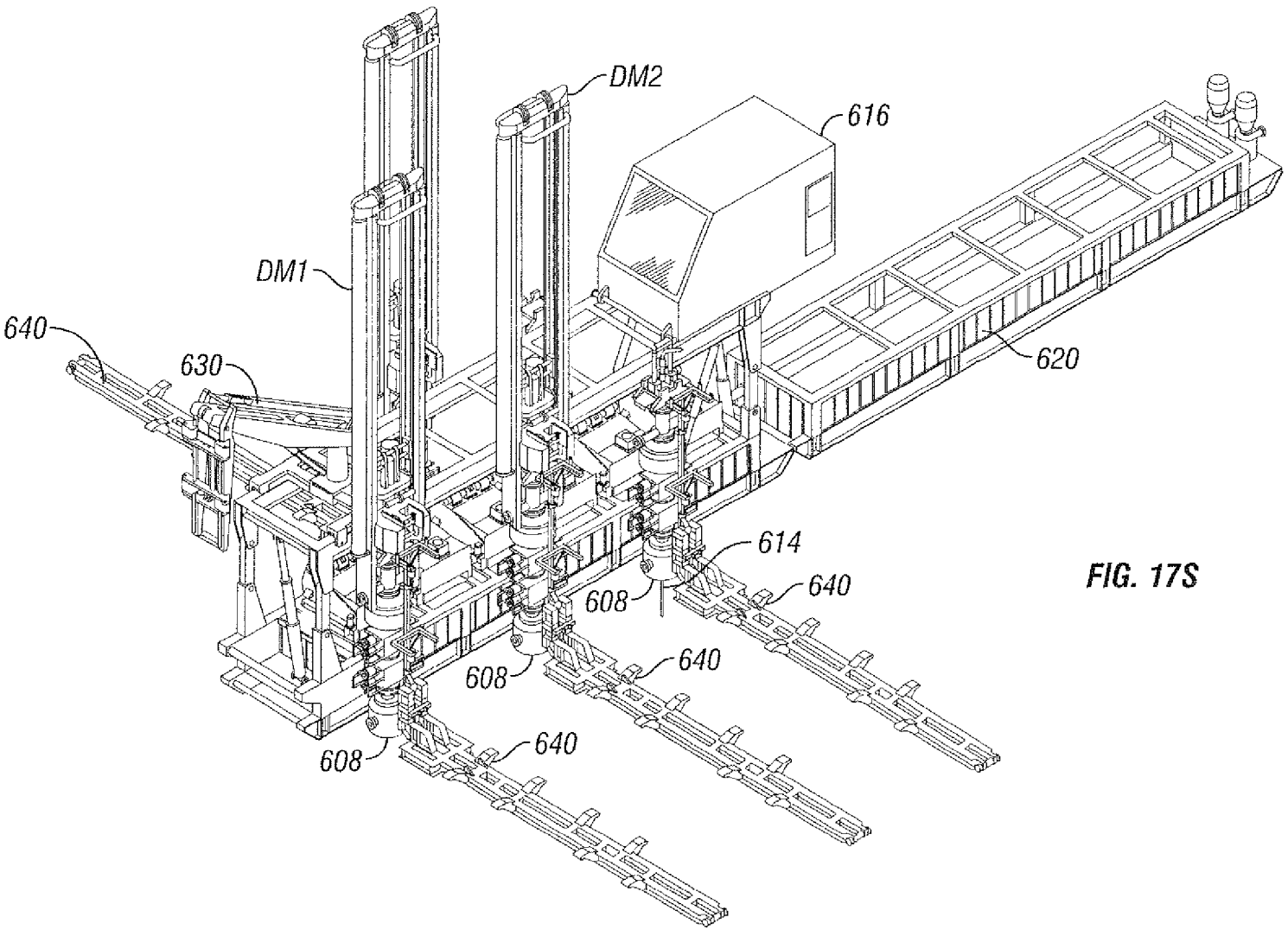
FIG. 17S is a perspective view showing a step in the method according to the present invention using the system of FIG. 15.

FIGS. 17A-17S illustrate steps in a method according to the present invention using the system 600.

As shown in FIG. 17A a blowout preventer stack 608 is lifted by lifting apparatus, e.g., by the crane 630, and placed in position over the well location 613.

A drilling machine DM1 is moved adjacent an end of the rig structure 602 and the crane 630 proceeds to begin lifting of the drilling machine DM1 (FIG. 17B). FIG. 17C shows the crane 630 lifting the drilling machine DM1 and FIG. 17D illustrates the crane 630 holding the drilling machine DM1 upright at the end of the rig structure 602.

FIG. 17E shows the crane 620 moving in the rails 604*r* of the floor 604 while supporting the drilling machine DM1. FIG. 17F shows the drilling machine DM1 in position above the stack 608 while the drilling machine DM1 is still connected to the crane 630.

FIG. 17G illustrates a pipe erector apparatus 640 with tubulars for tripping operations which has been moved adjacent the well location 613, e.g., to supply pipe for drilling by the drilling machine DM1 or tubulars, e.g., casing, for tripping operations.

As shown in FIG. 17H, the crane 630 has placed another blowout preventer stack in position over the well location 614. The crane 630 connects to and raises a second drilling machine DM2 (FIG. 17I) and moves it into place above the well location 614 (FIG. 17J). Meanwhile, the drilling machine DM1 is drilling a wellbore at the well location 613 (FIGS. 17I-17K).

As shown in FIG. 17K, a pipe erector apparatus 640 has been placed adjacent the well location 614 to supply drill pipe for drilling by the drilling machine DM2 and the crane 630 has moved to the end of the rig floor 604 opposite the end with the driller's cabin 616.

While drilling commences with the drilling machines DM1 and DM2, the crane 630 has positioned another blowout preventer stack 608 above the well location 611 (FIG. 17L) and another pipe erector apparatus 640 has been positioned adjacent the well location 611.

After the wellbore has been drilled at the well location 613, the drilling machine DM1 is moved by the crane 630 above the stack 608 at the well location 611 (FIG. 17M) while drilling with the drilling machine DM2 proceeds.

As shown in FIG. 17N, the crane 630 has moved a tripping machine TM1 into place at the well location 613 and the tripping machine has commenced a tripping operation, e.g. to trip out drill pipe and or to trip in casing to case a wellbore at the well location 613; and drilling proceeds with the drilling machine DM1 (well location 611) and with the drilling machine DM2 (well location) 614.

The crane 630 moves a blowout preventer stack 608 (or other pressure control equipment if it is used) into position at the well location 612 and a pipe erector apparatus 640 is positioned at this well location (FIG. 17O). Meanwhile, the machines DM1, DM2 and TM1 continue their operations.

FIG. 17P illustrates movement of the drilling machine DM2 by the crane 630 toward the well location 612 after the crane 630 has moved the tripping machine to the well location 614. Meanwhile, the machine DM1 continues operation as does the tripping machine TM1 and a cementing machine CM1 (previously moved into place by the crane) is cementing casing in place in the wellbore 613.

As shown in FIG. 17Q the drilling machine DM2 has commenced drilling a wellbore at the well location 612 while the machines DM1, CM1, and TM1 continue operations.

FIG. 17R shows the tripping machine TM1 (after movement by the crane 630) proceeding with a tripping operation at the well location 611 while the drilling machine DM2 continues drilling a wellbore at the well location 612. Meanwhile the crane 630 is moving the drilling machine DM1 to a new well location 615 (after moving a stack 608 there and after a pipe erector apparatus 640 has been installed there). The cementing machine CM1, after being moved to the well location 614, is cementing casing in the wellbore 614.

As shown in FIG. 17S, the drilling machine DM1 has commenced drilling a wellbore at the well location 615; the drilling machine DM2 is finishing a drilling operation at the well location 612; and the cementing machine CM1 is finishing the cementing job for the wellbore 614.

Optionally, at any well location in FIGS. 17A-17S, a cementing machine is used as desired. At this time wellbores at the well locations 611 and 613 are drilled and cased with casing.

Figure 18:
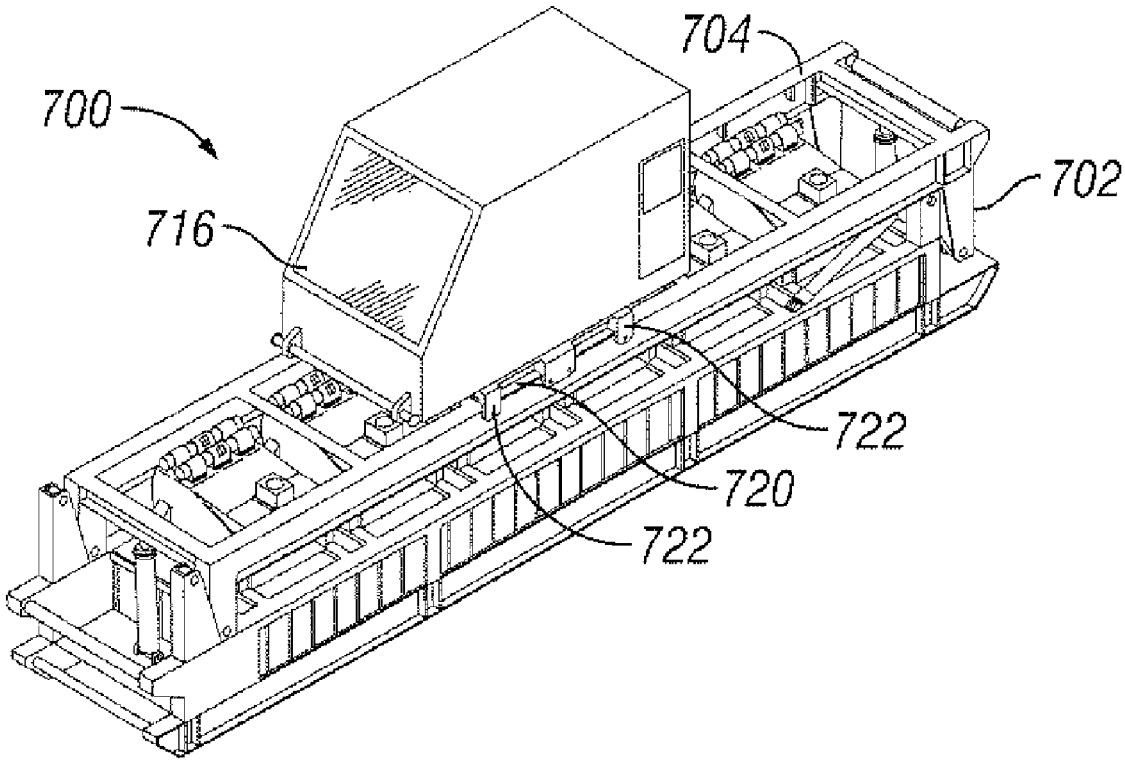
FIG. 18 is a perspective view of a system according to the present invention.

FIG. 18 shows a system 700 according to the present invention with a rig structure 702 (like the rig structure 602) and a driller's cabin 716 (like the driller's cabin 616). The driller's cabin 716 is mounted on a base 720 which is movable on a floor 704 of the structure 702. The base 720 has a plurality of roller apparatuses 722 (four present, two on each side; two shown) to facilitate movement of the base 720 on the floor 704.

Any system disclosed herein according to the present invention may have a movable driller's cabin (e.g. like that of the system 700).

Figure 19:
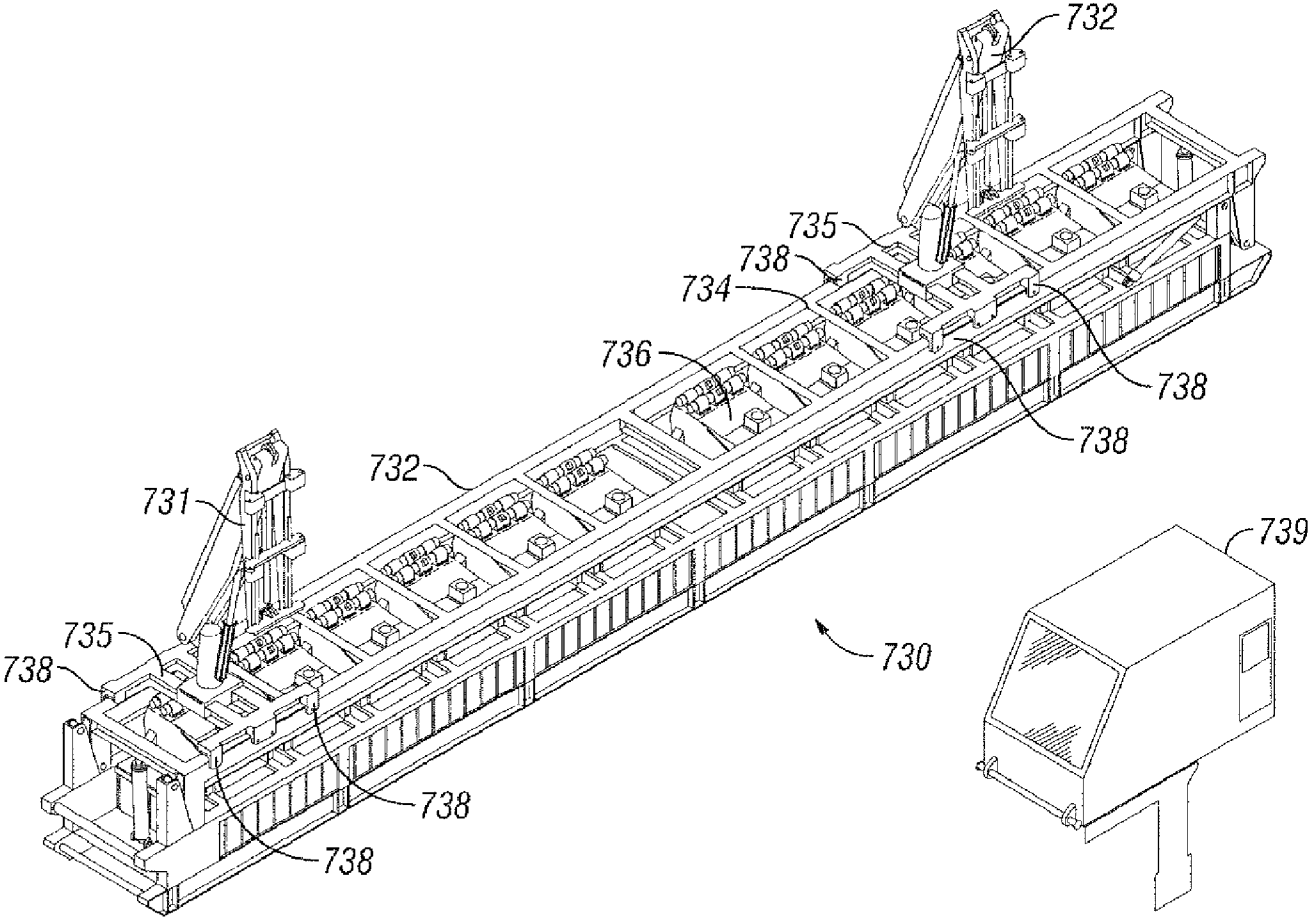
FIG. 19 is a perspective view of a system according to the present invention.

FIG. 19 illustrates a system 730 according to the present invention which has a rig structure 732 (like the rig structures 602 or 702) with a floor 734 under which, optionally, is a series of shale shakers 736. Two cranes 731, 733 are movably mounted on the floor 734. Each crane has a base 735 and roller apparatuses 738.

The system 730 may have a driller's cabin as in any system disclosed herein (e.g., but not limited to, the systems of FIGS. 15A and 18) or it may have a driller's cabin 739 spaced-apart from the rig structure 732, but positioned for viewing of the entire rig structure 732 and operations conducted therewith (as may any system according to the present invention have a driller's cabin 739 instead of the cabin disclosed above for any such system).

Any system disclosed herein according to the present invention may have multiple movable cranes (e.g. like the system 730).

Figure 20A:
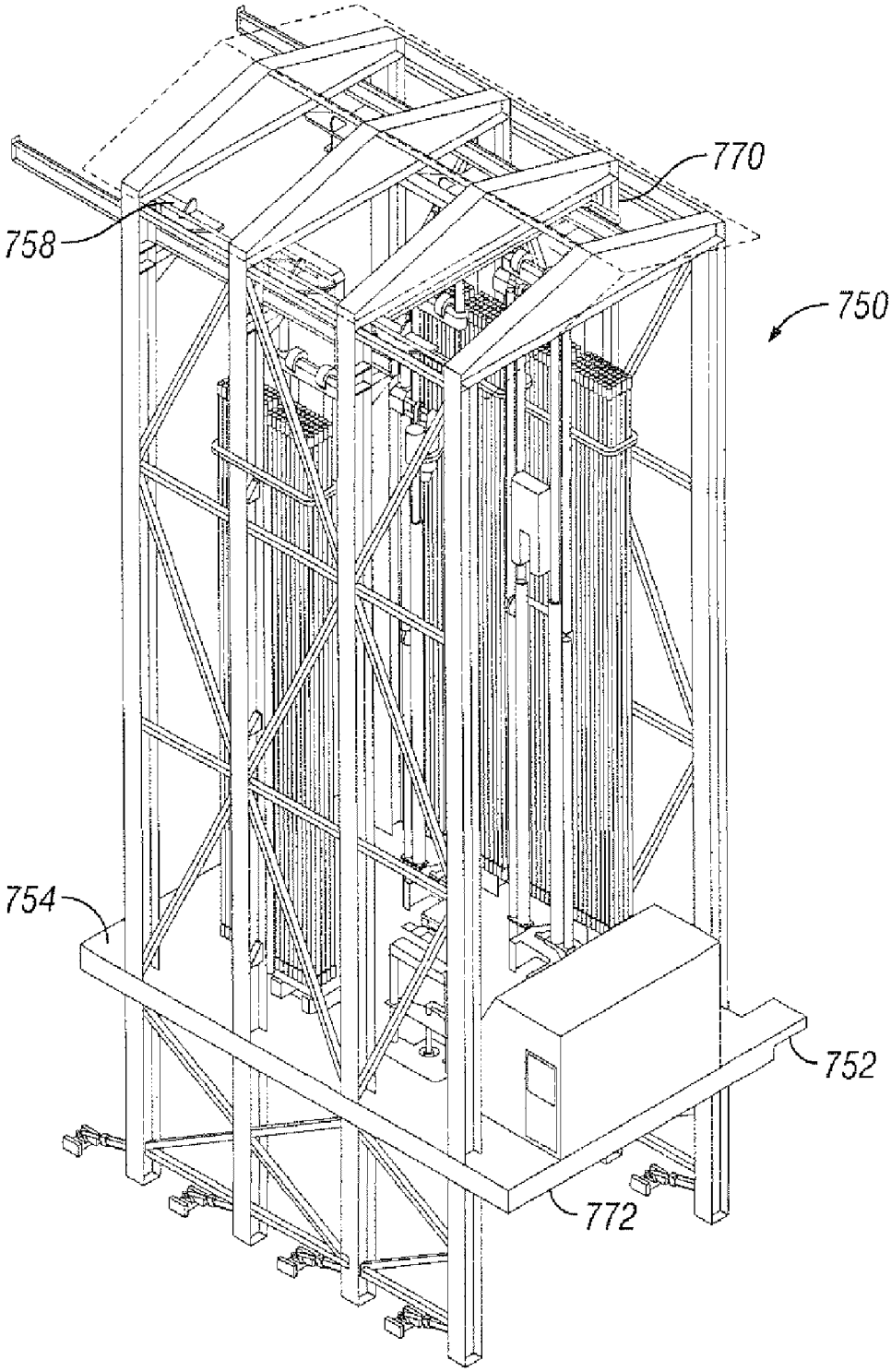
FIG. 20A is a perspective view of a system according to the present invention.
Figure 20B:
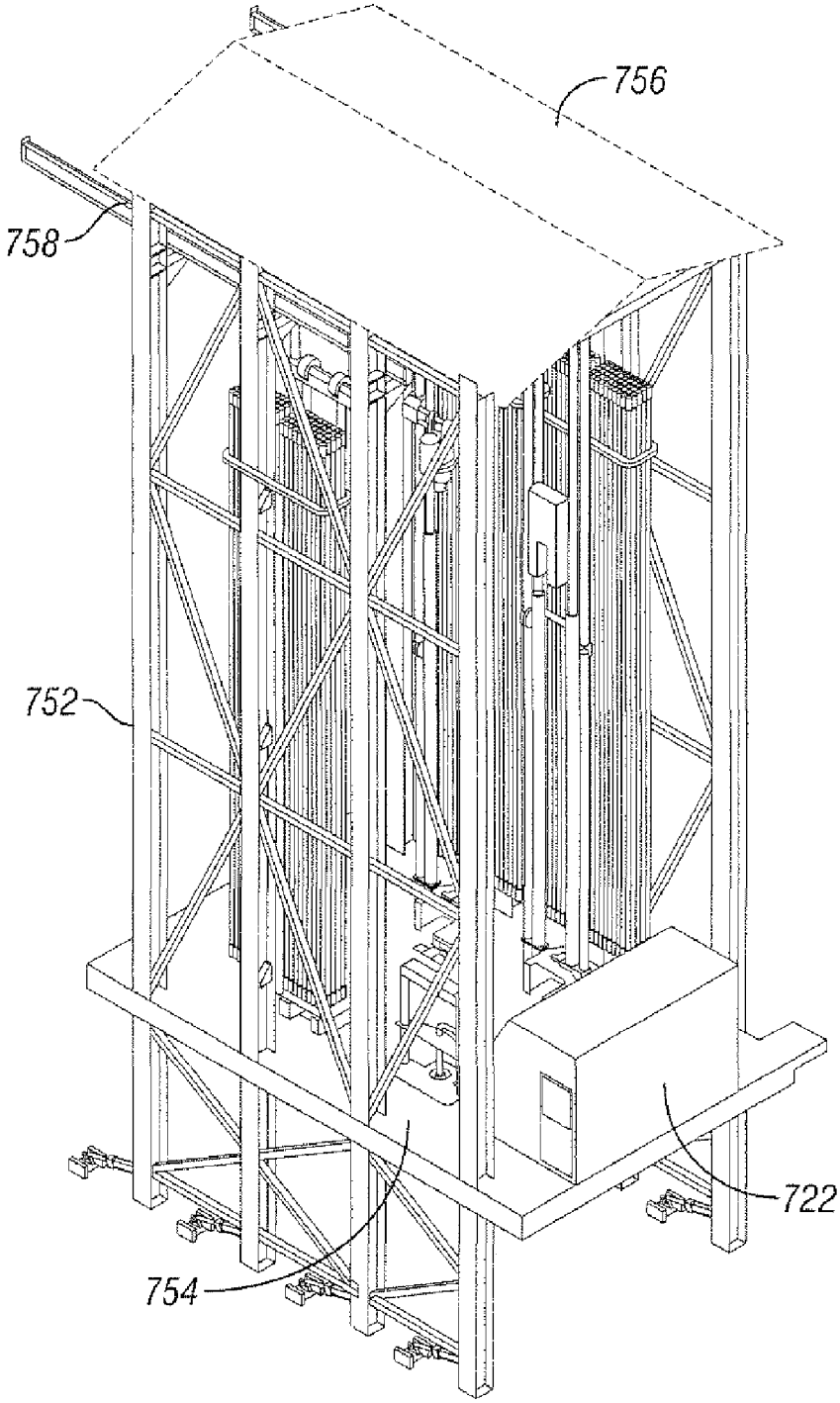
FIG. 20B is a perspective view of the system of FIG. 20A.
Figure 20C:
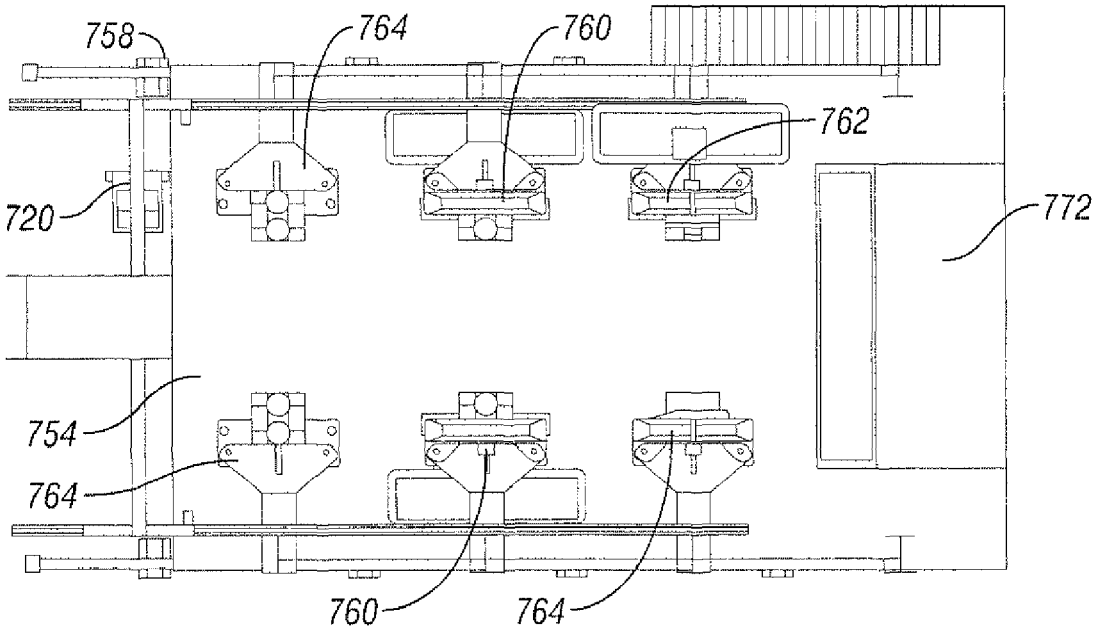
FIG. 20C is a top view of the system of FIG. 20A.

FIGS. 20A-20C disclose a system 750 according to the present invention which has a rig structure 752 with a floor 754 and an optional roof 756. The system 750 may be completely enclosed as described for systems herein above. Multiple well operations machines are movably mounted on the structure 752, including any machine or machines described for any system according to the present invention described above. As shown in FIG. 20C, the system 750 has drilling machines 760, a tripping machine 762, and cementing machines 764. A superstructure 758 supports a movable crane 770 which is movable to move any of the machines to a desired location. The system 750 is located over multiple well locations, one well location corresponding to each of the six machines as shown in FIG. 20C. A driller's cabin 772 is like any driller's cabin described above; and, in one aspect, with the machines moved out of the way, is movable down the floor 754.

The present invention, therefore, provides multi-function rigs for producing multiple spaced-apart wellbores from the multi-function rig, the multi-function rig in certain aspects including: a base, the base overlying multiple wellbore locations; multiple machines on the base; each machine of the multiple machines for accomplishing a task related to producing a wellbore; each machine movable on and with respect to the base to positions adjacent a plurality of the wellbore locations for operation thereat so that multiple wellbores are producible without moving the rig from wellbore location to wellbore location; and movement apparatus movably mounted on the base for moving the machines with respect to the base. Such a rig may have one or some, in any possible combination, of the following: the multiple machines including multiple drilling machines and at least one tripping machine and/or at least one cementing machine and/or at least one auxiliary drilling machine for drilling a conductor portion of the wellbores; the multiple machines including at least one heater installation machine; the multiple machines including at least one casing drilling machine; the multiple machines including at least one casing machine; the multiple machines including at least one cementing machine; the multiple machines including at least one pipe racker apparatus, the at least one pipe racker apparatus located behind (not between a machine and a well location) a machine of the multiple machines; a driller's cabin from which a person can view all machines of the multiple machines in operation; wherein the driller's cabin is movable on the base to view the rig and/or multiple machines in operation; wherein the base is generally rectangular or not; wherein each of the wellbores as produced is a cased cemented wellbore; pressure control equipment operatively positioned at each wellbore location; wherein the pressure control equipment is one of flowline apparatus, blowout preventer apparatus, and diverter; wherein the pressure control equipment supports drilling loads (e.g., the loads are supported by a blowout preventer apparatus, a frame therearound, and/or a wellhead); wherein the multiple machines are capable of conducting multiple operations simultaneously at least two well locations; pipe racker apparatus which is a pipe racker with generally vertically oriented tubulars or a pipe racker with generally non-vertically oriented tubulars; auxiliary drilling apparatus for drilling an upper portion of the wellbores; control system apparatus for selectively controlling the multiple machines; and/or wherein the control system apparatus controls the multiple machines to automatically operate to perform their functions; and/or shaker apparatuses and a mud pit or pits within the rig structure and selectively movable out therefrom, and, in one aspect, the shaker apparatuses and the mud pit(s) movable away from the base independently of any pressure control apparatuses and/or BOP's at each well location.

In conclusion, therefore, it is seen that the present invention and the embodiments disclosed herein and those covered by the appended claims are well adapted to carry out the objectives and obtain the ends set forth. Certain changes can be made in the subject matter without departing from the spirit and the scope of this invention. It is realized that changes are possible within the scope of this invention and it is further intended that each element or step recited in any of the following claims is to be understood as referring to the step literally and/or to all equivalent elements or steps. The following claims are intended to cover the invention as broadly as legally possible in whatever form it may be utilized. The invention claimed herein is new and novel in accordance with 35 U.S.C. §102 and satisfies the conditions for patentability in §102. The invention claimed herein is not obvious in accordance with 35 U.S.C. §103 and satisfies the conditions for patentability in §103. The inventors may rely on the Doctrine of Equivalents to determine and assess the scope of their invention and of the claims that follow as they may pertain to apparatus not materially departing from, but outside of, the literal scope of the invention as set forth in the following claims. All patents and applications identified herein are incorporated fully herein for all purposes. It is the express intention of the applicant not to invoke 35 U.S.C. §112, paragraph 6 for any limitations of any of the claims herein, except for those in which the claim expressly uses the words 'means for' together with an associated function. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

What is claimed is:

1. A multi-function rig for performing rig operations on a plurality of spaced-apart wellbore locations at a single wellbore location site, said multi-function rig configured to be movable between multiple wellbore location sites, the multi-function rig comprising:

a rig structure configured to be positioned adjacent to said plurality of spaced-apart wellbore locations at said single wellbore location site;

a plurality of machines operatively coupled to said rig structure and configured to perform at least one of said rig operations on each of said plurality of spaced-apart wellbore locations, wherein each of said plurality of machines is configured to be supported by at least one pressure-retaining device associated with at least one of said plurality of spaced-apart wellbore locations while performing said at least one of said rig operations, and wherein at least one of said plurality of machines is configured to be movable relative to said rig structure to positions proximate at least one of said plurality of spaced-apart wellbore locations without moving said multi-function rig from said single wellbore location site; and at least one of said plurality of machines being configured as a drilling machine to perform a drilling operation, and configured to be movable relative to said rig structure to positions proximate at least one of said plurality of spaced-apart wellbore locations.

2. The multi-function rig of claim 1, wherein said rig structure comprises a rig floor, a base, a framework, and a support structure.

3. The multi-function rig of claim 1, wherein said rig operations comprise at least one of a drilling operation, a completions operation, and a workover operation.

4. The multi-function rig of claim 1, further comprising a movement apparatus disposed on or adjacent to said rig structure, said movement apparatus being configured to move at least one of said plurality of machines relative to said rig structure.

5. The multi-function rig of claim 4, wherein said movement apparatus is further configured to position said at least one of said plurality of machines above at least one pressure-retaining device associated with at least one of said plurality of spaced-apart wellbore locations.

6. The multi-function rig of claim 1, wherein said multi-function rig is configured for onshore applications.

7. The multi-function rig of claim 1, wherein said multi-function rig is configured for offshore applications.

8. The multi-function rig of claim 1, wherein each of said plurality of machines is configured to perform said rig operations simultaneously at a plurality of said spaced-apart wellbore locations.

9. The multi-function rig of claim 1, wherein said plurality of machines comprises at least one tripping machine.

10. The multi-function rig of claim 1, wherein said plurality of machines comprises at least one heater installation machine.

11. The multi-function rig of claim 1, wherein said plurality of machines comprises at least one casing drilling machine.

12. The multi-function rig of claim 1, wherein said plurality of machines comprises at least one casing machine.

13. The multi-function rig of claim 1, wherein said plurality of machines comprises at least one cementing machine.

14. The multi-function rig of claim 1, wherein said plurality of machines comprises at least one workover machine.

15. The multi-function rig of claim 1, wherein said plurality of machines comprises at least one coiled tubing unit.

16. The multi-function rig of claim 1, further comprising a driller cabin.

17. The multi-function rig of claim 16, wherein said driller cabin is configured to move relative to said rig structure.

18. The multi-function rig of claim 1, wherein said rig structure comprises a rectangular base.

19. The multi-function rig of claim 1, wherein said rig structure comprises a non-rectangular base.

20. The multi-function rig of claim 1, wherein at least one of said plurality of spaced-apart wellbore locations is a cased cemented wellbore.

21. The multi-function rig of claim 1, further comprising said at least one pressure-retaining device, wherein said at least one pressure-retaining device comprises at least one of a wellhead and pressure control equipment.

22. The multi-function rig of claim 21, wherein at least one of said plurality of machines comprises a frame structure configured to be supported by said at least one pressure-retaining device.

23. The multi-function rig of claim 22, wherein said frame structure is configured to support drilling loads.

24. The multi-function rig of claim 21, wherein said pressure control equipment comprises a flowline apparatus.

25. The multi-function rig of claim 21, wherein said pressure control equipment comprises a blowout preventer apparatus.

26. The multi-function rig of claim 21, wherein said pressure control equipment comprises a diverter apparatus.

27. The multi-function rig of claim 21, wherein said at least one pressure-retaining device is configured to support drilling loads.

28. The multi-function rig of claim 1, further comprising auxiliary drilling equipment disposed proximate said rig structure, said auxiliary drilling equipment being configured to drill an upper portion of a wellbore.

29. The multi-function rig of claim 1, further comprising a control system configured for selective control of said plurality of machines.

30. The multi-function rig of claim 29, wherein said control system is configured to control said plurality of machines to perform automatic operations.

31. The multi-function rig of claim 1, further comprising a shaker system disposed on said rig structure and a mud pit proximate said shaker system.

32. A method for performing rig operations on a plurality of spaced-apart wellbore locations at a single wellbore location site, said method comprising:

providing a single multi-function rig comprising a rig structure and a plurality of machines operatively coupled to said rig structure to perform said rig operations, wherein at least one of said rig operations comprises a drilling operation and said multi-function rig is configured to be movable between multiple wellbore location sites;

configuring each of said plurality of machines to perform at least one of said rig operations on each of said plurality of spaced-apart wellbore locations;

configuring each of said plurality of machines to be supported by at least one pressure-retaining device associated with at least one of said plurality of spaced-apart wellbore locations while performing said at least one of said rig operations;

configuring at least one of said plurality of machines to be movable relative to said rig structure to positions proximate at least one of said plurality of spaced-apart wellbore locations without moving said multi-function rig from said single wellbore location site, wherein at least one of said plurality of machines configured to be movable relative to said rig structure is further configured as a drilling machine to perform said drilling operation;

positioning said multi-function rig adjacent to said plurality of spaced-apart wellbore locations at said single wellbore location site;

moving said at least one of said plurality of machines configured as a drilling machine proximate at least one of said plurality of spaced-apart wellbore locations; and performing a drilling operation on said at least one of said plurality of spaced-apart wellbore locations using said at least one of said plurality of machines that is configured as a drilling machine.

33. The method of claim 32, wherein said rig structure further comprises a rig floor, a base, a framework, and a support structure.

34. The method of claim 32, wherein said rig operations comprise at least one of a drilling operation, a completions operation, and a workover operation.

35. The method of claim 32, said method further comprising moving at least one of said plurality of machines relative to said rig structure, wherein moving said at least one of said plurality of machines comprises providing a movement apparatus disposed on or adjacent to said rig structure.

36. The method of claim 35, wherein said movement apparatus comprises a crane.

37. The method of claim 36, said method further comprising using said crane to move at least one of said plurality of machines from a first position to a second position relative to said rig structure.

38. The method of claim 32, said method further comprising wherein said rig operations are performed onshore.

39. The method of claim 32, said method further comprising wherein said rig operations are performed offshore.

40. The method of claim 32, said method further comprising performing a plurality of said rig operations simultaneously at a plurality of said spaced-apart wellbore locations.

41. The method of claim 40, wherein performing a plurality of said rig operations simultaneously comprises supporting each of said plurality of machines performing at least one of said plurality of said rig operations from said at least one pressure-retaining device associated with each of said plurality of said spaced-apart wellbore locations where said rig operations are performed.

42. The method of claim 32, said method further comprising utilizing said plurality of machines to drill a wellbore and perform a tripping operation at said drilled wellbore.

43. The method of claim 32, said method further comprising utilizing said plurality of machines to drill a plurality of wellbores and perform tripping operations at each of said plurality of drilled wellbores.

44. The method of claim 32, said method further comprising performing said rig operations at a first wellbore location site and moving said multi-function rig to a second wellbore location site for performing additional rig operations thereat.

45. The method of claim 32, said method further comprising installing a heater apparatus in a drilled wellbore using a heater installation machine operatively coupled to said rig structure.

46. The method of claim 32, said method further comprising producing a cased wellbore using a casing drilling machine operatively coupled to said rig structure.

47. The method of claim 32, said method further comprising casing a previously drilled wellbore using a casing machine operatively coupled to said rig structure.

48. The method of claim 32, said method further comprising cementing a previously cased wellbore using a cementing machine operatively coupled to said rig structure.

49. The method of claim 32, wherein configuring each of said plurality of machines to be supported by said at least one pressure-retaining device comprises configuring each of said plurality of machines to be supported by at least one of a wellhead and pressure control equipment associated with at least one of said spaced-apart wellbore locations.

50. The method of claim 49, said method further comprising configuring said at least one pressure-retaining device to support drilling loads.

51. The method of claim 32, wherein configuring at least one of said plurality of machines to be supported by said at least one pressure-retaining device comprises providing a frame structure and configuring said frame structure to be supported by said at least one pressure-retaining device.

52. The method of claim 51, said method further comprising configuring said frame structure to support drilling loads.

53. The method of claim 51, wherein said plurality of machines comprises at least one pipe racker system disposed proximate said frame structure.

54. The method of claim 32, said multi-function rig further comprising a control system configured to selectively control said plurality of machines.

55. The method of claim 32, wherein said plurality of machines comprises at least one workover machine.

56. The method of claim 55, further comprising performing one of a completions or workover operation using said workover machine.

57. The method of claim 32, wherein said plurality of machines comprises at least one coiled tubing unit.

58. The method of claim 57, further comprising performing one of a drilling, completions, or workover operation using said coiled tubing unit.

59. The method of claim 32, wherein said plurality of machines comprises at least one pipe racker system.

60. The method of claim 59, wherein said pipe racker system comprises a pipe racker, said pipe racker being configured to support vertically oriented tubulars.

61. The method of claim 59, wherein the pipe racker system comprises a pipe racker, said pipe racker being configured to support non-vertically oriented tubulars.

62. The method of claim 59, said method further comprising tripping in or out of a wellbore utilizing said pipe racker system.

63. The method of claim 32, said method further comprising drilling an upper portion of a wellbore using an auxiliary drilling unit disposed proximate said rig structure.

64. The method of claim 32, said method further comprising automatically operating said plurality of machines using a control system.

65. The method of claim 32, wherein performing said drilling operation comprises supporting said at least one of said plurality of machines configured as a drilling machine from at least one pressure-retaining device associated with said at least one of said plurality of spaced-apart wellbore locations.

66. A method for performing rig operations with a single multi-function rig configured to be movable between multiple wellbore location sites, said method comprising:

positioning said multi-function rig at a first wellbore location site comprising a first plurality of spaced-apart wellbore locations, said multi-function rig comprising a plurality of machines operatively coupled to said multi-function rig and configured to perform at least one of said rig operations on each of said first plurality of spaced-apart wellbore locations, wherein each of said plurality of machines is configured to be supported by at least one pressure-retaining device associated with at least one of said plurality of spaced-apart wellbore locations while performing said at least one of said rig operations, at least one of said rig operations is a drilling operation, and at least one of said plurality of machines is configured as a drilling machine to perform said drilling operation;

performing said drilling operation on at least two of said first plurality of spaced-apart wellbore locations using said at least one of said plurality of machines configured as a drilling machine, wherein said drilling operation performed on each of said at least two of said plurality of spaced-apart wellbore locations are performed while said multi-function drilling rig remains positioned at said first wellbore location site.

67. The method of claim 66, wherein performing drilling operations on at least two of said first plurality of spaced-apart wellbore locations comprises disposing said at least one of said plurality of machines configured as a drilling machine at a first spaced-apart wellbore location, performing drilling operations on said first spaced-apart wellbore location, moving said at least one of said plurality of machines configured as a drilling machine to a second spaced-apart wellbore location, and performing drilling operations on said second spaced-apart wellbore location.

68. The method of claim 67, wherein moving said at least one of said plurality of machines configured as a drilling machine comprises providing a movement apparatus disposed on or adjacent to said multi-function rig.

69. The method of claim 67, wherein performing drilling operations on said first spaced-apart wellbore location comprises supporting said at least one of said plurality of machines configured as a drilling machine from said at least one pressure-retaining device associated with said first spaced-apart wellbore location, and wherein performing drilling operations on said second spaced-apart wellbore location comprises supporting said at least one of said plurality of machines configured as a drilling machine from at least one pressure-retaining device associated with said second spaced-apart wellbore location.

70. The method of claim 66, said method further comprising moving said multi-function rig to a second wellbore location site comprising a second plurality of spaced-apart wellbore locations and performing rig operations on at least one of said second plurality of spaced-apart wellbore locations.

71. The method of claim 66, wherein said rig operations comprise at least one of a drilling operation, a completions operation, and a workover operation.

72. The method of claim 71, said method further comprising operating at least two of said plurality of machines to perform at least one of said rig operations simultaneously on at least two of said first plurality of spaced-apart wellbore locations.

73. The method of claim 66, wherein at least one of said plurality of machines is configured to perform one of a drilling operation, a tripping operation, a casing operation, a cementing operation, a completions operation, and a workover operation.

74. The method of claim 66, wherein at least one of said plurality of machines is configured as one of a tripping machine, a casing drilling machine, a casing machine, a cementing machine, a workover machine, a coiled tubing unit and a heater installation machine.

* * * * *